US006593074B2

(12) United States Patent
Hioki et al.

(10) Patent No.: US 6,593,074 B2
(45) Date of Patent: Jul. 15, 2003

(54) SILVER HALIDE PHOTOGRAPHIC EMULSION, PRODUCING METHOD OF THE SAME, AND SILVER HALIDE PHOTOGRAPHIC MATERIAL CONTAINING THE SAME

(75) Inventors: Takanori Hioki, Minami Ashigara (JP); Noboru Hikichi, Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/888,505

(22) Filed: Jun. 26, 2001

(65) Prior Publication Data

US 2002/0018974 A1 Feb. 14, 2002

(30) Foreign Application Priority Data

Jun. 26, 2000 (JP) ..... 2000-191519

(51) Int. Cl.[7] ..... G03C 1/005; G03C 1/494

(52) U.S. Cl. ..... 430/584; 430/517; 430/570; 430/576; 430/581

(58) Field of Search ..... 430/517, 570, 430/576, 581, 584

(56) References Cited

U.S. PATENT DOCUMENTS

| | | | | | |
|---|---|---|---|---|---|
| 4,030,927 | A | * | 6/1977 | Tani | 430/550 |
| 4,097,284 | A | * | 6/1978 | Tani | 430/576 |
| 4,956,254 | A | * | 9/1990 | Washizu et al. | 430/339 |
| 6,258,509 | B1 | * | 7/2001 | Usami et al. | 430/270.19 |

* cited by examiner

*Primary Examiner*—Geraldine Letscher
(74) *Attorney, Agent, or Firm*—Birch, Stewart, Kolasch & Birch, LLP

(57) ABSTRACT

A silver halide photographic emulsion is disclosed, which comprises at least one dye or sensitizing dye having at least one organic counter ion; and also a silver halide photographic emulsion layer containing the above dye or sensitizing dye and a method of producing the above silver halide photographic emulsion are disclosed.

16 Claims, No Drawings

SILVER HALIDE PHOTOGRAPHIC EMULSION, PRODUCING METHOD OF THE SAME, AND SILVER HALIDE PHOTOGRAPHIC MATERIAL CONTAINING THE SAME

FIELD OF THE INVENTION

The present invention relates to a silver halide photographic emulsion stable in quality, and/or improved in dyeing property, and/or capable of reducing the amount of an organic solvent to be added, relates to a method for producing a silver halide photographic material containing the silver halide photographic emulsion, relates to a silver halide photographic emulsion stable in quality and/or improved in dyeing property, and relates to a silver halide photographic material containing the silver halide photographic emulsion.

BACKGROUND OF THE INVENTION

Every effort has been expended to improve the quality of the silver halide photographic emulsion and the silver halide photographic material (the increment of sensitivity, the reduction of the residual color after processing, the improvement of the storage stability, etc.). Although the improvement of the quality is being realized, it is still a difficult problem to obtain stably high quality products without unevenness among production lots. With respect to the dyeing, there is still a problem that a photographic material dyes with a dye disadvantageously.

Further, when a sensitizing dye is added to an emulsion by being dissolved in an organic solvent, a lot of organic solvent is required if the solubility of the dye is low.

It is known that the sensitizing dye used for spectral sensitization has a great influence on the performances of the silver halide photographic material. Even a slight structural difference of the sensitizing dye largely affects the photographic performances such as sensitivity, fog, storage stability and residual color but it is difficult to forecast the effects in advance, therefore, many engineers have endeavored to synthesize various kinds of sensitizing dyes and examine the photographic performances.

However, a sensitizing dye which is effective for the stabilization of the quality of a silver halide photographic emulsion and a silver halide photographic material, and/or effective for the improvement of dyeing, and/or effective for the reduction of the addition amount of an organic solvent, and the directions as to how to use the same are difficult problems and the development has been required.

SUMMARY OF THE INVENTION

The objects of the present invention are to provide a silver halide photographic emulsion stable in quality, and/or improved in dyeing property, and/or capable of reducing the amount of an organic solvent to be added, relates to a method for producing a silver halide photographic material containing the silver halide photographic emulsion, relates to a silver halide photographic emulsion stable in quality and/or improved in dyeing property, and relates to a silver halide photographic material containing the silver halide photographic emulsion.

As a result of eager investigation of the present inventors, the above objects of the present invention have been accomplished by the following items (1) to (7):

(1) A silver halide photographic emulsion which comprises at least one dye or sensitizing dye having at least one organic counter ion.

(2) The silver halide photographic emulsion as described in the above item (1), wherein said dye or sensitizing dye has at least two anionic groups and/or at least two positive organic counter ions.

(3) The silver halide photographic emulsion as described in the above item (1) or (2), wherein said dye or sensitizing dye has at least one carboxyl group and at least one sulfo group.

(4) The silver halide photographic emulsion as described in the above item (1), (2) or (3), wherein said dye or sensitizing dye is a merocyanine dye having at least one carboxyl group and at least one sulfo group.

(5) A silver halide photographic material which contains at least one silver halide photographic emulsion layer as described in the above item (1), (2), (3) or (4).

(6) A method of producing a silver halide photographic emulsion, which comprises the step of adding the dye or sensitizing dye as described in the above item (1), (2), (3) or (4) to the silver halide photographic emulsion as the solution of an organic solvent.

(7) A silver halide photographic emulsion which is produced by the method as described in the above item (6), a silver halide photographic material which contains at least one said silver halide photographic emulsion, and a producing method of a silver halide photographic material which contains at least one said silver halide photographic emulsion.

The preferred embodiments of the present invention are described above but these items can be further classified in detail into the following items (1) to (15) including the preferred additional factors.

(1) A silver halide photographic emulsion which comprises at least one dye having at least one organic counter ion.

(2) A silver halide photographic emulsion which comprises at least one sensitizing dye having at least one organic counter ion.

(3) The silver halide photographic emulsion as described in the above item (1) or (2), wherein said dye or sensitizing dye has at least one anionic group and/or at least one positive organic counter ion.

(4) The silver halide photographic emulsion as described in the above item (1), (2) or (3), wherein said dye or sensitizing dye has at least two anionic groups and/or at least two positive organic counter ions.

(5) The silver halide photographic emulsion as described in the above item (1), (2), (3) or (4), wherein said dye or sensitizing dye has at least one anionic group other than a sulfo group.

(6) The silver halide photographic emulsion as described in the above item (1), (2), (3), (4) or (5), wherein said dye or sensitizing dye has at least one anionic group other than a sulfo group and at least one sulfo group.

(7) The silver halide photographic emulsion as described in the above item (1), (2), (3), (4), (5) or (6), wherein said dye or sensitizing dye has at least one carboxyl group and at least one sulfo group.

(8) The silver halide photographic emulsion as described in the above item (1), (2), (3), (4), (5), (6) or (7), wherein said dye or sensitizing dye is a merocyanine dye having at least one carboxyl group and at least one sulfo group.

(9) A silver halide photographic material which comprises at least one silver halide photographic emulsion layer as described in the above item (1), (2), (3), (4), (5), (6), (7) or (8).

(10) A method of producing a silver halide photographic emulsion, which comprises the step of adding the dye or sensitizing dye as described in the above item (1), (2), (3), (4), (5), (6), (7) or (8) to the silver halide photographic emulsion as the solution of an organic solvent.

(11) A silver halide photographic emulsion which is produced by the method as described in the above item (10).

(12) A silver halide photographic material which comprises at least one silver halide photographic emulsion as described in the above item (11).

(13) A method of producing a silver halide photographic material which comprises at least one silver halide photographic emulsion as described in the above item (11).

(14) The silver halide photographic emulsion, the silver halide photographic material containing the silver halide photographic emulsion, the method of producing the silver halide photographic emulsion and the method of producing the silver halide photographic material described in any of the above items (1) to (14), wherein said silver halide photographic emulsion is an emulsion in which tabular grains having an aspect ratio of 2 or more occupying 50% or more (in area).

(15) A photothermographic material comprising at least one kind of light-sensitive silver halide and light-insensitive organic silver salt, wherein the photothermographic material comprises the silver halide photographic emulsion as described in any of the above items (1) to (14), and a method of producing the same.

DETAILED DESCRIPTION OF THE INVENTION

The present invention is described in detail below.

Any dyes can be used in the present invention so long as they have an organic counter ion.

Examples of the dyes include a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, an azamethine dye, a coumarin dye, an arylidene dye, an anthraquinone dye, a triphenylmethane dye, an azo dye, azomethine dye, a spiro compound, a metallocene dye, a fluorenone dye, a fulgide dye, a perylene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperylene dye, a porphyrin dye, a chlorophyll dye, a phthalocyanine dye, and a metallic complex dye.

In the present invention, the organic counter ion means a counter ion having at least one carbon atom.

In the present invention, it is more preferred to use a sensitizing dye for spectrally sensitizing a silver halide photographic emulsion.

The dyes or sensitizing dyes preferably used in the present invention are described below.

Those exemplified above as the examples of the dyes are used as the sensitizing dyes in the present invention.

Of the above-described examples, the preferred dyes are polymethine chromophores such as a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, and an azamethine dye, more preferred dyes are a cyanine dye, a merocyanine dye, a trinuclear merocyanine dye (as the basic structure of the trinuclear merocyanine dye, a basic structure represented by formula (I) or (II) in JP-A-3-171135 or represented by formula (I) in JP-A-7-159920 is preferred (the term "JP-A" as used herein means an "unexamined published Japanese patent application")), a tetranuclear merocyanine dye (as the basic structure of the tetranuclear merocyanine dye, a basic structure represented by formula (I) in EP 735415 is preferred), and a rhodacyanine dye, particularly preferred dyes are a merocyanine dye and a rhodacyanine dye, and most preferred dye is a merocyanine dye.

These dyes are described in detail in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515. As the preferred formulae of the dyes, the formulae on pages 32 to 36 in U.S. Pat. No. 5,994,051, and the formulae on pages 30 to 34 in U.S. Pat. No. 5,747,236 can be exemplified. Further, formulae (XI), (XII) and (XIII), columns 21 and 22 in U.S. Pat. No. 5,340,694 are preferred as formulae of the cyanine, merocyanine and rhodacyanine dyes, respectively. However, the numbers of n12, n15, n17 and n18 are not restricted here and regarded as the integers of 0 or more (preferably 4 or less).

In the present invention, a dye (preferably a sensitizing dye) having at least one organic counter ion is used (this is taken as condition 1), and more preferred condition 1 is as follows: 2a, the case where the dye of condition 1 (preferably the sensitizing dye) has at least one anionic group; 2b, the case where the dye of condition 1 has at least one positive counter ion (preferably the case having conditions of 2a and 2b together); 3a, the case where the dye (preferably the sensitizing dye) of condition 1 has at least two anionic groups; 3b, the case where the dye (preferably the sensitizing dye) of condition 1 has at least two positive counter ions (preferably the case having conditions of 3a and 3b together); 4, the case where the dye (preferably the sensitizing dye) of condition 1 has at least one anionic group other than a sulfo group; 5, the case where the dye (preferably the sensitizing dye) of condition 1 has at least one anionic group other than a sulfo group and at least one sulfo group; 6, the case where the dye (preferably the sensitizing dye) of condition 1 has at least one carboxyl group and at least one sulfo group; and 7, the case where the dye (preferably the sensitizing dye) of condition 1 is a merocyanine dye having at least one carboxyl group and at least one sulfo group.

Having more conditions of 1, 2a, 2b, 3a, 3b, 4, 5, 6 and 7 together is preferred, and the case satisfying all the conditions is most preferred.

The sensitizing dye preferably used in the present invention is represented by the following formula (I):

$$(\mathrm{dye}_1)\text{-}(\mathrm{R}_1)_q \qquad \text{(I)}$$

$$\mathrm{M}_1\mathrm{m}_1$$

wherein $\mathrm{dye}_1$ represents a sensitizing dye; $\mathrm{R}_1$ represents an anionic group; q represents an integer of 0 or more, and when q is 2 or more, $\mathrm{R}_1$ i s repeated but repeating $\mathrm{R}_1$'s need not be the same; $\mathrm{M}_1$ represents a counter ion to balance an electric charge; $\mathrm{m}_1$ represents a number bigger than 0, and when $\mathrm{m}_1$ is 2 or more, $\mathrm{M}_1$ is repeated but repeating $\mathrm{M}_1$'s need not be the same, provided that at least one of $\mathrm{M}_1$ represents an organic counter ion.

q preferably represents from 1 to 10, more preferably from 2 to 10, and particularly preferably 2 or 3. $m_1$ preferably represents from 1 to 10, more preferably from 2 to 10, and particularly preferably 2 or 3.

Any substituents having negative electric charge may be used as the anionic group represented by $R_1$, e.g., proton-dissociable acidic groups which dissociate 90% or more of protons at pH 5 to 8 can be exemplified. Specifically, for example, a sulfo group, a carboxyl group, a sulfato group, a phosphoric acid group, and a boric acid group, can be exemplified. In addition to these groups, groups in which protons are dissociated by pka and the ambient pH, e.g., an amino group substituted with an electron attractive group [e.g., a —$CON^-SO_2$— group (a sulfonylcarbamoyl group, a carbonylsulfamoyl group), a —$CON^-CO$— group (a carbonylcarbamoyl group), and an —$SO_2N$—$SO_2$— group (a sulfonylsulfamoyl group), these dissociable groups are described in dissociated form but they can also be described in non-dissociated form (e.g., a —$CONHSO_2$— group, a —CONHCO— group, and an —$SO_2NHSO_2$— group)], and a phenolic hydroxyl group can be exemplified. The more preferred anionic groups represented by $R_1$ are a sulfo group, a carboxyl group, a —$CON^-SO_2$— group, a —$CON^-CO$— group and an —$SO_2N^-SO_2$— group.

The substituents having the above representative anionic groups preferably used in the present invention are represented by the following formulae ($R_{1a}$, $R_{1b}$, $R_{1c}$, $R_{1d}$, $R_{1e}$ and $R_{1f}$).

$$R_{1a}=(A_1)_rCON^-SO_2R_a$$

$$R_{1b}=(A_2)_sSO_2N^-COR_b$$

$$R_{1c}=(A_3)_tCON^{-COR}{}_c$$

$$R_{1d}=(A_4)_uSO_2N^-SO_2R_d$$

$$R_{1e}=(A_5)_x—X$$

(X represents $CO_2^-$, $OSO_3^-$, phosphoric acid or boric acid)

$$R_{1f}=(A_6)_y^-SO_3^-$$

wherein $R_a$, $R_b$, $R_c$ and $R_d$ each represents an alkyl group, an aryl group, a heterocyclic group, an alkoxyl group, an aryloxy group, a heterocyclic oxy group, or an amino group; $A_1$, $A_2$, $A_3$, $A_4$, $A_5$ and $A_6$ each represents a linking group; r, s, t, u, x and y each represents 0 or 1, preferably 1.

The dissociable groups in the formulae are described in dissociated form (e.g., $N^-$, $CO_2^-$), but they can also be described in non-dissociated form (e.g., NH, $CO_2H$).

When a cation is present as the counter ion, it is described as, e.g., ($N^-$, $Na^+$). In a non-dissociated state, it is described as (NH), but taking the cationic compound of the counter ion as a proton, it can also be described as ($N^-$, $Na^+$). The anionic group practically becomes a dissociating state or a non-dissociating state depending upon the ambience such as pH in which the dye is present.

A preferred case as the anionic group is the case where the dye according to the present invention has at least one anionic group other than a sulfo group, a more preferred case is the case where the dye has at least one anionic group other than a sulfo group and at least one sulfo group, and a particularly preferred case is the case where the dye has at least one carboxyl group and at least one sulfo group.

However, in the present invention, it is preferred that at least one anionic group is present in a dissociated form. Further, the case where the dye has at least one positive organic counter ion as the counter ion is preferred.

$M_1$ is included in the formula to show the presence of a cation or an anion when a counter ion is necessary to neutralize the ionic charge of the dye. Representative cations may be either inorganic cations or organic cations and examples include inorganic ions such as a hydrogen ion ($H^+$), an alkali metal ion (e.g., a sodium ion, a potassium ion, a lithium ion), and an alkaline earth metal ion (e.g., a calcium ion), and organic ions such as an ammonium ion {preferably an ammonium ion, e.g., an ammonium ion substituted with a substituted or unsubstituted alkyl, aryl or heterocyclic group having from 1 to 30 carbon atoms [preferably a tetraalkylammonium ion (preferably a tetramethylammonium ion), a trialkylammonium ion (preferably a triethylammonium ion), a 1,8-diazabicyclo[5.4.0]-7-undecenium ion], a substituted or unsubstituted cationic heterocyclic ion having from 1 to 30 carbon atoms (preferably a pyridinium ion, an ethylpyridinium ion)}. Anions may be either inorganic anions or organic anions, and examples include inorganic ions such as a halide anion (e.g., a fluorine ion, a chlorine ion, a bromine ion, an iodine ion), a sulfuric acid ion, a perchloric acid ion, and a tetrafluoroboric acid ion, and organic ions such as a substituted arylsulfonic acid ion (e.g., a p-toluenesulfonic acid ion, a p-chlorobenzene-sulfonic acid ion), an aryldisulfonic acid ion (e.g., a 1,3-benzenedisulfonic acid ion, a 1,5-naphthalenedisulfonic acid ion, a 2,6-naphthalenedisulfonic acid ion), an alkylsulfuric acid ion (e.g., a methylsulfuric acid ion), a thiocyanic acid ion, a picric acid ion, an acetic acid ion, and a trifluoro-methanesulfonic acid ion. In addition, ionic polymers or other dyes having a counter charge to the dye may be used. Further, $CO_2^-$ and $SO_3^-$ can be described as $CO_2H$ and $SO_3H$ when they have hydrogen ions as the counter ions.

$m_1$ represents a number necessary to balance the electric charge. When $m_1$ is 2 or more, $M_1$'s need not be the same.

The sensitizing dye according to the present invention has at least one organic counter ion as the counter ion, preferably two or more organic counter ions. Therefore, at least one (preferably two or more) of $M_1$'s is an organic counter ion. Specifically, the organic counter ions described above in $M_1$ are preferred as the organic counter ions. As the organic counter ion, a cation is preferred when the sensitizing dye has negative electric charge, and an anion is preferred when the sensitizing dye has positive electric charge, but the cation is particularly preferred as the organic counter ion.

Further, the above-described organic ammonium ion is preferred. A preferred ammonium ion is represented by the following formula (A):

(A)

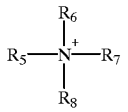

wherein $R_5$, $R_6$, $R_7$ and $R_8$ each represents a hydrogen atom, an alkyl group, an aryl group or a heterocyclic group.

When $R_5$, $R_6$, $R_7$ and $R_8$ each contains a hydrogen atom, it is possible to describe the hydrogen atom in the anionic group side (e.g., $CO_2^-O$ can be described as $CO_2H$ and $SO_3^-$ can be described as $SO_3H$), and in such a case, it can be described in the form not having electric charge formally as follows.

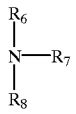

(when $R_5$ represents a hydrogen atom)

The ammonium ion is preferably a trialkylammonium ion, and more preferably a triethylammonium ion.

The sensitizing dye for use in the present invention is described in further detail below.

The sensitizing dye represented by formula (I) is preferably represented by the following formula (X), (XI) or (XII):

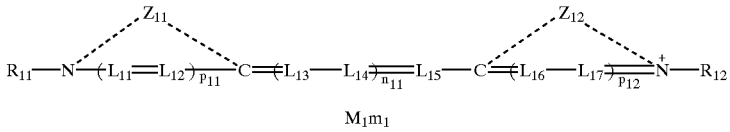

(X)

$M_1m_1$ wherein $L_{11}$, $L_{12}$, $L_{13}$, $L_{14}$, $L_{15}$, $L_{16}$ and $L_{17}$ each represents a methine group; $p_{11}$ and $p_{12}$ each represents 0 or 1; $n_{11}$ represents 0, 1, 2, 3 or 4; $Z_{11}$ and $Z_{12}$ each represents an atomic group necessary to form a nitrogen-containing heterocyclic ring, provided that they may be condensed with a ring; $M_1$ and $m_1$ have the same meaning as in formula (I); and $R_{11}$ and $R_{12}$ each represents an alkyl group, an aryl group or a heterocyclic group.

$L_{11}$, $L_{12}$, $L_{13}$, $L_{14}$, $L_{15}$, $L_{16}$, $L_{17}$, $Z_{11}$, $Z_{12}$, $R_{11}$ and $R_{12}$ are substituted with at least one anionic group represented by $R_1$. More preferably, $R_{11}$ or $R_{12}$ is substituted with the anionic group represented by $R_1$, and especially preferably both $R_{11}$ and $R_{12}$ are substituted with the anionic groups represented by $R_1$. formula (XI)

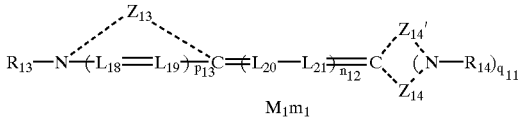

(XI)

$M_1m_1$ wherein $L_{18}$, $L_{19}$, $L_{20}$ and $L_{21}$ each represents a methine group; $p_{13}$ represents 0 or 1; $q_{11}$ represents 0 or 1; $n_{12}$ represents 0, 1, 2, 3 or 4; $Z_{13}$ represents an atomic group necessary to form a nitrogen-containing heterocyclic ring; $Z_{14}$ and $Z_{14}'$ represent an atomic group necessary to form a heterocyclic ring or an acyclic acidic terminal group together with $(N—R_{14})q_{11}$, provided that $Z_{13}$, $Z_{14}$ and $Z_{14}'$ may be condensed with a ring; $M_1$ and ml have the same meaning as in formula (I); $R_{13}$ represents an alkyl group, an aryl group or a heterocyclic group; and $R_{14}$ represents a hydrogen atom, an alkyl group, an aryl group or a heterocyclic group.

$L_{18}$, $L_{19}$, $L_{20}$, $L_{21}$, $Z_{13}$, $Z_{14}$, $Z_{14}'$, $R_{13}$ and $R_{14}$ are substituted with at least one anionic group represented by $R_1$. More preferably, $R_{13}$ or $R_{14}$ is substituted with the anionic group represented by $R_1$, and especially preferably both $R_{13}$ and $R_{14}$ are substituted with the anionic groups represented by $R_1$. formula (XII)

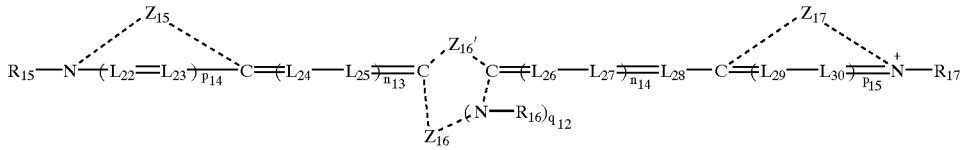

(XII)

$M_1m_1$ wherein $L_{22}$, $L_{23}$, $L_{24}$, $L_{25}$, $L_{26}$, $L_{27}$, $L_{28}$, $L_{29}$ and $L_{30}$ each represents a methine group; $p_{14}$ and $p_{15}$ each represents 0 or 1; $q_{12}$ represents 0 or 1; $n_{13}$ and $n_{14}$ each represents 0, 1, 2, 3 or 4; $Z_{15}$ and $Z_{17}$ each represents an atomic group necessary to form a nitrogen-containing heterocyclic ring; $Z_{16}$ and $Z_{16}'$ represent an atomic group necessary to form a heterocyclic ring together with $(N—R_{16})$ $q_{12}$, provided that $Z_{15}$, $Z_{16}$, $Z_{16}'$ and $Z_{17}$ may be condensed with a ring; $M_1$ and $m_1$ have the same meaning as in formula (I); $R_{15}$ and $R_{17}$ each represents an alkyl group, an aryl group or a heterocyclic group; and $R_{16}$ represents a hydrogen atom, an alkyl group, an aryl group or a heterocyclic group.

$L_{22}$, $L_{23}$, $L_{24}$, $L_{25}$, $L_{26}$, $L_{27}$, $L_{28}$, $L_{29}$, $L_{30}$, $Z_{15}$, $Z_{16}$, $Z_{16}'$, $Z_{17}$, $R_{15}$, $R_{16}$ and $R_{17}$ are substituted with at least one anionic group represented by $R_1$. More preferably, $R_{15}$, $R_{16}$ or $R_{17}$ is substituted with the anionic group represented by $R_1$, especially preferably at least two of $R_{1\ 5}$, $R_{16}$ and $R_{17}$ are substituted with the anionic groups represented by $R_1$, and most preferably all of $R_{15}$, $R_{16}$ and $R_{17}$ are substituted with the anionic groups represented by $R_1$.

Of formulae (X), (XI) and (XII), formulae (XI) and (XII) are preferred and formula (XI) is more preferred.

The sensitizing dyes represented by formulae (I), (X), (XI) and (XII) are described in detail below.

In the present invention, when a specific part of a compound is called "a group", the compound may be substituted with one or more substituents (until the possible maximum number), even if the part itself is not substituted. For example, "an alkyl group" means a substituted or unsubstituted alkyl group. Further, the substituents which can be used in the compound according to the present invention include every substituents irrespective of the presence or absence of substitution. For example, the later-described V can be exemplified.

$Z_{11}$, $Z_{12}$, $Z_{13}$, $Z_{15}$ and $Z_{17}$ each represents an atomic group necessary to form a nitrogen-containing heterocyclic ring, preferably a 5- or 6-membered nitrogen-containing heterocyclic ring, and each group may be condensed with a ring, and the condensed ring may be an aromatic ring or a non-aromatic ring, preferably an aromatic ring, such as an aromatic hydrocarbon ring, e.g., a benzene ring and a naphthalene ring, and an aromatic heterocyclic ring, e.g., a pyrazine ring and a thiophene ring.

The examples of the nitrogen-containing heterocyclic rings include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a tellurazoline nucleus, a tellurazole nucleus, a benzotellurazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus, and a pyrimidine nucleus. Preferred of them are a benzothiazole nucleus, a benzoxazole nucleus, a 3,3-dialkylindolenine nucleus (e.g., 3,3-dimethylindolenine), a benzimidazole nucleus, a 2-pyridine nucleus, a 4-pyridine nucleus, a 2-quinoline nucleus, 4-quinoline nucleus, a 1-isoquinoline nucleus, and a 3-isoquinoline nucleus, more preferred are a benzothiazole nucleus, a benzoxazole nucleus, a 3,3-dialkylindolenine nucleus (e.g., 3,3-dimethylindolenine), and a benzimidazole nucleus, still more preferred are a benzoxazole nucleus, a benzothiazole nucleus, and a benzimidazole nucleus, and most preferred are a benzoxazole nucleus and a benzothiazole nucleus.

Taking the substituents on these nitrogen-containing heterocyclic rings as V, the substituents represented by V are not particularly restricted and any substituents may be used. For example, V represents a halogen atom, an alkyl group [(including a cycloalkyl group and a bicycloalkyl group), an alkenyl group (including a cycloalkenyl group and a bicycloalkenyl group), and an alkynyl group are also to be included], an aryl group, a heterocyclic group (i.e., a hetero ring group), a cyano group, a hydroxyl group, a nitro group, a carboxyl group, an alkoxyl group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phosphinyl group, a phosphinyloxy group, a phosphinylamino group, a phospho group, a silyl group, a hydrazino group, a ureido group, and other well-known substituents.

More specifically, V represents a halogen atom (e.g., fluorine, chlorine, bromine, iodine), an alkyl group { [a straight chain, branched, cyclic, substituted or unsubstituted alkyl group including an alkyl group [preferably an alkyl group having from 1 to 30 carbon atoms (e.g., methyl, ethyl, n-propyl, isopropyl, t-butyl, n-octyl, eicosyl, 2-chloroethyl, 2-cyanoethyl, 2-ethylhexyl)], a cycloalkyl group [preferably a substituted or unsubstituted cycloalkyl group having from 3 to 30 carbon atoms (e.g., cyclohexyl, cyclopentyl, 4-n-dodecylcyclohexyl)], a bicycloalkyl group [preferably a substituted or unsubstituted bicycloalkyl group having from 5 to 30 carbon atoms, i.e., a monovalent group obtained by eliminating one hydrogen atom from bicycloalkane having from 5 to 30 carbon atoms (e.g., bicyclo[1,2,2]heptan-2-yl, bicyclo[2,2,2]octan-3-yl), and a tricyclo structure having many ring structures; the alkyl group in the substituent described below (e.g., the alkyl group in an alkylthio group) represents the alkyl group of such a concept and further includes an alkenyl group and an alkynyl group], an alkenyl group [a straight chain, branched, cyclic, substituted or unsubstituted alkenyl group including an alkenyl group (preferably a substituted or unsubstituted alkenyl group having from 2 to 30 carbon atoms (e.g., vinyl, allyl, prenyl, geranyl, oleyl)), a cycloalkenyl group (preferably a substituted or unsubstituted cycloalkenyl group having from 3 to 30 carbon atoms, i.e., a monovalent group obtained by eliminating one hydrogen atom from cycloalkene having from 3 to 30 carbon atoms (e.g., 2-cyclopenten-1-yl, 2-cyclohexen-1-yl)), a bicycloalkenyl group (a substituted or unsubstituted bicycloalkenyl group, preferably a substituted or unsubstituted bicycloalkenyl group having from 5 to 30 carbon atoms, i.e., a monovalent group obtained by eliminating one hydrogen atom from bicycloalkene having one double bond (e.g., bicyclo[2,2,1]hepto-2-en-1-yl, bicyclo-[2,2,2]octo-2-en-4-yl))] an alkynyl group [preferably a substituted or unsubstituted alkynyl group having from 2 to 30 carbon atoms (e.g., ethynyl, propargyl, trimethylsilylethynyl)}, an aryl group [preferably a substituted or unsubstituted aryl group having from 6 to 30 carbon atoms (e.g., phenyl, p-tolyl, naphthyl, m-chlorophenyl, o-hexadecanoylaminophenyl)], a heterocyclic group [preferably a monovalent group obtained by eliminating one hydrogen atom from a 5- or 6-membered, substituted or unsubstituted, aromatic or non-aromatic heterocyclic compound, more preferably a 5- or 6-membered aromatic heterocyclic group having from 3 to 30 carbon atoms (e.g., 2-furyl, 2-thienyl, 2-pyrimidinyl, 2-benzothiazolyl), further, a cationic heterocyclic group, e.g., 1-methyl-2-pyridinio, 1-methyl-2-quinolinio may be included], a cyano group, a hydroxyl group, a nitro group, a carboxyl group, an alkoxyl group [preferably a substituted or unsubstituted alkoxyl group having from 1 to 30 carbon atoms (e.g., methoxy, ethoxy, isopropoxy, t-butoxy, n-octyloxy, 2-methoxyethoxy)], an aryloxy group [preferably a substituted or unsubstituted aryloxy group having from 6 to 30 carbon atoms (e.g., phenoxy, 2-methylphenoxy, 4-t-butylphenoxy, 3-nitrophenoxy, 2-tetradecanoylaminophenoxy)], a silyloxy group [preferably a silyloxy group having from 3 to 20 carbon atoms (e.g., trimethylsilyloxy, t-butyldimethylsilyloxy)], a heterocyclic oxy group [preferably a substituted or unsubstituted heterocyclic oxy group having from 2 to 30 carbon atoms (e.g., 1-phenyltetrazol-5-oxy, 2-tetrahydropyranyloxy)], an acyloxy group [preferably a formyloxy group, a substituted or unsubstituted alkylcarbonyloxy group having from 2 to 30 carbon atoms, a substituted or unsubstituted arylcarbonyloxy group having from 6 to 30 carbon atoms (e.g., formyloxy, acetyloxy, pivaloyloxy, stearoyloxy, benzoyloxy, p-methoxyphenylcarbonyloxy)], a carbamoyloxy group [preferably a substituted or unsubstituted carbamoyloxy group having from 1 to 30 carbon atoms (e.g., N,N-dimethylcarbamoyloxy, N,N-diethylcarbamoyloxy, morpholinocarbonyloxy, N,N-di-n-octylaminocarbonyloxy, N-n-octylcarbamoyloxy)], an alkoxycarbonyloxy group [preferably a substituted or unsubstituted alkoxycarbonyloxy group having from 2 to 30 carbon atoms (e.g., methoxycarbonyloxy, ethoxycarbonyloxy, t-butoxycarbonyloxy, n-octylcarbonyloxy)], an aryloxycarbonyloxy group [preferably a substituted or unsubstituted aryloxycarbonyloxy group having from 7 to 30 carbon atoms (e.g., phenoxycarbonyloxy, p-methoxyphenoxycarbonyloxy, p-n-hexadecyloxyphenoxycarbonyloxy)], an amino group [preferably an amino group, a substituted or unsubstituted alkylamino group having from 1 to 30 carbon atoms, a substituted or unsubstituted anilino group having from 6 to 30 carbon atoms (e.g., amino, methylamino, dimethylamino, anilino, N-methylanilino, diphenylamino)], an ammonio group [preferably an ammonio group, an ammonio group substituted with a substituted or unsubstituted alkyl, aryl or heterocyclic ring having from 1 to 30 carbon atoms (e.g., trimethylammonio, triethylammonio, diphenylmethylammonio)], an acylamino group [preferably a formylamino group, a substituted or unsubstituted alkylcarbonylamino group having from 1 to 30 carbon atoms, a substituted or unsubstituted arylcarbonylamino group having from 6 to 30 carbon atoms (e.g., formylamino, acetylamino, pivaloylamino, lauroylamino, benzoylamino, 3,4,5-tri-n-octyloxyphenylcarbonylamino)], an aminocarbonylamino group [preferably a substituted or unsubstituted aminocarbonylamino group having from 1 to 30 carbon atoms (e.g., carbamoylamino, N,N-dimethylaminocarbonylamino, N,N-diethylaminocarbonylamino, morpholinocarbonylamino)], an alkoxycarbonylamino group [preferably a substituted or unsubstituted alkoxycarbonylamino group having from 2 to 30 carbon atoms (e.g., methoxycarbonylamino, ethoxycarbonylamino, t-butoxycarbonylamino, n-octadecyloxycarbonylamino, N-methylmethoxycarbonylamino)], an aryloxycarbonylamino group [preferably a substituted or unsubstituted aryloxycarbonylamino group having from 7 to 30 carbon atoms (e.g., phenoxycarbonylamino, p-chlorophenoxycarbonylamino, m-(n-octyloxyphenoxycarbonyl-amino)], a sulfamoylamino group [preferably a substituted or unsubstituted sulfamoylamino group having from 0 to 30 carbon atoms (e.g., sulfamoylamino, N,N-dimethylaminosulfonylamino, N-n-octylaminosulfonylamino)], an alkylsulfonylamino group and arylsulfonylamino group [preferably a substituted or unsubstituted alkylsulfonylamino group having from 1 to 30 carbon atoms, a substituted or unsubstituted arylsulfonylamino group having from 6 to 30 carbon atoms (e.g., methylsulfonylamino, butylsulfonylamino, phenylsulfonylamino, 2,3,5-trichlorophenylsulfonylamino, p-methylphenylsulfonyl-amino)], a mercapto group, an alkylthio group [preferably a substituted or unsubstituted alkylthio group having from 1 to 30 carbon atoms (e.g., methylthio, ethylthio, n-hexadecylthio)], an arylthio group [preferably a substituted or unsubstituted arylthio group having from 6 to 30 carbon atoms (e.g., phenylthio, p-chlorophenylthio, m-methoxyphenylthio)], a heterocyclic thio group [preferably a substituted or unsubstituted heterocyclic thio group having from 2 to 30 carbon atoms (e.g., 2-benzothiazolylthio, 1-phenyltetrazol-5-ylthio)], a sulfamoyl group [preferably a substituted or unsubstituted sulfamoyl group having from 0 to 30 carbon atoms (e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl)], a sulfo group, an alkylsulfinyl group and arylsulfinyl group [preferably a substituted or unsubstituted alkylsulfinyl group having from 1 to 30 carbon atoms, a substituted or unsubstituted arylsulfinyl group having from 6 to 30 carbon atoms (e.g., methylsulfinyl, ethylsulfinyl, phenylsulfinyl, p-methylphenylsulfinyl)], an alkylsulfonyl group and arylsulfonyl group [preferably a substituted or unsubstituted alkylsulfonyl group having from 1 to 30 carbon atoms, a substituted or unsubstituted arylsulfonyl group having from 6 to 30 carbon atoms (e.g., methylsulfonyl, ethylsulfonyl, phenylsulfonyl, p-methylphenylsulfonyl)], an acyl group [preferably a formyl group, a substituted or unsubstituted alkylcarbonyl group having from 2 to 30 carbon atoms, a substituted or unsubstituted arylcarbonyl group having from 7 to 30 carbon atoms, a substituted or unsubstituted heterocyclic carbonyl group having from 4 to 30 carbon atoms bonded to the carbonyl group via a carbon atom (e.g., acetyl, pivaloyl, 2-chloroacetyl, stearoyl, benzoyl, p-n-octyloxyphenylcarbonyl, 2-pyridylcarbonyl, 2-furylcarbonyl)], an aryloxycarbonyl group [preferably a substituted or unsubstituted aryloxycarbonyl group having from 7 to 30 carbon atoms (e.g., phenoxycarbonyl, o-chlorophenoxycarbonyl, m-nitrophenoxycarbonyl, p-t-butylphenoxycarbonyl)], an alkoxycarbonyl group [preferably a substituted or unsubstituted alkoxycarbonyl group having from 2 to 30 carbon atoms (e.g., methoxycarbonyl, ethoxycarbonyl, t-butoxycarbonyl, n-octadecyloxycarbonyl)], a carbamoyl group [preferably a substituted or unsubstituted carbamoyl group having from 1 to 30 carbon atoms (e.g., carbamoyl, N-methylcarbamoyl, N,N-dimethylcarbamoyl, N,N-di-n-octylcarbamoyl, N-(methyl-sulfonyl) carbamoyl)], an arylazo group and heterocyclic azo group [preferably a substituted or unsubstituted arylazo group having from 6 to 30 carbon atoms, a substituted or unsubstituted heterocyclic azo group having from 3 to 30 carbon atoms (e.g., phenylazo, p-chlorophenylazo, 5-ethylthio-1,3,4-thiadiazol-2-ylazo)], an imido group (preferably N-succinimido, N-phthalimido), a phosphino group [preferably a substituted or unsubstituted phosphino group having from 2 to 30 carbon atoms (e.g., dimethylphosphino, diphenylphosphino, methylphenoxyphosphino)], a phosphinyl group [preferably a substituted or unsubstituted phosphinyl group having from 2 to 30 carbon atoms (e.g., phosphinyl, dioctyloxyphosphinyl, diethoxyphosphinyl)], a phosphinyloxy group [preferably a substituted or unsubstituted phosphinyloxy group having from 2 to 30 carbon atoms (e.g., diphenoxyphosphinyloxy, dioctyloxyphosphinyloxy)], a phosphinylamino group [preferably a substituted or unsubstituted phosphinylamino group having from 2 to 30 carbon atoms (e.g., dimethoxyphosphinylamino, dimethylaminophosphinylamino)], a phospho group, a silyl group [preferably a substituted or unsubstituted silyl group having from 3 to 30 carbon atoms (e.g., trimethylsilyl, t-butyldimethylsilyl, phenyldimethylsilyl)], a hydrazino group [preferably a substituted or unsubstituted hydrazino group having from 0 to 30 carbon atoms (e.g., trimethylhydrazino)], or a ureido group [preferably a substituted or unsubstituted ureido group having from 0 to 30 carbon atoms (e.g., N,N-dimethylureido)].

Rings may be condensed. For example, an aromatic or non-aromatic hydrocarbon ring or heterocyclic ring may form a polycyclic condensed ring in combination. Examples of such rings include a benzene ring, a naphthalene ring, an anthracene ring, a quinoline ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, an isoquinoline ring, a phthalazine ring, a naphthyridine ring, a quinoxaline ring, a quinoxazoline ring, a carbazole ring, a phenanthridine ring, an acridine ring, a phenanthroline ring, a thianthrene ring, a chromene ring, a xanthene ring, a phenoxthine ring, a phenothiazine ring, and a phenazine ring.

Of the above functional groups, those having hydrogen atoms maybe substituted with the above substituents after removing the hydrogen atoms. The examples of such functional groups include an alkylcarbonylaminosulfonyl group, an arylcarbonylaminosulfonyl group, an alkylsulfonylaminocarbonyl group, and an arylsulfonylaminocarbonyl group, and the examples of the substituted groups include a methylsulfonylaminocarbonyl group, a p-methylphenylsulfonylaminocarbonyl group, an acetylaminosulfonyl group, and a benzoylaminosulfonyl group.

The more preferred examples of the substituents V on $Z_{11}$, $Z_{12}$, $Z_{13}$, $Z_{15}$ and $Z_{17}$ are the above-described alkyl group, aryl group, alkoxyl group, halogen atom, aromatic condensed ring and carboxyl group.

As the specific examples of the heterocyclic rings formed by $Z_{11}$, $Z_{12}$, $Z_{13}$, $Z_{15}$ and $Z_{17}$, the similar rings to those exemplified as the examples formed by $Z_{11}$, $Z_{12}$, $Z_{13}$, $Z_{14}$ and $Z_{16}$ disclosed in columns 23 and 24 in U.S. Pat. No. 5,340,694 can be exemplified.

$Z_{14}$ and $Z_{14}'$ represent an atomic group necessary to form a heterocyclic ring or an acyclic acidic terminal group together with $(N—R_{14})q_{11}$. The heterocyclic ring (preferably a 5- or 6-membered heterocyclic ring) is not particularly limited but an acidic nucleus is preferred. The acidic nucleus and the acyclic acidic terminal group are described below. Any forms of acidic nuclei and acyclic acidic terminal groups of the generally used merocyanine dyes can be used in the present invention. Preferably, $Z_{14}$ represents a thiocarbonyl group, a carbonyl group, an ester group, an acyl group, a carbamoyl group, a cyano group or a sulfonyl group, more preferably a thiocarbonyl group or a carbonyl group. $Z_{14}^{1}$ represents the remaining atomic group necessary to form the acidic nucleus and the acyclic acidic terminal group. For forming an acyclic acidic terminal group, a thiocarbonyl group, a carbonyl group, an ester group, an acyl group, a carbamoyl group, a cyano group or a sulfonyl group are preferably used.

$q_{11}$ represents 0 or 1, preferably 1.

The acidic nucleus and the acyclic acidic terminal group for use in the present invention are described, for example, in James, *The Theory of the Photographic Process,* 4th Ed., pp. 198 to 200, Macmillan (1977). The acyclic acidic terminal group here means acidic, i.e., electron-attractive, terminal groups which do not form a ring.

As the acidic nuclei and the acyclic acidic terminal groups, those disclosed in U.S. Pat. Nos. 3,567,719, 3,575,869, 3,804,634, 3,837,862, 4,002,480, 4,925,777 and JP-A-3-167546, U.S. Pat. Nos. 5,994,051 and 5,747,236 can be exemplified.

The acidic nucleus is preferably used to form a heterocyclic ring (preferably a 5- or 6-membered nitrogen-containing heterocyclic ring) comprising carbon, nitrogen and/or chalcogen atoms (typically, oxygen, sulfur, selenium, tellurium), more preferably used to form a 5- or 6-membered nitrogen-containing heterocyclic ring comprising carbon, nitrogen and/or chalcogen atoms (typically, oxygen, sulfur, selenium, tellurium). Specifically, for example, the following nuclei are exemplified.

For example, 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,5-dione, 2-thiooxazoline-2,4-dione, isooxazolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide, and 3-dicyanomethine-2,3-dihydrobenzo[d]thiophene-1,1-dioxide can be exemplified.

Further examples include nuclei having exo-methylene structure obtained by substituting a carbonyl group or a thiocarbonyl group constituting these nuclei on the active methylene position of acidic nuclei, and nuclei having exo-methylene structure obtained by substituting a carbonyl group or a thiocarbonyl group on the active methylene position of active methylene compounds having the structure of ketomethylene and cyanomethylene which are raw materials of acyclic acidic terminal groups.

However, the nuclei having a carbonyl group or a thiocarbonyl group is preferred to the nuclei having exo-methylene structure obtained by substituting a carbonyl group or a thiocarbonyl group, the nuclei having a thiocarbonyl group is more preferred.

These acidic nuclei and acyclic acidic terminal groups may be substituted or condensed with the above substituents V or rings.

The preferred examples of the heterocyclic rings formed by $Z_{14}$, $Z_{14}'$ and $(N—R_{14})q_{11}$ include hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid and 2-thiobarbituric acid, the more preferred examples are hydantoin, 2- or 4-thiohydantoin, 2-oxazolin-5-one, rhodanine, barbituric acid and 2-thiobarbituric acid, the particularly preferred are 2- or 4-thiohydantoin, 2-oxazolin-5-one, rhodanine and barbituric acid, and the most preferred is rhodanine.

As the heterocyclic rings formed by $Z_{16}$, $Z_{16}'$ and $(N—R_{16})q_{11}$, the same as those described in the heterocyclic rings formed by $Z_{14}$, $Z_{14}'$ and $(N—R_{14})q_{11}$ can be exemplified. The preferred are those obtained by eliminating an oxo group or a thioxo group from the acidic nuclei described in the explanation of the heterocyclic ring of $Z_{14}$, $Z_{14}'$ and $(N—R_{14})q_{11}$.

The more preferred are those obtained by eliminating an oxo group or a thioxo group from the acidic nuclei exemplified as the specific examples of $Z_{14}$, $Z_{14}'$ and $(N—R_{14})q_{11}$.

The still further preferred are those obtained by eliminating an oxo group or a thioxo group from hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, or 2-thiobarbituric acid, the particularly preferred are those obtained by eliminating an oxo group or a thioxo group from hydantoin, 2- or 4-thiohydantoin, 2-oxazolin-5-one, rhodanine, barbituric acid, or 2-thiobarbituric acid, and the most preferred are those obtained by eliminating an oxo group or a thioxo group from 2- or 4-thiohydantoin, 2-oxazolin-5-one, or rhodanine.

$q_{12}$ represents 0 or 1, preferably 1.

$R_{11}$, $R_{12}$, $R_{13}$, $R_{15}$ and $R_{17}$ each represents an alkyl group, an aryl group or a heterocyclic group. $R_{14}$ and $R_{16}$ each represents a hydrogen atom, an alkyl group, an aryl group or a heterocyclic group, $R_{14}$ and $R_{16}$ each preferably represents an alkyl group, an aryl group or a heterocyclic group. The specific examples of the alkyl group, aryl group and heterocyclic group represented by $R_{11}$, $R_{12}$, $R_{13}$, $R_{14}$, $R_{15}$, $R_{16}$ and $R_{17}$ include an alkyl group, e.g., an unsubstituted alkyl group having from 1 to 18, preferably from 1 to 7, and particularly preferably from 1 to 4, carbon atoms (e.g., methyl, ethyl, propyl, isopropyl, butyl, isobutyl, hexyl, octyl, dodecyl, octadecyl), and a substituted alkyl group having from 1 to 18, preferably from 1 to 7, and particularly preferably from 1 to 4, carbon atoms [e.g., an alkyl group substituted with the above-described substituent V can be exemplified, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy) ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), a heterocyclic group-substituted alkyl group (e.g., 2-(pyrrolidin-2-one-1-yl)ethyl, tetrahydrofurfuryl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl), an alkylsulfonylsulfamoylalkyl group (e.g., methanesulfonylsulfamoylmethyl)], an unsubstituted aryl group having from 6 to 20, preferably from 6 to 10, and more preferably from 6 to 8, carbon atoms (e.g., phenyl, 1-naphthyl), and a substituted aryl group having from 6 to 20, preferably from 6 to 10, and more preferably from 6 to 8, carbon atoms (e.g., the aryl groups substituted with V described above as the substituent, specifically p-methoxyphenyl, p-methylphenyl, p-chlorophenyl can be exemplified), an unsubstituted heterocyclic group having from 1 to 20, preferably from 3 to 10, and more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), and a substituted heterocyclic group having from 1 to 20, preferably from 3 to 10, and more preferably from 4 to 8, carbon atoms (e.g., the heterocyclic groups substituted with V described above as the substituent, specifically 5-methyl-2-thienyl, 4-methoxy-2-pyridyl).

The preferred groups represented by $R_{11}$, $R_{12}$, $R_{13}$, $R_{14}$, $R_{15}$, $R_{16}$ and $R_{17}$ are the alkyl, aryl and heterocyclic groups substituted with the above-described anionic group represented by $R_1$, and the more preferred are the groups represented by the above formulae $R_{1a}$, $R_{1b}$, $R_{1c}$, $R_{1d}$, $R_{1e}$ and $R_{1f}$.

In the next place, the anionic group is explained below.

When the sensitizing dye has one anionic group (represented by $R_1$), it is preferably an anionic group other than a sulfo group (preferably a carboxyl group, a —$CON^-SO_2$— group, a —$CON^-CO$— group, an —$SO_2N^-SO_2$— group, more preferably a carboxyl group), and when the sensitizing dye has two or more anionic groups (represented by $R_1$), the case where at least one anionic group is an anionic group other than a sulfo group (preferably a carboxyl group, a —$CON^-SO_2$— group, a —$CON^-CO$— group, an —$SO_2N^-SO_2$— group, more preferably a carboxyl group), and at least one anionic group is a sulfo group is preferred.

The substituents having representative anionic groups represented by formulae ($R_{1a}$, $R_{1b}$, $R_{1c}$, $R_{1d}$, $R_{1e}$ and $R_{1f}$) are described below.

$R_a$, $R_b$, $R_c$ and $R_d$ each represents an alkyl group, an aryl group, a heterocyclic group, an alkoxyl group, an aryloxy group, a heterocyclicoxy group, or an amino group. The preferred examples of the groups are as follows.

For example, an unsubstituted alkyl group having from 1 to 18, preferably from 1 to 10, and more preferably from 1 to 5, carbon atoms (e.g., methyl, ethyl, propyl, butyl), a substituted alkyl group having from 1 to 18, preferably from 1 to 10, and more preferably from 1 to 5, carbon atoms (hydroxymethyl, trifluoromethyl, benzyl, carboxyethyl, ethoxycarbonylmethyl, acetylaminomethyl, in addition, an unsaturated hydrocarbon group preferably having from 2 to 18, more preferably from 3 to 10, and particularly preferably from 3 to 5, carbon atoms (e.g., vinyl, ethynyl, 1-cyclohexenyl, benzylidyne, benzylidene) is also included in a substituted alkyl group), a substituted or unsubstituted aryl group having from 6 to 20, preferably from 6 to 15, more preferably from 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl), a heterocyclic group (which may be substituted) having from 1 to 20, preferably from 2 to 10, more preferably from 4 to 6, carbon atoms (e.g., pyridyl, 5-methylpyridyl, thienyl, furyl, morpholino, tetrahydrofurfuryl), an alkoxyl group having from 1 to 10, preferably from 1 to 8, carbon atoms (e.g., methoxy, ethoxy, 2-methoxyethoxy, 2-hydroxyethoxy, 2-phenylethoxy), an aryloxy group having from 6 to 20, preferably from 6 to 12, more preferably from 6 to 10, carbon atoms (e.g., phenoxy, p-methylphenoxy, p-chlorophenoxy, naphthoxy), a heterocyclic oxy group having from 1 to 20, preferably from 3 to 12, and more preferably from 3 to 10, carbon atoms (which means an oxy group substituted with a heterocyclic group, e.g., 2-thienyloxy, 2-morpholinoxy), and an amino group having from 0 to 20, preferably from 0 to 12, and more preferably from 0 to 8, carbon atoms (e.g., amino, methylamino, dimethylamino, ethylamino, diethylamino, hydroxyethylamino, benzylamino, anilino, diphenylamino) can be exemplified. These groups may further be substituted with the above-described V.

$R_a$, $R_b$, $R_c$ and $R_d$ each more preferably represents a methyl group, an ethyl group or a hydroxyethyl group, and particularly preferably a methyl group.

$A_1$, $A_2$, $A_3$, $A_4$, $A_5$ and $A_6$ each represents a linking group and any linking group can be used in the present invention. The preferred examples are shown below.

The linking group represented by $A_1$, $A_2$, $A_3$, $A_4$, $A_5$ or $A_6$ is preferably composed of an atom or an atomic group containing at least one of a carbon atom, a nitrogen atom, a sulfur atom and an oxygen atom. The linking group is preferably a linking group having from 0 to 100, preferably from 1 to 20, carbon atoms composed of one or more in combination of an alkylene group (e.g., methylene, ethylene, trimethylene, tetramethylene, pentamethylene), an arylene group (e.g., phenylene, naphthylene), an alkenylene (e.g., ethenylene, propenylene), an alkynylene (e.g., ethynylene, propynylene), an amido group, an ester group, a sulfoamido group, a sulfonic ester group, a ureido group, a sulfonyl group, a sulfinyl group, a thioether group, an ether group, a carbonyl group, —N (Va)— (wherein $V_a$ represents a hydrogen atom or a monovalent substituent, and the above-described V can be exemplified as the monovalent substituent), and a heterocyclic divalent group (e.g., a 6-chloro-1,3,5-triazine-2,4-diyl group, a pyrimidine-2,4-diyl group, a quinoxaline-2,3-diyl group).

The linking group may further have a substituent represented by V described above, or may contain a ring (e.g. an aromatic or non-aromatic hydrocarbon ring or a heterocyclic ring).

The linking group is more preferably a divalent linking group having from 1 to 10 carbon atoms composed of one or more in combination of an alkylene group having from 1 to 10 carbon atoms (e.g., methylene, ethylene, trimethylene, tetramethylene), an arylene group having from 6 to 10 carbon atoms (e.g., phenylene, naphthylene), an alkenylene having from 2 to 10 carbon atoms (e.g., ethenylene, propenylene), an alkynylene having from 2 to 10 carbon atoms (e.g., ethynylene, propynylene), an ether group, an amido group, an ester group, a sulfoamido group, and a sulfonic ester group. The linking group may be substituted with V described above.

The preferred cases with respect to $R_{11}$, $R_{12}$, $R_{13}$, $R_{14}$, $R_{15}$, $R_{16}$ and $R_{17}$ are described below.

It is preferred that at least one of $R_{11}$, and $R_{12}$, at least one of $R_{13}$ and $R_{14}$, and at least one of $R_{15}$, $R_{16}$ and $R_{17}$ be an alkyl group, an aryl group or a heterocyclic group having an anionic group represented by $R_1$, and it is more preferred that both of $R_{11}$ and $R_{12}$, both of $R_{13}$ and $R_{14}$, and at least two of $R_{15}$, $R_{16}$ and $R_{17}$ (especially preferably all of $R_{15}$, $R_{16}$ and $R_{17}$) be an alkyl group, an aryl group or a heterocyclic group having an anionic group represented by $R_1$. As the anionic group, the cases described above are preferred.

That is, when the sensitizing dye has one anionic group (represented by $R_1$), it is preferably an anionic group other than a sulfo group (preferably a carboxyl group, a —$CON^-SO_2$— group, a —$CON^-CO$— group, an —$SO_2N^-SO_2$— group, more preferably a carboxyl group), and when the sensitizing dye has two or more anionic groups (represented by $R_1$), the case where at least one anionic group is an anionic group other than a sulfo group (preferably a carboxyl group, a —$CON^{31}SO_2$— group, a —$CON^{31}CO$— group, an —$SO_2N^-SO_2$— group, more preferably a carboxyl group), and at least one anionic group is a sulfo group is preferred.

When r, s, t, u, x and y each represents 1 in $R_{1a}$, $R_{1b}$, $R_{1c}$, $R_{1d}$, $R_{1e}$ and $R_{1f}$, these substituents are preferably used as the groups represented by $R_{11}$, $R_{12}$, $R_{13}$, $R_{14}$, $R_{15}$, $R_{16}$ or $R_{17}$.

As $R_{1a}$, $R_{1b}$, $R_{1c}$, $R_{1d}$, $R_{1e}$ and $R_{1f}$ in that case, specifically a carboxyalkyl group (e.g., 2-carboxyethyl, 3-carboxypropyl, 4-carboxybutyl, carboxymethyl, 2-carboxyethoxyethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), an alkylsulfonylcarbamoylalkyl group (e.g., methanesulfonylcarbamoylmethyl, methanesulfonylcarbamoylethoxyethyl), an acylcarbamoylalkyl group (e.g., acetylcarbamoylmethyl), an acylsulfamoylalkyl group (e.g., acetylsulfamoylmethyl), and an alkylsulfonylsulfamoylalkyl group (e.g., methanesulfonylsulfamoylmethyl) can be exemplified.

The particularly preferred examples of $R_{1a}$, $R_{1b}$, $R_{1c}$, $R_{1d}$ and $R_{1e}$ are shown below.

$R_{98}$=$CH_2CO_2^-$ $R_{99}$=$(CH_2)_2CO_2^-$ $R_{100}$=$(CH_2)_3CO_2^-$ $R_{101}$=$CH_2CO\overline{N}SO_2CH_3$ $R_{102}$=$CH_2SO_2\overline{N}COCH_3$ $R_{103}$=$CH_2CO\overline{N}COCH_3$ $R_{104}$=$CH_2SO_2\overline{N}SO_2CH_3$ $R_{105}$=$(CH_2)_2CO\overline{N}SO_2CH_3$ $R_{106}$=$CH_2CO\overline{N}SO_2C_2H_5$ $R_{107}$=$(CH_2)_3CO\overline{N}SO_2CH_3$ $R_{108}$=$(CH_2)_3SO_2\overline{N}COCH_3$ $R_{109}$=$(CH_2)_3CO\overline{N}COCH_3$ $R_{110}$=$(CH_2)_3SO_2\overline{N}SO_2CH_3$ Of $R_{98}$ to $R_{110}$, younger numbers are preferred, and $R_{98}$ is most preferred. A sulfoalkyl group (e.g., 2-sulfoethyl, 3-sulfopropyl, 3-sulfobutyl, 4-sulfobutyl) is preferred as $R_{1f}$.

In this case also, similarly to the case where $R_{11}$, $R_{12}$, $R_{13}$, $R_{14}$, $R_{15}$, $R_{16}$ or $R_{17}$ is substituted with the above-described anionic group (represented by $R_1$), when the sensitizing dye has one anionic group, $R_{1a}$, $R_{1b}$, $R_{1c}$, $R_{1d}$ or $R_{1e}$ is preferred and $R_{1e}$ wherein X represents $CO_2^-$ is more preferred. When there are two or more anionic groups, the case where at least one is $R_{1a}$, $R_{1b}$, $R_{1c}$, $R_{1d}$ or $R_{1e}$ (more preferably $R_{1e}$ wherein X represents $CO_2^-$) and at least one is $R_{1f}$ is preferred.

$L_{11}$, $L_{12}$ $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$ and $L_{30}$ each represents a methine group. Each of these methine groups represented by $L_{11}$ to $L_{30}$ may have a substituent and the above-described V can be exemplified as the substituents. For example, a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-diethylbarbituric acid), a halogen atom (e.g., chlorine, bromine, iodine, fluorine), an alkoxyl group having from 1 to 15, preferably from 1 to 10, more preferably from 1 to 5, carbon atoms (e.g., methoxy, ethoxy), an amino group having from 0 to 15, preferably from 2 to 10, more preferably from 4 to 10, carbon atoms (e.g., methylamino, N,N-dimethylamino, N-methyl-N-phenylamino, N-methylpiperazino), an alkylthio group having from 1 to 15, preferably from 1 to 10, more preferably from 1 to 5, carbon atoms (e.g., methylthio, ethylthio), an arylthio group having from 6 to 20, preferably from 6 to 12, more preferably from 6 to 10, carbon atoms (e.g., phenylthio, p-methylphenylthio) can be exemplified as the substituents. Each of these methine groups may form a ring together with other methine groups or can form a ring together with $Z_{11}$ to $Z_{17}$, and $R_{11}$ to $R_{17}$.

$L_{11}$, $L_{12}$, $L_{16}$, $L_{17}$, $L_{18}$, $L_{19}$, $L_{22}$, $L_{23}$, $L_{29}$ and $L_{30}$ each preferably represents an unsubstituted methine group.

$n_{11}$, $n_{12}$, $n_{13}$ and $n_{14}$ each represents 0, 1, 2, 3 or 4, preferably 0, 1, 2 or 3, and more preferably 0, 1 or 2. When $n_{11}$, $n_{12}$, n13 and $n_{14}$ each represents 2 or more, a methine group is repeated but they need not be the same.

$p_{11}$, $p_{12}$, $p_{13}$, $p_{14}$ and $p_{15}$ each represents 0 or 1, and preferably 0.

$R_5$, $R_6$, $R_7$ and $R_8$ each represents a hydrogen atom, an alkyl group, an aryl group, or a heterocyclic group, and the specific examples are the same as those exemplified in $R_{11}$, $R_{12}$, $R_{13}$, $R_{14}$, $R_{15}$, $R_{16}$ or $R_{17}$, preferably a hydrogen atom and an alkyl group. More preferably, one of $R_5$, $R_6$, $R_7$ and $R_8$ represents a hydrogen atom, and each of the remaining three represents an alkyl group [preferably a substituted or unsubstituted alkyl group preferably having from 1 to 18, more preferably from 1 to 7, and particularly preferably from 1 to 4, carbon atoms (preferably an unsubstituted alkyl group)], or all of $R_5$, $R_6$, $R_7$ and $R_8$ represent an alkyl group [preferably a substituted or unsubstituted alkyl group preferably having from 1 to 18, more preferably from 1 to 7, and particularly preferably from 1 to 4, carbon atoms (preferably an unsubstituted alkyl group)]. A particularly preferred case is that one of $R_5$, $R_6$, $R_7$ and $R_8$ represents a hydrogen atom, and the remaining three represents an alkyl group. The most preferred is the case where a counter ion represented by formula (A) is triethylammonium.

The specific examples of the sensitizing dyes according to the present invention (formula (I), and formulae (X), (XI) and (XII) of the subordinate concept are also included) are shown below, but the present invention is not limited thereto.

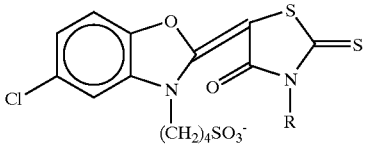

2M (1)

$R = CH_2CO_2^-$, $M = \overset{+}{N}(C_2H_5)_3$ (2)

$R = CH_2CO_2^-$, M = 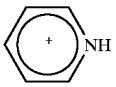

(3)

$R = CH_2CO_2^-$, M = 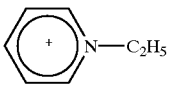

(4)

$R = CH_2CO^-SO_2CH_3$, $M = \overset{+}{N}(C_2H_5)_3$

-continued (5)

$R = CH_2CO_2^-$, M = 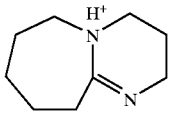

(6)

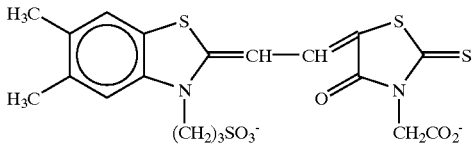

$2(\overset{+}{H}N(C_2H_5)_3)$

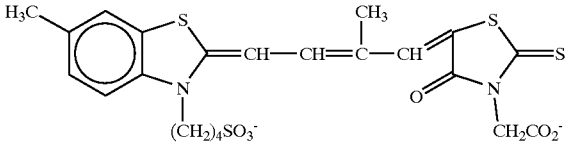

2M (7)

$M = \overset{+}{H}N(C_2H_5)_3$ (8)

$M = \overset{+}{H}N(^nC_4H_9)_3$ (9)

$M = \overset{+}{N}(CH_3)_4$

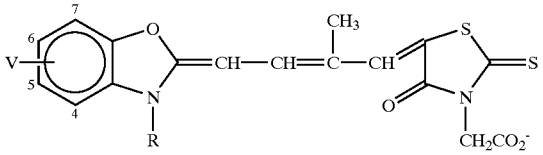

$2(\overset{+}{H}N(C_2H_5)_3)$ (10)

$V = 5, 6\text{-}(CH_3)_2$, $R = (CH_2)_3SO_3^-$ (11)

$V = 6, 7\text{-benzo}$, $R = (CH_2)_4SO_3^-$ (12)

$V = H$, $R = (CH_2)_2SO_3^-$

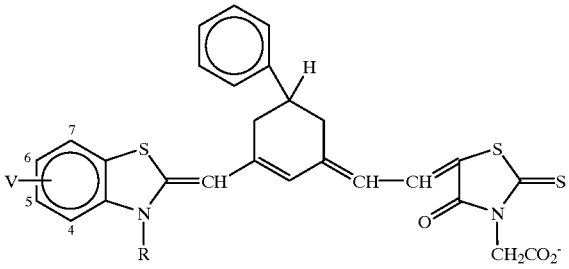

2 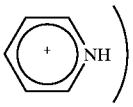

(13)

$V = 6, 7\text{-benzo}$, $R = CH_2CON^-SO_2CH_3$ (14)

$V = 5, 6\text{-}(OCH_3)_2$, $R = CH_2SO_2N^-COCH_3$ (15)

$V = H$, $R = (CH_2)_2OSO_3^-$ (16)

$V = 5, 6\text{-benzo}$, $R = CH_2CO_2^-$

-continued (17)

V = 5-phenyl, R = $(CH_2)_2O(CH_2)_2CO_2^-$

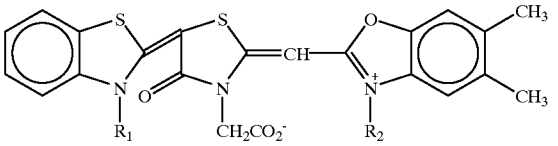

(51)

$R_1 = (CH_2)_3SO_3^-$, $R_2 = C_2H_5$, $M = H\overset{+}{N}(C_2H_5)_3$ (52)

$R_1 = (CH_2)_4SO_3^-$, $R_2 = (CH_2)_4SO_3^-$, $M = 2(N\overset{+}{H}(C_2H_5)_3)$ (53)

$R_1 = (CH_2)_4SO_3^-$, $R_2 = CH_2CO\overset{-}{N}SO_2CH_3$, $M = 2(N\overset{+}{H}(C_2H_5)_3)$ (54)

$R_1 = CH_2CO_2^-$, $R_2 = CH_2CO_2^-$, M = 2 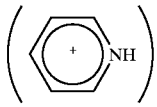

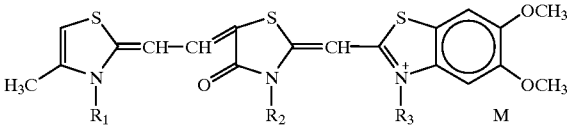

(55)

$R_1, R_3 = (CH_2)_4SO_3^-$, $R_2 = CH_2CO_2^-$, $M = 2(H\overset{+}{N}(C_2H_5)_3)$ (56)

$R_1 = (CH_2)_3SO_3^-$, $R_2 = C_2H_5$, $R_3 = CH_2CO_2^-$, $M = H\overset{+}{N}(C_2H_5)_3$ (57)

$R_1 = (CH_2)_4SO_3^-$, $R_2 = CH_2CO_2^-$, $R_3 = CH_2CO\overset{-}{N}SO_2CH_3$,
$M = 2(H\overset{+}{N}(C_2H_5)_3)$

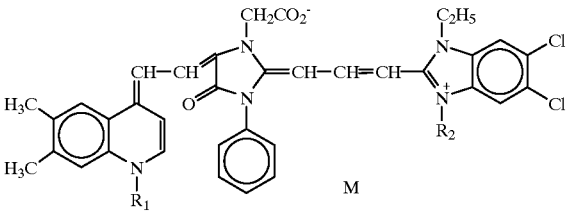

(58)

$R_1 = R_2 = (CH_2)_4SO_3^-$, $M = 2(H\overset{+}{N}(C_2H_5))$ (59)

$R_1 = R_2 = CH_2CO_2^-$, $M = 2(\overset{+}{N}(C_2H_5)_4)$

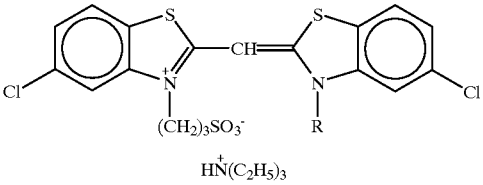

(100)

$R = CH_2CO_2^-$ (101)

$R = CH_2CO\overset{-}{N}SO_2CH_3$

-continued

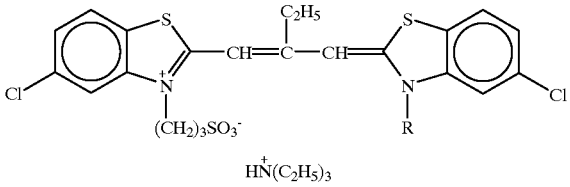

(102)

$R = CH_2CO_2^-$ (103)

$R = CH_2CO\overset{-}{N}SO_2CH_3$ (104)

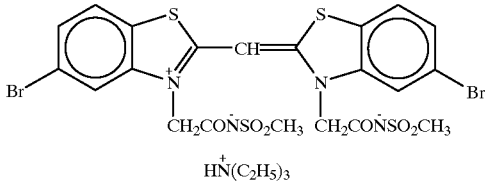

(105)

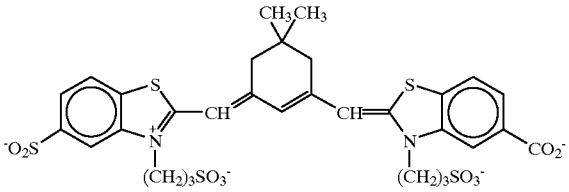

(106)

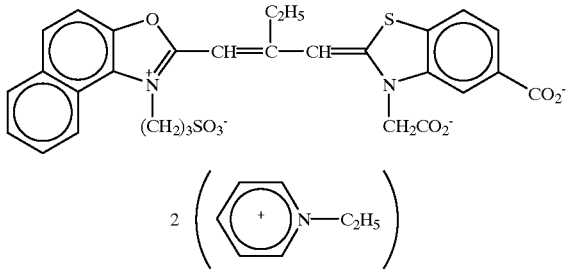

(151)

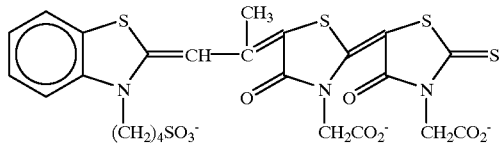

(152)

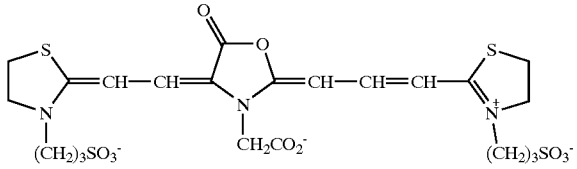

-continued (153)

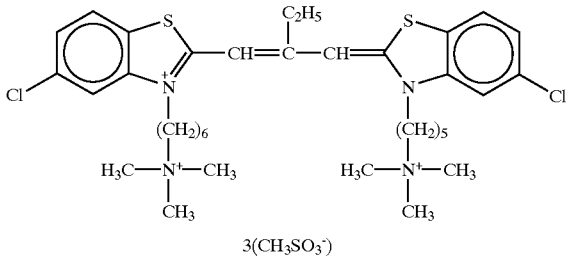

The sensitizing dye (including the dye of the subordinate concept) according to the present invention can be synthesized according to the methods described in F. M. Harmer, *Heterocyclic Compounds—Cyanine Dyes and Related Compounds*, John Wiley & Sons, New York, London (1964), D. M. Sturmer, *Heterocyclic Compounds —Special Topics in Heterocyclic Chemistry*, Chap. 18, Clause 14, pp. 482 to 515, John Wiley & Sons, New York, London (1977), *Rodd's Chemistry of Carbon Compounds,* 2nd Ed., Vol. IV, Part B, Chap. 15, pp. 369 to 422, Elsevier Science Publishing Company Inc., New York (1977) and the like.

Not only the sensitizing dyes according to the present invention but sensitizing dyes other than the dyes of the present invention may be used in combination. A cyanine dye, a merocyanine dye, a rhodacyanine dye, a trinuclear merocyanine dye, a tetranuclear merocyanine dye, an allopolar dye, a hemicyanine dye and a styryl dye are preferably used. More preferred dyes are a cyanine dyes, a merocyanine dye and a rhodacyanine dye, and a cyanine dye is particularly preferred. These dyes are described in detail in F. M. Harmer, *Heterocyclic Compounds— Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515.

The formulae disclosed on pages 32 to 44 in U.S. Pat. No. 5,994,051, the formulae disclosed on pages 30 to 39 in U.S. Pat. No. 5,747,236 and the sensitizing dyes shown therein by the specific examples can be exemplified as the preferred dyes.

Further, formulae (XI), (XII) and (XIII), columns 21 and 22 in U.S. Pat. No. 5,340,694 are preferred as formulae of the cyanine, merocyanine and rhodacyanine dyes, respectively. However, the numbers of n12, n15, n17 and n18 are not restricted here and regarded as the integers of 0 or more (preferably 4 or less).

These sensitizing dyes may be used alone or in combination of two or more kinds. A combination of sensitizing dyes is often used for the purpose of supersensitization. The representative examples of combinations are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862, 4,026,707, British Patents 1,344,281, 1,507,803, JP-B-43-49336 (the term "JP-B" as used herein means an "examined Japanese patent publication"), JP-B-53-12375, JP-A-52-110618 and JP-A-52-109925.

Dyes which themselves do not have a spectral sensitizing function or substances which substantially do not absorb visible light but show supersensitization may be incorporated into the emulsion with sensitizing dyes.

Supersensitizers preferably used in spectral sensitization in the present invention (e.g., pyrimidylamino compounds, triazinylamino compounds, azolium compounds, aminostyryl compounds, aromatic organic acid-formaldehyde condensation products, azaindene compounds, cadmium salts) and the combination of supersensitizers with sensitizing dyes are disclosed, e.g., in U.S. Pat. Nos. 3,511,664, 3,615,613, 3,615,632, 3,615,641, 4,596,767, 4,945,038, 4,965,182, 2,933,390, 3,635,721, 3,743,510, 3,617,295, and 3,635,721, and the using methods disclosed in these patents are also preferably used.

The time of the addition of the sensitizing dyes according to the present invention (and other sensitizing dyes and supersensitizers) to the silver halide emulsion of the present invention may be at any stage of the preparation of the emulsion recognized as useful hitherto. For example, they may be added at any stage if it is before coating, i.e., before grain formation stage of silver halide grains or/and before desalting stage, during desalting stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Also, as disclosed in U.S. Pat. No. 4,225,666 and JP-A-58-7629, the sensitizing dyes can be used as a single compound alone or in combination with compounds having foreign structures, and they can be divided and added separately, for example, one part of them is added during grain formation stage and the remaining is added during chemical ripening or after the completion of chemical ripening, alternatively one part is added prior to chemical ripening or during ripening stage and the remaining after completion of chemical ripening. The kinds of compounds added separately and combinations of compounds may be varied.

The addition amount of the sensitizing dyes according to the present invention (and other sensitizing dyes and supersensitizers) is varied in accordance with the shape and the size of silver halide grains, but the dyes can be used in an amount of from $1\times10^{-6}$ to $8\times10^{-2}$ mol per mol of the silver halide. For example, when the grain size of the silver halide grains is from 0.2 to 1.3 $\mu$m, the addition amount is preferably from $2\times10^{-6}$ to $3.5\times10^{-2}$ mol and more preferably from $7.5\times10^{-6}$ to $1.5\times10^{-2}$ mol per mol of the silver halide.

The sensitizing dyes according to the present invention (and other sensitizing dyes and supersensitizers) may be directly dispersed in an emulsion. Alternatively, the sensitizing dyes may be dissolved in an appropriate solvent, e.g., methyl alcohol, ethyl alcohol, methyl cellosolve, acetone, water, pyridine, or mixtures of these solvents, and added to an emulsion as a solution. At this time, additives such as bases, acids, surfactants, etc., may be added together. Further, ultrasonic waves can also be used for dissolution. For adding the sensitizing dyes, a method of dissolving the sensitizing dyes in a volatile organic solvent, dispersing the solution in a hydrophilic colloid and adding this dispersion to an emulsion as disclosed in U.S. Pat. No. 3,469,987, a method of dispersing the sensitizing dyes in a water-soluble solvent and adding the dispersion to an emulsion as disclosed in JP-B-46-24185, a method of dissolving the sensitizing dyes in a surfactant and adding the solution to an emulsion as disclosed in U.S. Pat. No. 3,822,135, a method of dissolving the sensitizing dyes using a compound capable of red-shifting and adding the solution to an emulsion as disclosed in JP-A-51-74624, and a method of dissolving the sensitizing dyes in an acid not substantially containing water and adding the solution to an emulsion as disclosed in JP-A-50-80826 can be used. Besides the above methods, the methods disclosed in U.S. Pat. Nos. 2,912,343, 3,342,605, 2,996,287 and 3,429,835 can also be used for the addition of the sensitizing dyes to an emulsion.

The dyes or sensitizing dyes according to the present invention are preferably added to a silver halide emulsion as the solution of an organic solvent. The dyes or sensitizing dyes according to the present invention are highly soluble in an organic solvent as compared with the dyes or sensitizing dyes having inorganic counter ions, hence they can be added with a smaller amount of organic solvent, which is advantageous to provide a silver halide emulsion and a silver halide photographic material of stable quality.

As the organic solvents for use in the present invention, e.g., methyl alcohol, ethyl alcohol, n-propanol, isopropanol, n-butanol, isobutanol, t-butanol, benzyl alcohol, fluorine-containing alcohol, methyl cellosolve, acetone, pyridine and mixed solvents of these compounds can be used.

Methyl alcohol and ethyl alcohol are preferred, and methyl alcohol is more preferred.

The time of the addition of the sensitizing dyes according to the present invention may be at any stage of the preparation of the emulsion, but they are added preferably after beginning of chemical ripening, more preferably during chemical ripening or after chemical ripening, and especially preferably after chemical ripening.

The silver halide photographic emulsion and the silver halide photographic material according to the present invention and the producing methods of them are described below.

Any of silver bromide, silver iodobromide, silver chlorobromide, silver iodide, silver iodochloride, silver iodobromochloride and silver chloride may be used in the silver halide photographic emulsion concerning the light-sensitive mechanism according to the present invention. The halogen composition of the outermost surface of the emulsion may contain 0.1 mol % or more, preferably 1 mol % or more, and particularly preferably 5 mol % or more, of iodide.

The grain size distribution may be broad or narrow but is preferably narrow.

The silver halide grains contained in the photographic emulsion may have a regular crystal form, such as cubic, octahedral, tetradecahedral, or rhombic dodecahedral, an irregular crystal form, such as spherical or plate-like, the hkl planes, or a composite form of these crystal forms, but the silver halide grains according to the present invention are preferably tabular grains. Tabular grains are described in detail later. With respect to the silver halide grains having the hkl planes, *Journal of Imaging Science*, Vol. 30, pp. 247 to 254 (1986) can be referred to.

The above-described silver halide grains may be used in the silver halide photographic emulsions according to the present invention alone or in combination of two or more. The interiors and the surfaces of the silver halide grains may be composed of different phases, the silver halide grains may be composed of multi-phase structures having junction structures, may have local phases on the surfaces, the grains may be composed of uniform phases, or may be composed of the mixtures of these.

The emulsions may be of the surface latent image type wherein the latent image is primarily formed on the surface, or of the internal latent image type wherein the latent image is formed within the grains.

In the present invention, tabular silver halide grains having halogen composition comprising silver chloride, silver bromide, silver chlorobromide, silver iodobromide, silver chloroiodobromide or silver iodochloride are preferably used. The tabular grains having {100} or {111} face as main surfaces are preferably used. Tabular grains having {111} face as main surfaces (hereinafter referred to as {111} tabular grains) have generally triangular or hexagonal planes. In general, the more uniform the grain size distribution, the higher is the ratio of tabular grains having hexagonal planes. Hexagonal monodispersed tabular grains are disclosed in JP-B-5-61205.

Tabular grains having {100} face as main surfaces (herein after referred to as {100} tabular grains) have rectangular or square shapes. In this emulsion, as compared with acicular grains, grains having a ratio of adjacent side lengths of less than 5/1 are called tabular grains. In silver chloride tabular grains or high silver chloride content tabular grains, {100} tabular grains are originally high in main surface stability as compared with {111} tabular grains. With {111} tabular grains, it is essential to stabilize {111 }main surface, and JP-A-9-80660, JP-A-9-80656 and U.S. Pat. No. 5,298,388 can be referred to.

Silver chloride {111} tabular grains or high silver chloride content {111} tabular grains for use in the present invention are disclosed in U.S. Pat. Nos. 4,414,306, 4,400,463, 4,713,323, 4,783,398, 4,962,491, 4,983,508, 4,804,621, 5,389,509, 5,217,858 and 5,460,934.

High silver bromide content {111} tabular grains which are used in the present invention are disclosed in U.S. Pat. Nos. 4,425,425, 4,425,426, 4,434,226, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

{100} Tabular grains for use in the present invention are disclosed in U.S. Pat. Nos. 4,386,156, 5,275,930, 5,292,632, 5,314,798, 5,320,938, 5,319,635, 5,356,764, European Patents 569971, 737887, JP-A-6-308648 and JP-A-9-5911.

The silver halide emulsions for use in the present invention are preferably tabular silver halide grains adsorbed with the sensitizing dyes of the present invention and having higher surface area/volume ratio. The aspect ratio of the silver halide emulsions of the present invention is 2 or more (preferably 100 or less), preferably from 3 to 100, more preferably from 5 to 80, and still more preferably from 8 to 80. The tabular grains preferably have a thickness of less than 0.2 $\mu$m, more preferably less than 0.1 $\mu$m, and still more preferably less than 0.07 $\mu$m.

"The aspect ratio is 2 or more (preferably 100 or less)" here means that silver halide grains having an aspect ratio (equivalent-circle diameter/thickness of a silver halide grain) of 2 or more (preferably 100 or less) occupy 50% or more of the projected area of the entire silver halide grains in the emulsion, preferably 70% or more, and particularly preferably 85% or more.

For producing thin tabular grains having such a high aspect ratio, the following techniques are applied.

The dislocation line distribution among grains of the tabular grains according to the present invention is preferably uniform. In the emulsion of the present invention, it is preferred that the silver halide grain having ten or more dislocation lines per one grain occupies from 50 to 100% (number) of the entire grains, more preferably from 70 to 100%, and particularly preferably from 90 to 100%.

If this ratio is lower than 50%, it is not preferred in the point of uniformity.

For finding the ratio of the grains having dislocation lines and the number of dislocation lines, it is preferred to directly observe at least 100 grains, more preferably 200 grains or more, and particularly preferably 300 grains or more.

The photographic emulsions which are used in the present invention can be prepared according to the methods described in P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964) and so on.

That is, any of an acid process, a neutralization process, etc., may be used. Any of a single jet method, a double jet method and a combination of these methods can be used for the reaction of a soluble silver salt with a soluble halide. A method in which grains are formed in the presence of excess silver ions (a so-called reverse mixing method) can also be used. A method in which the pAg in the liquid phase in which the silver halide is formed is kept constant, that is, the controlled double jet method, can also be used as one type of the double jet method. In addition, the grain formation is preferably carried out using a silver halide solvent such as ammonia, thioether, or tetra-substituted thiourea. Tetra-substituted thiourea compounds are more preferred and they are disclosed in JP-A-53-82408 and JP-A-55-77737. Preferred thiourea compounds are tetramethylthiourea and 1,3-dimethyl-2-imidazolidinethione. The addition amount of a silver halide solvent varies according to the kind of the compound used and the objective grain size and halogen composition but is preferably from $2\times10^{-5}$ to $10^{-2}$ mol per mol of silver halide.

Silver halide emulsions with a regular crystal form and a narrow grain size distribution can easily be obtained by the controlled double jet method and the grain formation method using silver halide solvents, and these methods are effective to prepare the silver halide emulsion for use in the present invention.

Moreover, the method in which the rates of addition of the silver nitrate and the alkali halide are varied according to the grain growth rate as disclosed in British Patent 1,535,016, JP-B-48-36890 and JP-B-52-16364, and the method in which the concentrations of the aqueous solutions are varied as disclosed in British Patent 4,242,445 and JP-A-55-158124 are preferably and effectively used to rapidly grow grains within the range not exceeding the critical degree of saturation in order to provide a uniform grain size.

The emulsions for use in the present invention are preferably monodispersed emulsions having the variation coefficient {represented by the equation [(standard deviation of grain sizes)/(average grain size)]×100} of 20% or less, more preferably 15% or less.

The average grain size of the silver halide emulsion grains is preferably 0.5 μm or less, more preferably from 0.1 to 0.4 μm.

The silver halide emulsion of the present invention is preferably chemically sensitized. Conventionally known chemical sensitization methods such as sulfur sensitization, selenium sensitization, tellurium sensitization and noble metal sensitization can be used alone or in combination. When sensitization is conducted in combination, a combination of sulfur sensitization and gold sensitization, a combination of sulfur sensitization, selenium sensitization and gold sensitization, and a combination of sulfur sensitization, tellurium sensitization and gold sensitization are preferred, for example.

The sulfur sensitization for use in the present invention is usually conducted by adding a sulfur sensitizer and stirring the emulsion at high temperature of 40° C. or more for a certain period of time. Various well-known sulfur compounds can be used as a sulfur sensitizer, for example, in addition to sulfur compounds contained in gelatin, various sulfur compounds, e.g., thiosulfates, thioureas, thiazoles, and rhodanines can be used. Preferred sulfur compounds are thiosulfates and thioureas compounds. The addition amount of a sulfur sensitizer is varied in accordance with various conditions such as the pH and temperature during chemical ripening and the grain size of the silver halide grains, but is preferably from $10^{-7}$ to $10^{-2}$ mol and more preferably from $10^{-5}$ to $10^{-3}$ mol per mol of the silver halide.

Various well-known selenium compounds can be used as a selenium sensitizer in the present invention. The selenium sensitization is usually conducted by adding labile and/or non-labile selenium compounds and stirring the emulsion at high temperature, preferably 40° C. or more, for a certain period of time. The compounds disclosed in JP-B-44-15748, JP-B-43-13489, JP-A-4-109240 and JP-A-4-324855 can be used as labile selenium compounds. The compounds represented by formulae (VIII) and (IX) disclosed in JP-A-4-322855 are particularly preferably used.

A low decomposable active selenium compound can also be preferably used. A low decomposable active selenium compound is a selenium compound whose half life period is 6 hours or more when a mixed solution (pH: 6.3) comprising 10 mol of $AgNO_3$, 0.5 mmol of the selenium compound, 40 mmol of 2-(N-morpholino)ethane sulfonic acid buffer water/1,4-dioxane (volume ratio: 1/1) is reacted at 40° C. Compounds SE-1 to SE-10 disclosed in JP-A-9-166841 are preferably used as a low decomposable active selenium compound.

The tellurium sensitizer for use in the present invention is a compound which forms silver telluride, which is presumed to become sensitization speck, in the surfaces or interiors of silver halide grains. The formation rate of the silver telluride in a silver halide emulsion can be examined according to the method disclosed in JP-A-5-313284. Specific examples of tellurium sensitizers which can be used in the present invention are those disclosed in the following patents and literature: U.S. Pat. Nos. 1,623,499, 3,320,069, 3,772,013, British Patents 235,211, 1,121,496, 1,295,462, 1,396,696, Canadian Patent 800,958, JP-A-4-204640, JP-A-4-271341, JP-A-4-333043, JP-A-5-303157, *J. Chem. Soc. Chem. Commun.*, 635 (1980), ibid., 1102 (1979), ibid., 645 (1979), *J. Chem. Soc. Perkin. Trans.*, 1, 2191 (1980), S. Patai compiled, *The Chemistry of Organic Selenium and Tellurium Compounds*, Vol.1 (1986), and ibid., Vol. 2 (1987). The compounds represented by formulae (II), (III) and (IV) disclosed in JP-A-5-313284 are particularly preferred.

The amount of the selenium and tellurium sensitizers for use in the present invention varies according to the silver halide grains used and the conditions of chemical ripening, but is generally from $10^{-8}$ to $10^{-2}$ Mol or so, preferably from $10^{-7}$ to $10^{-3}$ mol or so, per mol of silver halide. There is no particular limitation on the conditions of chemical sensitization in the present invention, but pH is from 5 to 8, pAg is from 6 to 11, preferably from 7 to 10, and temperature is from 40 to 95° C., preferably from 45 to 85° C.

The noble metal sensitizers which are used in the present invention include gold, platinum, palladium and iridium, and gold sensitization is particularly preferred. The specific examples of gold sensitizers for use in the present invention include chloroaurate, potassium chloroaurate, potassium auric thiocyanate, and gold sulfide, and the amount of about $10^{-7}$ to $10^{-2}$ mol per mol of silver halide can be used.

Cadmium salt, sulfite, lead salt and thallium salt may be coexist in the silver halide emulsion for use in the present invention in the process of the formation or physical ripening of silver halide grains.

Reduction sensitization can be used in the present invention. As reduction sensitizers, stannous salt, amines, formamidinesulfinic acid, and silane compounds can be used.

Thiosulfonic acid compounds may be added to the silver halide emulsion of the present invention according to the method disclosed in EP 293917.

A hydrophilic colloid layer containing light-insensitive silver halide grains is preferably used in the present invention besides the photographic emulsion layer containing the light-sensitive silver halide grains described above.

The halogen composition of the light-insensitive silver halide grains for use in the present invention is not particularly restricted and silver halide grains comprising any of silver chloride, silver bromide, silver chlorobromide, silver iodobromide, silver iodochloride, silver iodochlorobromide can be used, but silver halide grains having a silver bromide content of 50 mol % or more are preferably used. Silver iodochlorobromide having a silver bromide content of 50 mol % or more are more preferably used, silver iodobromide having a silver bromide content of 50 mol % or more are still more preferably used, and it is most preferred for the silver iodobromide having this halogen composition to have a silver iodide content of 1 mol % or less.

The form of the silver halide grain may be any of a cubic, tetradecahedral, octahedral, amorphous or plate-like form, but a cubic or tetradecahedral form is preferred.

The light-insensitive silver halide grains which are used in the present invention can be prepared according to the methods described in P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964) and so on.

It is preferred that the sensitivity in blue color region of the light-insensitive silver halide grains according to the present invention is 1/10 or less of that of the light-sensitive silver halide grains used in the photographic material of the present invention and the light-insensitive silver halide grains are not spectrally sensitized.

The light-insensitive silver halide grains according to the present invention are preferably monodispersed grains having the variation coefficient {represented by the equation (standard deviation of grain sizes)/(average grain size)]× 100} of 20% or less, more preferably 15% or less. The average grain size of the silver halide emulsion grains is preferably 0.1 $\mu$m or more, more preferably from 0.2 to 10 mm, and still more preferably from 0.3 to 1.0 $\mu$m.

The use amount of the light-insensitive silver halide grains is preferably from 0.01 g/m$^2$ to 1 g/M$^2$, more preferably from 0.03 g/m$^2$ to 0.5 g/m$^2$.

A hydrophilic colloid layer containing the light-insensitive silver halide grains may be provided as an antihalation layer (AH) nearer to the support than the light-sensitive silver halide emulsion layer, or may be provided at farther position as one or more protective layers.

Gelatin is preferably used as a binder for the silver halide emulsion layers and other hydrophilic colloid layers according to the present invention, but other hydrophilic colloids can also be used, and they can also be used in combination with gelatin. Examples of hydrophilic colloids include proteins such as gelatin derivatives, graft polymers of gelatin and other high polymers, albumin and casein; cellulose derivatives such as hydroxyethyl cellulose, carboxymethyl cellulose, and cellulose sulfate; saccharide derivatives such as sodium alginate and starch derivatives; and various kinds of synthetic hydrophilic high polymers of homopolymers or copolymers such as polyvinyl alcohol, partially acetalated polyvinyl alcohol, poly-N-vinyl pyrrolidone, polyacrylic acid, polymethacrylic acid, polyacrylamide, polyvinyl imidazole, and polyvinylpyrazole.

Acid-processed gelatin can be used as well as lime-processed gelatin, and hydrolyzed product and enzyme decomposed product of gelatin can also be used.

The coating amount of gelatin as the binder in the present invention is that such an amount that the amount of gelatin of all the hydrophilic colloid layers on the side on which silver halide emulsions layers are provided is 3 g/m$^2$ or less (preferably from 1.0 to 3.0 g/m$^2$), and the total gelatin amount of all the hydrophilic colloid layers on the side on which silver halide emulsions layers are provided and all the hydrophilic colloid layers on the opposite side to the silver halide emulsions layer side is 6.0 g/m$^2$ or less, preferably from 2.0 to 6.0 g/m$^2$.

The swelling factor of the hydrophilic colloid layers including the emulsion layers and the protective layers of the silver halide photographic material of the present invention is preferably from 80 to 150%, more preferably from 90 to 140%. The swelling factor of the hydrophilic colloid layers is obtained according to the following equation by measuring the thickness of the hydrophilic colloid layers ($d_o$) including the emulsion layers and the protective layers of the silver halide photographic material, immersing the silver halide photographic material in distilled water of 25° C. for 1 minute and determining the swollen thickness ($\Delta$d).

$$\text{Swelling factor } (\%) = \Delta d + d_0 \times 100$$

As the support which can be used in the present invention, for example, baryta paper, polyethylene-laminated paper, polypropylene synthetic paper, glass sheet, cellulose acetate, cellulose nitrate, and polyester films, e.g., polyethylene terephthalate can be exemplified. These supports are respectively arbitrarily selected according to the use purpose of the silver halide photographic material.

Hydrazine derivatives can be used without any limitation. For example, the compounds disclosed, e.g., in JP-A-11-344788, JP-A-12-98521 and JP-A-12-105438 can be preferably used.

Compounds having two or more acylhydrazino groups in one molecule can be used as hydrazine derivatives.

Such hydrazine derivatives are disclosed in JP-B-7-82220, JP-A-4-16938, JP-A-5-197091, JP-A-9-235266 and JP-A-9-179229.

The addition amount of hydrazine derivatives is preferably from $1\times10^{-6}$ to $5\times10^{-2}$ and particularly preferably from $1\times10^{-5}$ to $2\times10^{-2}$, per mol of the silver halide.

Hydrazine derivatives are contained in emulsion layers and/or other hydrophilic colloid layers. Other hydrophilic colloid layers used here means a protective layer, a layer provided between an emulsion layer and a support, and an intermediate layer.

The hydrazine derivatives for use in the present invention can be used by being dissolved in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl cellosolve.

Further, the hydrazine derivatives for use in the present invention can be used in the form of an emulsion dispersion mechanically prepared according to well known emulsifying dispersion methods by dissolving with oils such as dibutyl phthalate, tricresyl phosphate, glyceryl triacetate or diethyl phthalate, or auxiliary solvents such as ethyl acetate and cyclohexanone, or they can be used in the form of a dispersion prepared according to a well-known solid dispersion method in which powders of hydrazine derivatives are dispersed in water using a ball mill, a colloid mill or ultrasonic wave.

As the nucleation accelerating agent which can be used in the present invention, amine derivatives, onium salts, disulfide derivatives or hydroxymethyl derivatives can be exemplified. The examples of nucleation accelerating agents are shown below: The compounds disclosed in lines 2 to 37, page 48 of JP-A-7-77783, specifically Compounds A-1) to A-73), pages 49 to 58 of the same patent; the compounds represented by (chem. 21), (chem. 22) and (chem. 23) disclosed in JP-A-7-84331, specifically the compounds on pages 6 to 8 of the same patent; the compounds represented by formulae (Na) and (Nb) disclosed in JP-A-7-104426, specifically Compounds Na-1 to Na-22 and Nb-1 to Nb-12 on pages 16 to 20 of the same patent; and the compounds represented by formulae (1) to (7) disclosed in JP-A-8-272023, specifically Compounds 1-1 to 1-19, Compounds 2-1 to 2-22, Compounds 3-1 to 3-36, Compounds 4-1 to 4-5, Compounds 5-1 to 5-41, Compounds 6-1 to 6-58, and Compounds 7-1 to 7-38 of the same patent.

Nucleation accelerating agents for use in the present invention can be used by being dissolved in an appropriate organic solvent miscible with water, such as alcohols (e.g., methanol, ethanol, propanol, fluorinated alcohol) ketones (e.g., acetone, methyl ethyl ketone), dimethylformamide, dimethyl sulfoxide, and methyl cellosolve.

Further, the nucleation accelerating agents for use in the present invention can be used in the form of an emulsion dispersion mechanically prepared according to well-known emulsifying dispersion methods by dissolving with oils such as dibutyl phthalate, tricresyl phosphate, glyceryl triacetate or diethyl phthalate, or auxiliary solvents such as ethyl acetate and cyclohexanone, or they can be used in the form of a dispersion prepared according to a well-known solid dispersion method in which powders of nucleation accelerating agents are dispersed in water using a ball mill, a colloid mill or ultrasonic wave.

The nucleation accelerating agents of the present invention can be added to silver halide emulsion layers or any other hydrophilic colloid layers on the side of the support on which the silver halide emulsion layers are provided, but they are preferably added to the silver halide emulsion layers or the hydrophilic colloid layer adjacent to the silver halide emulsion layers.

The addition amount of the nucleating agents for use in the present invention is preferably from $1\times10^{-6}$ to $2\times10^{-2}$ mol, more preferably from $1\times10^{-5}$ to $2\times10^{-2}$ mol, and most preferably from $2\times10^{-5}$ to $1\times10^{-2}$ mol, per mol of the silver halide.

The processing agents such as a developing solution and a fixing solution and the processing methods in the present invention are described below, but the present invention is not limited thereto.

Any well-known development processing methods and development processing solutions can be used in the development process of the present invention.

A developing agent for use in a developing solution (a developing tank solution and a developing replenisher are referred to as a developing solution put together hereinafter) according to the present invention is not particularly limited, but it is preferred to contain dihydroxybenzenes, ascorbic acid derivatives and hydroquinonemonosulfonate, alone or in combination. Further, from the point of developing property, combination of dihydroxybenzenes or ascorbic acid derivatives with 1-phenyl-3-pyrazolidones, or combination of dihydroxybenzenes or ascorbic acid derivatives with p-amino-phenols is preferred.

Dihydroxybenzene developing agents which can be used in the present invention include hydroquinone, chlorohydroquinone, isopropylhydroquinone, and methylhydroquinone, and hydroquinone is particularly preferred.

Ascorbic acids for use in a developing solution which can be used in the present invention are generally known as Endiol type, Enaminol type, Endiamin type, Thiol-Enol type and Enamin-Thiol type compounds. The examples of these compounds are disclosed in U.S. Pat. No. 2,688,549 and JP-A-62-237443. The synthesis methods of these ascorbic acids are also well known and described, e.g., in Tsuguo Nomura and Hirohisa Ohmura, Reductone no Kagaku "*Chemistry of Reductone*", Uchida Rokakuho Shin-Sha (1969). Ascorbic acids can also be used in the form of alkali metal salts such as lithium salts, sodium salts and potassium salts in the present invention.

The developing agents of 1-phenyl-3-pyrazolidones or derivatives thereof which can be used in the present invention include 1-phenyl-3-pyrazolidone, 1-phenyl-4,4-dimethyl-3-pyrazolidone, and 1-phenyl-4-methyl-4-hydroxymethyl-3-pyrazolidone. p-Aminophenol-based developing agents which can be used in the present invention include N-methyl-p-aminophenol, p-aminophenol, N-(β-hydroxyphenyl)-p-aminophenol, and N-(4-hydroxyphenyl)glycine, and N-methyl-p-aminophenol is preferred.

Dihydroxybenzene-based developing agents are, in general, preferably used in an amount of from 0.05 to 0.8 mol/liter. When dihydroxybenzenes are used in combination with 1-phenyl-3-pyrazolidones or p-aminophenols, the amount used of the former is from 0.05 to 0.6 mol/liter, preferably from 0.23 to 0.5 mol/liter, and the latter is 0.06 mol/liter or less, preferably from 0.03 to 0.003 mol/liter.

Ascorbic acid derivative developing agents are, in general, preferably used in an amount of from 0.01 to 0.5 mol/liter, more preferably from 0.05 to 0.3 mol/liter. Further, when ascorbic acid derivatives are used in combination with 1-phenyl-3-pyrazolidones or p-aminophenols, the amount used of the ascorbic acid derivatives is preferably from 0.01 to 0.5 mol/liter, and that of the 1-phenyl-3-pyrazolidones or p-aminophenols is preferably from 0.005 to 0.2 mol/liter.

A developing solution for processing a photographic material in the present invention can contain additives ordinarily used (e.g., a developing agent, an alkali agent, a pH buffer, a preservative, a chelating agent, etc.). Specific examples of these compounds are shown below but the present invention is not limited to these.

A buffer which is used in a developing solution for development processing a photographic material in the present invention includes carbonate, boric acids disclosed in JP-A-62-186259, saccharides (e.g., saccharose) disclosed in JP-A-60-93433, oximes (e.g., acetoxime), phenols (e.g., 5-sulfosalicylic acid) or tertiary phosphate (e.g., sodium salt, potassium salt), preferably carbonate and boric acid are used. The use amount of a buffer, in particular carbonate, is preferably 0.1 mol/liter or more, particularly preferably from 0.2 to 1.5 mol/liter.

Examples of the preservatives for use in the present invention include sodium sulfite, potassium sulfite, lithium sulfite, ammonium sulfite, sodium bisulfite, potassium metabisulfite, and sodium formaldehyde bisulfite. Preferred addition amount of the sulfite preservative is 0.2 mol/liter or more, particularly preferably 0.3 mol/liter or more, but as too much an amount causes silver contamination of the developing solution, the upper limit is preferably 1.2 mol/liter, particularly preferably from 0.35 to 0.7 mol/liter.

A small amount of ascorbic acid derivatives may be used in combination with sulfite as a preservative for dihydroxybenzene developing agents. The use of sodium erythorbate is economically preferred. The addition amount is preferably from 0.03 to 0.12, particularly preferably from 0.05 to 0.10, in molar ratio to dihydroxybenzene developing agent. When ascorbic acid derivatives are used as a preservative, it is preferred not to contain boron compounds in the developing solution.

Additives which can be used in the present invention include, in addition to the above compounds, a development inhibitor such as sodium bromide and potassium bromide; an organic solvent such as ethylene glycol, diethylene glycol, triethylene glycol, and dimethylformamide; a development accelerator such as alkanolamine, e.g., diethanolamine and triethanolamine, imidazole or derivatives thereof; and a physical development unevenness inhibitor such as a heterocyclic mercapto compound (e.g., sodium 3-(5-mercaptotetrazol-1-yl)benzene sulfonate, 1-phenyl-5-mercaptotetrazole) and the compounds disclosed in JP-A-62-212651.

Further, mercapto-based compounds, indazole-based compounds, benzotriazole-based compounds and benzimidazole-based compounds can be used as an antifoggant or a black pepper inhibitor. Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzo-triazole, sodium 4-[(2-mercapto-1,3,4-thiadiazol-2-yl)thio]-butanesulfonate, 5-amino-1,3,4-thiadiazole-2-thiol, methylbenzotriazole, 5-methylbenzotriazole, and 2-mercaptobenzotriazole. The addition amount of these compounds is, in general, from 0.01 to 10 mmol, more preferably from 0.1 to 2 mmol, per liter of the developing solution.

Further, various kinds of organic and inorganic chelating agents can be used alone or in combination in the developing solution of the present invention.

Examples of inorganic chelating agents include sodium tetrapolyphosphate and sodium hexametaphosphate.

On the other hand, as organic chelating agents, organic carboxylic acid, aminopolycarboxylic acid, organic phosphonic acid, aminophosphonic acid, and organic phosphonocarboxylic acid can be primarily used.

Examples of organic carboxylic acids include acrylic acid, oxalic acid, malonic acid, succinic acid, glutaric acid, gluconic acid, adipic acid, pimelic acid, aci-elaidic acid, sebacic acid, nonanedicarboxylic acid, decanedicarboxylic acid, undecanedicarboxylic acid, maleic acid, itaconic acid, malic acid, citric acid, and tartaric acid.

Examples of aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminetetraacetic acid, and the compounds disclosed in JP-A-52-25632, JP-A-55-67747, JP-A-57-102624, and JP-B-53-40900.

Examples of organic phosphonic acids include the hydroxyalkylidene-diphosphonic acids disclosed in U.S. Pat. Nos. 3,214,454, 3,794,591 and West German Patent Publication No. 2,227,639, and the compounds described in *Research Disclosure*, Vol. 181, Item 18170 (May, 1979).

Examples of aminophosphonic acids include aminotris (methylenephosphonic acid), ethylenediaminetetramethylenephosphonic acid, aminotrimethylenephosphonic acid, etc., and the compounds disclosed in *Research Disclosure*, No. 18170, JP-A-57-208554, JP-A-54-61125, JP-A-55-29883 and JP-A-56-97347.

Examples of organic phosphonocarboxylic acids include the compounds disclosed in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure*, No.18170.

These organic and/or inorganic chelating agents are not limited to the above-described compounds and they may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developing solution.

Further, the developing solution can contain the following compounds as an agent for preventing silver contamination, in addition to the compounds disclosed in JP-A-56-24347, JP-B-56-46585, JP-B-62-2849 and JP-A-4-362942, for example, triazine having one or more mercapto groups (e.g., the compounds disclosed in JP-B-6-23830, JP-A-3-282457 and JP-A-7-175178), pyrimidine having one or more mercapto groups (e.g., 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine), pyridine having one or more mercapto groups (e.g., 2-mercaptopyridine, 2,6-dimercaptopyridine, 3,5-dimercaptopyridine, 2,4,6-trimercaptopyridine, the compounds disclosed in JP-A-7-248587), pyrazine having one or more mercapto groups (e.g., 2-mercaptopyrazine, 2,6-dimercaptopyrazine, 2,3-dimercaptopyrazine, 2,3,5-trimercaptopyrazine), pyridazine having one or more mercapto groups (e.g., 3-mercaptopyridazine, 3,4-dimercaptopyridazine, 3,5-dimercaptopyridazine, 3,4,6-trimercaptopyridazine), the compounds disclosed in JP-A-7-175177, and polyoxyalkylphosphonate disclosed in U.S. Pat. No. 5,457,011. These silver contamination preventing agents can be used alone or in combination of two or more, and they are used in an amount of preferably from 0.05 to 10 mmol, more preferably from 0.1 to 5 mmol, per liter of the developing solution.

The compounds disclosed in JP-A-61-267759 can be used as a dissolution aid. Further, if necessary, the developing solution may contain a toning agent, a surfactant, a defoaming agent and a hardening agent.

The pH of the developing solution is preferably from 8.5 to 12.0, and particularly preferably from 8.5 to 11.0. As an alkali agent which is used for pH adjustment, water-soluble inorganic alkali metal salts ordinarily used (e.g., sodium hydroxide, potassium hydroxide, sodium carbonate, potassium carbonate) can be used.

As the cation in a developing solution, a potassium ion does not inhibit development so much as a sodium ion does, and provides less fringes around the blackened part compared with a sodium ion. Further, when a developing solution is preserved as a concentrated solution, a potassium salt has, in general, higher solubility and preferred. However, since a potassium ion in a fixing solution inhibits fixation in the same degree as a silver ion does, if the potassium ion concentration in a developing solution is high, the potassium ion concentration in a fixing solution becomes high due to the developing solution carried over with a photographic material, which is not preferred. Accordingly, the molar ratio of the potassium ion to the sodium ion in a developing solution is preferably from 20/80 to 80/20. The ratio of the potassium ion to the sodium ion in a developing solution can be arbitrarily adjusted within the above range by the counter cations of a pH buffer, a pH adjustor, a preservative, a chelating agent, etc.

The replenishing rate of a developing solution is generally 200 ml or less, preferably from 30 to 200 ml, and particularly preferably from 60 to 180 ml, per $m^2$of the photographic material.

The composition and/or the concentration of a developing replenisher may be the same with or different from those of a developing tank solution.

Ammonium thiosulfate, sodium thiosulfate and ammonium sodium thiosulfate can be used as the fixing agent of fixing processing chemicals in the present invention. The use amount of the fixing agent can be varied arbitrarily and is generally from about 0.7 mol/liter to about 3.0 mol/liter.

The fixing solution according to the present invention may contain water-soluble aluminum salts and water-soluble chromium salts having a function as a hardening agent. Preferred compounds are water-soluble aluminum salts, e.g., aluminum chloride, aluminum sulfate, potassium alum, ammonium aluminum sulfate, aluminum nitrate, and aluminum lactate. They are preferably contained in an amount of from 0.01 mol/liter to 0.15 mol/liter in terms of an aluminum ion concentration in the working solution.

When the fixing solution is preserved as a concentrated solution or a solid agent, it may comprise a plurality of parts with a hardening agent being a separate part or it may comprise one part type including all the components.

The fixing processing chemicals can contain, if desired, a preservative (e.g., sulfite, bisulfite or metabisulfite, in an amount of 0.015 mol/liter or more, preferably from 0.02 mol/liter to 0.3 mol/liter), a pH buffer (e.g., acetic acid, sodium acetate, sodium carbonate, sodium hydrogencarbonate, phosphoric acid, succinic acid, and adipic acid, in an amount of from 0.1 mol/liter to 1 mol/liter, preferably from 0.2 mol/liter to 0.7 mol/liter), and compounds having stabilizing capability of aluminum and hard water softening capability (e.g., gluconic acid, iminodiacetic acid, 5-sulfosalicylic acid, glucoheptanic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives and salts of these compounds, saccharides and boric acid, in an amount of from 0.001 mol/liter to 0.5 mol/liter, preferably from 0.05 mol/liter to 0.3 mol/liter).

In addition to the above-described compounds, the fixing processing chemicals can contain, if desired, the compounds disclosed in JP-A-62-78551, a pH adjustor (e.g., sodium hydroxide, ammonia, sulfuric acid), a surfactant, a wetting agent, and a fixing accelerator. Specific examples of surfactants include an anionic surfactant (e.g., a sulfated product, a sulfonated product), a polyethylene surfactant, and the ampholytic surfactants disclosed in JP-A-57-6840, and well-known defoaming agents can also be used. Specific examples of the wetting agents include alkanolamine and alkylene glycol. Specific examples of the fixing accelerators include the alkyl- and aryl-substituted thiosulfonic acid and the salts thereof disclosed in JP-A-6-308681, the thiourea derivatives disclosed in JP-B-45-35754, JP-B-58-122535 and JP-B-58-122536, an alcohol having a triple bond in the molecule, the thioether compounds disclosed in U.S. Pat. No. 4,126,459, the mercapto compounds disclosed in JP-A-1-4739, JP-A-1-159645 and JP-A-3-101728, the mesoionic compounds disclosed in JP-A-4-170539, and thiocyanate.

The pH of the fixing solution for use in the present invention is preferably 4.0 or more and more preferably from 4.5 to 6.0. The pH of the fixing solution rises due to the mixture of a developing solution by processing. In such a case the pH of a hardening fixing solution is 6.0 or less, preferably 5.7 or less, and that of a non-hardening fixing solution is 7.0 or less, preferably 6.7 or less.

The replenishing rate of the fixing solution is preferably 500 ml/$m^2$ or less, more preferably 300 ml/$M^2$ or less, and still more preferably from 60 to 200 ml/$m^2$, of the photographic material processed. The compositions and/or the concentration of the fixing replenisher may be the same with or different from those of the fixing tank solution.

Silver recovery from a fixing solution can be conducted according to well-known fixing solution-reclaiming methods, such as electrolytic silver recovery, and the regenerated solution after silver recovery can be used in the present invention. As a reclaiming device, Reclaim R-60 produced by Fuji Hunt Co., Ltd. can be used.

Further, the removal of dyes and the like using an adsorptive filter of activated carbon is also preferred.

A photographic material is subjected to washing or stabilizing processing after being development processed and fixing processed (hereinafter washing includes stabilization processing and the solution used therefor is called water or washing water unless otherwise indicated). The water which is used for washing may be any of city water, ion exchange water, distilled water, and stabilizing solution. The replenishing rate of the water is in general from about 8 liters to about 17 liters per $m^2$ of the photographic material, but washing can be carried out with the less replenishing rate. In particular, with the replenishing rate of 3 liters or less (including zero, i.e., washing in a reservoir), not only water saving processing can be carried out but piping for installation of an automatic processor is not required. When washing is carried out with a reduced amount of water, it is preferred to use a washing tank equipped with a squeegee roller or a crossover roller disclosed in JP-A-63-18350 and JP-A-62-287252. The addition of various kinds of oxidizing agents (e.g., ozone, hydrogen peroxide, sodium hypochlorite, activated halogen, chlorine dioxide, sodium carbonate hydrogen peroxide salt) and the provision of filters for filtration may be combined to reduce load in environmental pollution which becomes a problem when washing is carried out with a small amount of water and to prevent generation of scale.

As a means of reducing the replenishing rate of the washing water, a multistage countercurrent system (e.g., two stages or three stages) has been known. The replenishing rate of the washing water in this system is preferably from 50 to 200 ml per $m^2$ of the photographic material. This is also effective in an independent multistage system (a method which is not a countercurrent system and fresh solution is replenished separately to multistage washing tanks).

Further, a means of preventing generation of scale may be included in a washing process. A means of preventing generation of scale is not particularly limited and well-known methods can be used, such as a method of adding antimold agents (a scale preventive), a method by electro conduction, a method of irradiating ultraviolet ray or infrared ray and far infrared ray, a method of making the magnetic field, a method by ultrasonic wave processing, a method by heating, and a method of emptying tanks when they are not used. These scale preventing means may be performed in proportion to the progress of the processing of photographic materials, may be conducted at regular intervals irrespective of usage conditions, or may be conducted only during the time when processing is not conducted, for example, during night. In addition, washing water provided with such a means in advance may be replenished. It is also preferred to conduct different scale preventing means for every given period of time for inhibiting the proliferation of resisting fungi.

An antimold agent is not particularly limited and well-known antimold agents can be used. Examples of antimold gents include, for example, a chelating agent such as glutaraldehyde and aminopolycarboxylic acid, cationic surfactants, and mercaptopyridine oxide (e.g., 2-mercaptopyridine-N-oxide), in addition to the above-described oxidants, and they can be used alone or in combination of two or more.

Methods by electroconduction disclosed in JP-A-3-224685, JP-A-3-224687, JP-A-4-16280 and JP-A-4-18980 can be used in the present invention.

Furthermore, well-known water-soluble surfactants or defoaming agents may be added to washing water for preventing generation of water-foaming spots and transfer of stains. In addition, dye-adsorbents disclosed in JP-A-63-163456 may be provided in a washing system to inhibit contamination by dyes eluted out from photographic materials.

All or a part of the overflow from the washing process can be utilized by mixture in the processing solution having fixing ability as disclosed in JP-A-60-235133. It is also preferred from the environmental protection for a washing solution to be processed by various processes before draining, for example, biochemical oxygen demand (BOD), chemical oxygen demand (COD), iodine consumption, etc., are reduced by a microorganism process (e.g., processes using sulfur oxidizing fungus and activated sludge, a process using a filter of a porous carrier, such as activated carbon or ceramic, carrying microorganisms) and an oxidation process by electroconduction and oxidants, or silver is precipitated by adding a compound which forms a sparingly soluble silver complex such as trimercaptotriazine and filtrated using a filter of a polymer having affinity with silver and to reduce the silver concentration in water drained.

Also, when a photographic material is subjected to stabilizing processing after washing processing, a bath containing compounds disclosed in JP-A-2-201357, JP-A-2-132435, JP-A-1-102553 and JP-A-46-44446 may be used as a final bath. This stabilizing bath may also contain, if necessary, ammonium compounds, metal compounds such as Bi and Al, brightening agents, various kinds of chelating agents, film pH adjustors, hardening agents, sterilizers, antimold agents, alkanolamines, and surfactants.

Additives such as antimold agents and stabilizing agents which are added to a washing bath and a stabilizing bath can also be solid agents the same as the above-described developing and fixing processing chemicals.

Waste solutions of the developing solution, fixing solution, washing water and stabilizing solution for use in the present invention are preferably subjected to incineration disposal. It is also possible to discard these waste solutions as concentrated solutions concentrated by concentrators as disclosed in JP-B-7-83867 and U.S. Pat. No. 5,439,560, or as solids.

In the case when the replenishing rate is reduced, it is preferred to prevent evaporation and air oxidation of the solution by minimizing the opening area of the processing tank. A roller transporting type automatic processor is disclosed in U.S. Pat. Nos. 3,025,779 and 3,545,971 and is referred to as merely a roller transporting type processor in the specification of the present invention. A roller transporting type processor comprises four steps of development, fixation, washing and drying and, although the method of the present invention does not exclude other steps (e.g., stopping step), it is most preferred to follow this four step system. Further, a rinsing bath may be provided between development and fixation and/or between fixation and washing.

Development processing according to the present invention is preferably conducted by development processing of dry to dry of from 25 to 160 seconds, with development and fixing time being 40 seconds or less, preferably from 6 to 22 seconds, the temperature of each processing solution being from 25 to 50° C., preferably from 30 to 40° C. The temperature and time of washing is preferably from 0 to 50° C. and 40 seconds or less, respectively. According to the method of the present invention, photographic materials having been subjected to development, fixation and washing may be dried after the water content is squeezed out of the materials, that is, through squeegee rollers. The drying step is carried out at a temperature of from about 40 to about 100° C. and the time of drying can vary properly depending upon the surroundings. Drying methods are not particularly limited and any known methods can be used, such as a warm air drying method, the heated roller drying method and the far infrared ray drying method disclosed in JP-A-4-15534, JP-A-5-2256 and JP-A-5-289294 and a plurality of methods can be used in combination.

There is no particular limitation on various additives for use in the photographic material of the present invention and, for example, those described in the following places can be preferably used.

Polyhydroxybenzene Compound:

Line 11, right lower column, page 10 to line 5, left lower column, page 12 of JP-A-3-39948, specifically Compounds (III)-1 to (III)-25 disclosed in the same patent.

Compound Which Substantially Does not Have Absorption Maximum in Visible Region:

The compound represented by formula (I) disclosed in JP-A-1-118832, specifically Compounds (I)-1 to (I)-26 in the same patent.

Antifoggant:

Line 19, right lower column, page 17 to line 4, right upper column, page 18 of JP-A-2-103536.

Polymer Latex:

Line 12, left lower column, page 18 to line 20, left lower column, the same page of JP-A-2-103536; the polymer latex having an active methylene group represented by formula (I) disclosed in JP-A-9-179228, specifically Compounds (1)-1 to (I)-16 disclosed in the same patent; and the polymer latex having a core/shell structure disclosed in JP-A-9-179228, specifically Compounds P-1 to P-55 disclosed in the same patent.

Matting Agent, Sliding Agent and Plasticizer:

Line 15, left upper column, page 19 to line 15, right upper column, the same page of JP-A-2-103536.

Hardening Agent:

Line 5, right upper column, page 18 to line 17, right upper column, the same page of JP-A-2-103536.

Compound Having Acid Radical:

Line 6, right lower column, page 18 to the first line, left upper column, page 19 of JP-A-2-103536.

Conductive Material:

Line 13, left lower column, page 2 to line 7, right upper column, page 3 of JP-A-2-18542, specifically metallic oxides disclosed in line 2, right lower column, page 2 to line 10, right lower column of the same page, and conductive high polymer Compounds P-1 to P-7 disclosed in the same patent.

Water-Soluble Dye:

The first line, right lower column, page 17 to line 18, right upper column of the same page of JP-A-2-103536.

Solid Dispersion Dye:

Compounds represented by formulae (FA), (FA1), (FA2) and (FA3) disclosed in JP-A-9-179243, specifically Compounds F1 to F-34in the same patent; Compounds (II-2) to (II-24) disclosed in JP-A-7-152112; Compounds (III-5) to (III-18) disclosed in JP-A-7-152112; Compounds (IV-2) to (IV-7) disclosed in JP-A-7-152112; and solid dispersion dyes disclosed in JP-A-2-294638 and JP-A-5-11382.

Surfactant:

Surfactants disclosed in line 7, right upper column, page 9 to line 3, right lower column of the same page of JP-A-2-12236; PEO series surfactants disclosed in line 4, left lower column, page 18 to line 7, left lower column of the same page of JP-A-2-103536; and fluorine surfactants disclosed in line 6, left lower column, page 12 to line 5, right lower column, page 13 of JP-A-3-39948, specifically Compounds IV-1 to VI-15 of the same patent.

Redox Compound:

Redox compounds capable of releasing a development inhibitor by oxidation disclosed in JP-A-5-274816, preferably the redox compounds represented by formulae (R-1), (R-2) and (R-3), specifically Compounds R-1 to R-68 in the same patent.

The exposure method of the silver halide photographic materials of the present invention is described below.

Photographic images can be obtained by ordinary exposure methods. That is, various well-known lightsources, e.g., natural light (daylight), a tungsten lamp, a fluorescent lamp, a mercury lamp, a xenon arc lamp, a carbon arc lamp, a xenon flash lamp, a laser beam, LED, CRT, etc., can be used. Exposure can be performed by light released from phosphors excited by an electron beam, an X-ray, a g-ray, an a-ray, etc. Various kinds of scanners, image setters and the light sources of cameras for plate-making are especially preferably used in the present invention.

Laser light sources are preferably used in the present invention. There are several kinds of laser beams, e.g., those making use of helium-neon gas, argon gas, krypton gas, and carbon dioxide gas as a laser oscillating medium, those using a solid, e.g., ruby and cadmium, as an oscillator, and a liquid laser and a semiconductor laser. Of these laser beams, a helium-neon laser which has a relatively long life and is inexpensive has prevailed most. As such laser beams are coherent lights having sharp directional property of uniform phase of single frequency different from general lights for illumination, etc., it is necessary for a silver halide photographic material to be exposed to have spectral characteristics coincident with the oscillating wavelength of the laser to be used as a light source.

A preferred case in the present invention is that exposure is performed with a laser light source having an oscillating wavelength between 620 and 690 nm, and a more preferred case is that the laser light source is selected from at least two to five laser light sources, and a particularly preferred case is that the laser light source is selected from at least two to five (particularly preferably two) laser light sources consisting of a He-Ne laser and a semiconductor laser having an oscillating wavelength at 670 nm±10 nm.

The present invention can be used in graphic arts (an image-forming system showing photographic property of super high contrast (in particular, γ is 10 or more) for realizing good reproduction of a continuous gradation image by a dot image or good reproduction of a line image). The present invention is preferably applied to the photographic materials as described below.

A system for forming a negative image of super high contrast showing γ exceeding 10 is proposed in U.S. Pat. Nos. 4,166,742, 4,168,977, 4,221,857, 4,224,401, 4,243,739, 4,272,606 and 4,311,781 as an image-forming system capable of obtaining photographic property of super high contrast by development with a processing solution having good storage stability, which comprises processing a surface latent image type silver halide photographic material containing a specific acylhydrazine compound with a developing solution having pH from 11.0 to 12.3 and containing 0.15 mol/liter or more of sulfurous acid preservative. Contrary to former super high contrast image-forming system where only silver chlorobromide having a high silver chloride content can be used, even silver iodobromide and silver iodochlorobromide can be used in this novel image-forming system. Further, conventional lith developing solutions can contain only a trace amount of a sulfurous acid preservative, however the developing solution for the novel system can contain a large amount of a sulfurous acid preservative, hence storage stability is relatively good.

Materials of high contrast containing two kinds of silver halide grains and hydrazine derivatives are disclosed in EP-A-0208514, JP-A-61-223734 and JP-A-63-46437.

A photographic material of high contrast containing silver halide grains which contain hydrazine derivatives and color-sensitized in high concentration per surface area as compared with other silver halide grains is disclosed in JP-A-4-331951. Further, a high contrast material which contains silver halide grains spectrally sensitized with a non-desorbing sensitizing dye and silver halide grains not spectrally sensitized and hydrazine derivatives is disclosed in British Patent Application 9,407,599. In either case, due to the presence of hydrazine derivatives, spectrally sensitized light-sensitive grains and light-insensitive grains not spectrally sensitized contribute to the silver image formed by imagewise exposure and development, which results in saving of sensitizing dyes and the improvement of residual color with maintaining high sensitivity and high density.

The disclosure on line 36, column 63 to line 2, column 65 in JP-A-10-239789 can be applied to the preparation method of the photographic emulsion for use in the present invention.

The disclosure on line 3, column 65 to line 13, column 73 in JP-A-10-239789 can be applied to additives such as color couplers, additives to photographic materials, the kind of the photographic materials to which the present invention can be applied and processing of photographic materials.

The above-described various additives are used in the photographic material according to the present invention, and various additives besides the above can be added according to purpose.

These additives are described more specifically in *Research Disclosure*, Item 17643 (December, 1978), ibid., Item 18716 November, 1979) and ibid., Item 308119 (December, 1989), and the locations related to various additives are summarized in the following table.

| Type of Additives | RD 17643 | RD 18716 | RD 308119 |
|---|---|---|---|
| 1. Chemical Sensitizers | page 23 | page 648, right column | page 996 |
| 2. Sensitivity Increasing | — | page 648, right column | — |

-continued

| Type of Additives | RD 17643 | RD 18716 | RD 308119 |
|---|---|---|---|
| Agents | | | |
| 3. Spectral Sensitizers and Supersensitizers | pages 23–24 | page 648, right column to page 649, right column | page 996, right column to page 998, right column |
| 4. Brightening Agents | page 24 | — | page 998, right column |
| 5. Antifoggants and Stabilizers | pages 24–25 | page 649, right column | page 998, right column to page 1000, right column |
| 6. Light Absorbers, Filter Dyes, and Ultraviolet Absorbers | pages 25–26 | page 649, right column to page 650, left column | page 1003, left column to page 1003, right column |
| 7. Antistaining Agents | page 25, right column | page 650, left to right columns | page 1002, right column |
| 8. Dye image Stabilizers | page 25 | — | page 1002, right column |
| 9. Hardening Agents | page 26 | page 651, left column | page 1004, right column to page 1005, left column |
| 10. Binders | page 26 | page 651, left column | page 1003, right column to page 1004, right column |
| 11. Plasticizers and Lubricants | page 27 | page 650, right column | page 1006, left to right columns |
| 12. Coating Aids and Surfactants | pages 26–27 | page 650, right column | page 1005, left column to page 1006, left column |
| 13. Antistatic Agents | page 27 | page 650, right column | page 1006, right column to page 1007, left column |
| 14. Matting Agents | — | — | page 1008, left column to page 1009, left column |

In addition to the above compounds, the emulsion of the present invention, and techniques such as layer arrangement, silver halide emulsions, functional couplers such as dye-forming couplers and DIR couplers, various additives and development processing which can be used in the photographic material using the emulsion of the present invention are described in EP-A-0565096 (disclosed on Oct. 13th, 1993) and the patents cited therein. Respective items and corresponding locations are listed below.

| | |
|---|---|
| 1. Layer Structures | lines 23 to 35, page 61; line 41, page 61 to line 14, page 62 |
| 2. Intermediate Layers | lines 36 to 40, page 61 |
| 3. Interlayer Effect-Donating Layers | lines 15 to 18, page 62 |
| 4. Halide Compositions of Silver Halide | lines 21 to 25, page 62 |
| 5. Crystal Habits of Silver Halide Grains | lines 26 to 30, page 62 |
| 6. Grain Sizes of Silver Halide Grains | lines 31 to 34, page 62 |
| 7. Producing Methods of Emulsions | lines 35 to 40, page 62 |
| 8. Grain Size Distributions of Silver Halide Grains | lines 41–42, page 62 |
| 9. Tabular Grains | lines 43 to 46, page 62 |
| 10. Structures of Interiors of Grains | lines 47 to 53, page 62 |
| 11. Latent Image-Forming Types of Emulsions | line 54, page 62 to line 5, page 63 |
| 12. Physical Ripening and Chemical Ripening of Emulsions | lines 6 to 9, page 63 |
| 13. Mixed Usage of Emulsions | lines 10 to 13, page 63 |
| 14. Fogged Emulsions | lines 14 to 31, page 63 |
| 15. Light-Insensitive Emulsions | lines 32 to 43, page 63 |
| 16. Coating Amount of Silver [0204] | lines 49 and 50, page 63 |
| 17. Formaldehyde Scavengers | lines 54 to 57, page 64 |
| 18. Mercapto-Based Antifoggants | lines 1 and 2, page 65 |
| 19. Releasing Agents of Antifoggants, etc. | lines 3 to 7, page 65 |
| 20. Dyes | lines 7 to 10, page 65 |
| 21. Color Couplers in General | lines 11 to 13, page 65 |
| 22. Yellow, Magenta and Cyan Couplers | lines 14 to 25, page 65 |
| 23. Polymer Couplers | lines 26 to 28, page 65 |
| 24. Diffusible Dye-Forming Couplers | lines 29 to 31, page 65 |

-continued

| | |
|---|---|
| 25. Colored Couplers | lines 32 to 38, page 65 |
| 26. Functional Couplers in General | lines 39 to 44, page 65 |
| 27. Bleaching Accelerator-Releasing Couplers | lines 45 to 48, page 65 |
| 28. Development Accelerator-Releasing Couplers | lines 49 to 53, page 65 |
| 29. Other DIR Couplers | line 54, page 65 to line 4, page 66 |
| 30. Methods of Coupler Dispersion | lines 5 to 28, page 66 |
| 31. Preservatives, Antibacterial Agents | lines 29 to 33, page 66 |
| 32. Kinds of Photographic Materials | lines 34 to 36, page 66 |
| 33. Film Thickness of Light-Sensitive Layer and Film Swelling Rate | line 40, page 66 to line 1, page 67 |
| 34. Backing Layers | lines 3 to 8, page 67 |
| 35. Development Processing in General | lines 9 to 11, page 67 |
| 36. Developing Solutions and Developing Agents | lines 12 to 30, page 67 |
| 37. Additives for Developing Solution | lines 31 to 44, page 67 |
| 38. Reversal Process | lines 45 to 56, page 67 |
| 39. Opening rate of Processing Solutions | line 57, page 67 to line 12, page 68 |
| 40. Developing Time | lines 13 to 15, page 68 |
| 41. Bleach-Fixing, Bleaching and Fixing | line 16, page 68 to line 31, page 69 |
| 42. Automatic Processors | lines 32 to 40, page 69 |
| 43. Washing, Rinsing and Stabilization | line 41, page 69 to line 18, page 70 |
| 44. Replenishment of Processing Solutions and Reuse | lines 19 to 23, page 70 |
| 45. Incorporation of Developing Agent in Photographic Material | lines 24 to 33, page 70 |
| 46. Temperature of Development Processing | lines 34 to 38, page 70 |
| 47. Use in Film Equipped with Lens | lines 39 to 41, page 70 |

Photothermographic materials which can be especially preferably used in the present invention are described below.

Thermal image-forming systems using organic silver salts are described, e.g., in U.S. Pat. Nos. 3,152,904, 3,457,075, and D. Klosterboer, *Thermally Processed Silver Systems*, "Imaging Processes and Materials", Neblette Ed. 8, J. Sturge, V. Walworth and A. Shepp compiled, Chap. 9, page 279 (1989). Photothermographic materials generally have a light-sensitive layer having dispersed in the binder matrix an catalyst active amount of a photocatalyst (e. g., silver halide), a reducing agent, a reducible silver salt (e.g., an organic silver salt) and, if necessary, a toner for adjusting the tone of silver. Photothermographic materials is heated at high temperature (e.g., 80° C. or higher) after image exposure and a blackish silver image is formed by the oxidation reduction reaction between the reducible silver salt (functions as an oxidant) and the reducing agent. The oxidation reduction reaction is accelerated by the catalytic function of the latent image of silver halide generated by exposure. Therefore, a blackish silver image is formed in the exposed domain. The mechanism is disclosed in U.S. Pat. No. 2,910,377, JP-B-43-4924 and other many literature.

Photothermographic materials which can be preferably used in the present invention and the materials which can be used are disclosed in the following patents and they can be referred to: EP-A-803764, EP-A-883022, WO 98/36322, JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898 and JP-A-11-352627.

EXAMPLE

The present invention is described in detail below with reference to the specific examples, but the present invention should not be construed as being limited thereto.

Example 1

Preparation of Emulsion A

| | |
|---|---|
| Solution 1 | |
| Water | 750 ml |
| Gelatin | 20 g |
| Sodium chloride | 3 g |
| 1,3-Dimethylimidazolidine-2-thione | 20 mg |
| Sodium benzenethiosulfonate | 10 mg |
| Citric acid | 0.7 g |
| Solution 2 | |
| Water | 300 ml |
| Silver nitrate | 150 g |
| Solution 3 | |
| Water | 300 ml |
| Sodium chloride | 38 g |
| Potassium bromide | 32 g |
| Potassium hexachloroiridate (III) (0.005%, KCl 20% aqueous solution) | 5 ml |
| Ammonium hexachlororhodate (0.001%, NaCl 20% aqueous solution) | 7 ml |

Potassium hexachloroiridate (III) (0.005%, KCl 20% aqueous solution) and ammonium hexachlororhodate (0.001%, NaCl 20% aqueous solution) for use in Solution 3 were prepared by dissolving the powders in a KCl 20% aqueous solution and an NaCl 20% aqueous solution respectively and heating each solution at 40° C. for 120 minutes.

Solution 2 and Solution 3 in the amounts corresponding to 90% of each solution were simultaneously added to Solution 1 maintained at 38° C. and pH 4.5 over a period of 20 minutes with stirring, and nucleus grains having a diameter of 0.16 μm were formed. Subsequently, Solution 4 and Solution 5 shown below were added over a period of 8 minutes. Further, the remaining amounts of 10% of Solution 2 and Solution 3 were added over a period of 2 minutes, and the diameter of the grains was grown to 0.21 μm. Further, 0.15 g of potassium iodide was added and ripening was performed for 5 minutes, thereby the grain formation was completed.

| | |
|---|---|
| Solution 4 | |
| Water | 100 ml |
| Silver nitrate | 50 g |
| Solution 5 | |
| Water | 100 ml |
| Sodium chloride | 13 g |
| Potassium bromide | 11 g |
| Yellow prussiate of potash (i.e., potassium ferrocyanaide) | 5 mg |

The mixture was then washed according to an ordinary flocculation method. Specifically, the temperature was lowered to 35° C., an anionic precipitant was added, and the pH was lowered with sulfuric acid until the silver halide was precipitated (pH was 3.2±0.2) About 3 liters of the supernatant was removed (first washing). Three liters of distilled water was added thereto and sulfuric acid was added until the silver halide was precipitated. Three liters of the supernatant was again removed (second washing). The same procedure as the second washing was further repeated one time (third washing), thereby washing×desalting process was finished. Gelatin (45 g) was added to the emulsion after washing and desalting to adjust pH to 5.6 and pAg to 7.5, and 10 mg of sodium benzenethiosulfonate, 3 mg of sodium benzenethiosulfinate, 15 mg of sodium thiosulfate, and 10 mg of chloroauric acid were added, and chemical sensitization was carried out at 55° C. to obtain optimal sensitivity. Further, 100 mg of 1,3,3a, 7-tetraazaindene as a stabilizer and 100 mg of Proxel (trade name, manufactured by ICI Co., Ltd.) as a preservative were added to the emulsion.

The finally obtained emulsion was a cubic silver iodochlorobromide grain emulsion having an average grain size of 0.22 μm and a variation coefficient of 9% and containing 70 mol % of silver chloride and 0.08 mol % of silver iodide. (Finally as emulsion, pH: 5.7, pAg: 7.5, electric conductivity: 40 ms/m, density: $1.2\times10^3$ kg/m$^3$, viscosity: 50 mPa·s)

Preparation of Emulsion B

| | |
|---|---|
| Solution 1 | |
| Water | 750 ml |
| Gelatin | 20 g |
| Sodium chloride | 1 g |
| 1,3-Dimethylimidazolidine-2-thione | 20 mg |
| Sodium benzenethiosulfonate | 10 mg |
| Citric acid | 0.7 g |

-continued

| Preparation of Emulsion B | |
|---|---|
| Solution 2 | |
| Water | 300 ml |
| Silver nitrate | 150 g |
| Solution 3 | |
| Water | 300 ml |
| Sodium chloride | 38 g |
| Potassium bromide | 32 g |
| Potassium hexachloroiridate (III) (0.005%, KCl 20% aqueous solution) | 5 ml |
| Ammonium hexachlororhodate (0.001%, NaCl 20% aqueous solution) | 15 ml |

Potassium hexachloroiridate(III) (0.005%, KCl 20% aqueous solution) and ammonium hexachlororhodate (0.001%, NaCl 20% aqueous solution) for use in Solution 3 were prepared by dissolving the powders in a KCl 20% aqueous solution and an NaCl 20% aqueous solution respectively and heating each solution at 40° C. for 120 minutes.

Solution 2 and Solution 3 in the amounts corresponding to 90% of each solution were simultaneously added to Solution 1 maintained at 38° C. and pH 4.5 over a period of 20 minutes with stirring, and nucleus grains having a diameter of 0.16 μm were formed. Subsequently, 500 mg of 1,3,3a, 7-tetraazaindene was added, and then Solution 4 and Solution 5 shown below were added over a period of 8 minutes. Further, the remaining amounts of 10% of Solution 2 and Solution 3 were added over a period of 2 minutes, and the diameter of the grains was grown to 0.18 μm. Further, 0.15 g of potassium iodide was added and ripening was performed for 5 minutes, thereby the grain formation was completed.

| | |
|---|---|
| Solution 4 | |
| Water | 100 ml |
| Silver nitrate | 50 g |
| Solution 5 | |
| Water | 100 ml |
| Sodium chloride | 13 g |
| Potassium bromide | 11 g |
| Yellow prussiate of potash (i.e., potassium ferrocyanide) | 2 mg |

The mixture was then washed according to an ordinary flocculation method. Specifically, the temperature was lowered to 35° C., an anionic precipitant was added, and the pH was lowered with sulfuric acid until the silver halide was precipitated (pH was 32±0.2). About 3 liters of the supernatant was removed (first washing). Three liters of distilled water was added thereto and sulfuric acid was added until the silver halide was precipitated. Three liters of the supernatant was again removed (second washing) The same procedure as the second washing was further repeated one time (third washing), thereby washing-desalting process was finished. Gelatin (45 g) was added to the emulsion after washing and desalting to adjust pH to 5.6 and pAg to 7.5, and 10 mg of sodium benzenethiosulfonate, 3 mg of sodium benzenethiosulfinate, 2 mg of triphenylphosphine selenide, and 1 mg of chloroauric acid were added, and chemical sensitization was carried out at 55° C. to obtain optimal sensitivity. Further, 100 mg of 1,3,3a, 7-tetraazaindene as a stabilizer and 100 mg of Proxel as a preservative were added to the emulsion. as a preservative were added to the emulsion.

The finally obtained emulsion was a cubic silver iodochlorobromide grain emulsion having an average grain size of 0.18 μm and a variation coefficient of 10% and containing 70 mol % of silver chloride and 0.08 mol % of silver iodide. (Finally as emulsion, pH: 5.7, pAg: 7.5, electric conductivity: 40 ms/m, density: $1.2\times10^3$ kg/m$^3$, viscosity: 50 mPa·s)

| Preparation of Light-Insensitive Silver Halide Grains | |
|---|---|
| Solution 1 | |
| Water | 1 liter |
| Gelatin | 20 g |
| Sodium chloride | 3.0 g |
| 1,3-Dimethylimidazolidine-2-thione | 20 mg |
| Sodium benzenethiosulfonate | 8 mg |
| Solution 2 | |
| Water | 400 ml |
| Silver nitrate | 100 g |
| Solution 3 | |
| Water | 400 ml |
| Sodium chloride | 13.5 g |
| Potassium bromide | 45.0 g |
| Potassium hexachlororhodate (III) (0.001% aqueous solution) | 860 ml |

Solution 2 and Solution 3 were simultaneously added to Solution 1 maintained at 70° C. and pH 4.5 over a period of 15 minutes with stirring and nucleus grains were formed. Subsequently, Solution 4 and Solution 5 shown below were added over a period of 15 minutes. Further, 0.15 g of potassium iodide was added to terminate grain formation.

| | |
|---|---|
| Solution 4 | |
| Water | 400 ml |
| Silver nitrate | 100 g |
| Solution 5 | |
| Water | 400 ml |
| Sodium chloride | 13.5 g |
| Potassium bromide | 45.0 g |

The mixture was then washed according to an ordinary flocculation method. Specifically, the temperature was lowered to 35° C., an anionic precipitant was added, and the pH was lowered with sulfuric acid until the silver halide was precipitated (pH was 3.2±0.2).

About 3 liters of the supernatant was removed (first washing). Three liters of distilled water was added thereto and sulfuric acid was added until the silver halide was precipitated. Three liters of the supernatant was again removed (second washing). The same procedure as the second washing was further repeated one time (third washing), thereby washing×desalting repeated one time (third washing), thereby washing×desalting process was finished. Gelatin (45 g) was added to the emulsion after washing and desalting to adjust pH to 5.7 and pAg to 7.5, and phenoxyethanol was added as a preservative. Finally, dispersion (1) of primitive emulsion silver iodochlorobromide cubic grains having an average grain size of 0.45 μm and a variation coefficient of 10% and containing 30 mol % of silver chloride and 0.08 mol % of silver iodide on average was obtained. (Finally as emulsion, pH: 5.7, pAg: 7.5, electric conductivity: 40 ms/m, density: $1.3\times10^3$ kg/m$^3$, viscosity: 50 mPa·s)

Preparation of Coated Sample

A coated sample was prepared by coating each layer in the constitution of UL layer/emulsion layer/lower protective layer/upper protective layer on a polyethylene terephthalate support having a moisture proof undercoating layer containing vinylidene chloride on both surfaces as shown below.

The preparing method, coating amount and coating method of each layer are shown below.

Emulsion Layer

To Emulsion B were added each sensitizing dye according to the present invention shown in Table 1 and $5.7\times10^{-4}$ mol/mol-Ag of a comparative sensitizing dye and spectral sensitization was conducted. Further, to the above emulsion were added KBr in an amount of $3.4\times10^{-4}$ mol/mol-Ag, Compound (Cpd-1) in an amount of $3.2\times10^{-4}$ mol/mol-Ag, Compound (Cpd-2) in an amount of $8.0\times10^{-4}$ mol/mol-Ag, and Emulsion A in an amount of ½ of Emulsion B in terms of Ag, and the mixture was thoroughly stirred. Further, 1,3,3a, 7-tetraazaindene in an amount of $1.2\times10^{-4}$ mol/mol-Ag, hydroquinone in an amount of $1.2\times10^{-2}$ mol/mol-Ag, citric acid in an amount of $3.0\times10^{-4}$ mol/mol-Ag, a hydrazine nucleating agent, Compound (Cpd-3) in an amount of $1.5\times10^{-4}$ mol/mol-Ag, a hydrazine nucleating agent, Compound (Cpd-4) in an amount of $6.0\times10^{-4}$ mol/mol-Ag, sodium 2,4-dichloro-6-hydroxy-1,3,5-triazine in an amount of 90 mg/m$^2$, 30 wt %, based on gelatin, of colloidal silica having a particle diameter of 10 $\mu$m, a water latex (Cpd-5) in an amount of 100 mg/m$^2$, a polyethyl acrylate latex in an amount of 150 mg/m$^2$, a latex copolymer (88/5/7 by weight) of methyl acrylate/2-acrylamide-2-methylpropanesulfonic acid sodium salt/2-acetoxyethyl methacrylate in an amount of 150 mg/m$^2$, a core/shell type latex [core: styrene/butadiene latex copolymer (37/63 by weight), shell: styrene/2-acetoxyethyl acrylate (84/16 by weight), core/shell ratio: 50/50] in an amount of 150 mg/m$^2$, and 4 wt %, based on gelatin, of Compound (Cpd-6) were added to the above mixture, and pH was adjusted to 5.6 with citric acid. The thus-obtained coating solution of the emulsion layer was coated on a support shown below to obtain a coated silver weight of 3.4 g/m$^2$ and a coated gelatin weight of 1.5 g/m$^2$.

| Upper Protective Layer | |
|---|---|
| Gelatin | 0.3 g/m$^2$ |
| Amorphous silica matting agent (average particle size: 3.5 $\mu$m) | 25 mg/m$^2$ |
| Compound (Cpd-7) (gelatin dispersion) | 20 mg/m$^2$ |
| Colloidal silica (particle size: 10 to 20 $\mu$m) (Snowtex C, manufactured by Nissan Chemical Industries Ltd.) | 30 mg/m$^2$ |
| Compound (Cpd-8) | 50 mg/m$^2$ |
| Sodium dodecylbenzenesulfonate | 20 mg/m$^2$ |
| Compound (Cpd-9) | 20 mg/m$^2$ |
| Preservative (Proxel) | 1.0 mg/m$^2$ |

-continued

| Lower Protective Layer | |
|---|---|
| Gelatin | 0.5 g/m$^2$ |
| Light-insensitive silver halide grains | 0.1 g/m$^2$ as Ag amount |
| Compound (Cpd-10) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-17) | 3 mg/m$^2$ |
| Preservative (Proxel) | 1.5 mg/m$^2$ |
| UL Layer | |
| Gelatin | 0.5 g/m$^2$ |
| Polyethyl acrylate latex | 150 mg/m$^2$ |
| Compound (Cpd-6) | 40 mg/m$^2$ |
| Compound (Cpd-11) | 10 mg/m$^2$ |
| Preservative (Proxel) | 1.5 mg/m$^2$ |
| Support | |

The support of the sample (biaxially stretched polyethylene terephthalate support having a thickness of 100 $\mu$m) which was used in this example had the backing layer and the conductive layer having the following compositions.

| Backing Layer | |
|---|---|
| Gelatin | 3.3 g/m$^2$ |
| Compound (Cpd-12) | 40 mg/m$^2$ |
| Compound (Cpd-13) | 20 mg/m$^2$ |
| Compound (Cpd-14) | 90 mg/m$^2$ |
| Compound (Cpd-15) | 40 mg/m$^2$ |
| Compound (Cpd-16) | 26 mg/m$^2$ |
| 1,3-Divinylsulfonyl-2-propanol | 60 mg/m$^2$ |
| Polymethyl methacrylate fine particles (average particle size: 6.5 $\mu$m) | 30 mg/m$^2$ |
| Liquid paraffin | 78 mg/m$^2$ |
| Compound (Cpd-6) | 120 mg/m$^2$ |
| Calcium nitrate | 20 mg/m$^2$ |
| Preservative (Proxel) | 12 mg/m$^2$ |
| Conductive Layer | |
| Gelatin | 0.1 g/m$^2$ |
| Sodium dodecylbenzenesulfonate | 20 mg/m$^2$ |
| $SnO_2$/Sb (9/1 by weight, average grain size: 0.25 $\mu$m) | 200 mg/m$^2$ |
| Preservative (Proxel) | 0.3 mg/m$^2$ |

SS-1

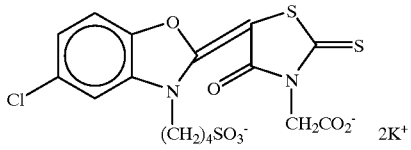

SS-2

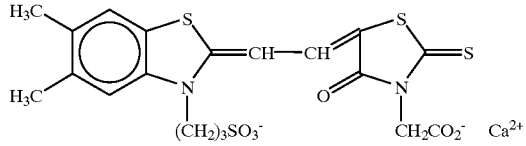

-continued
SS-3
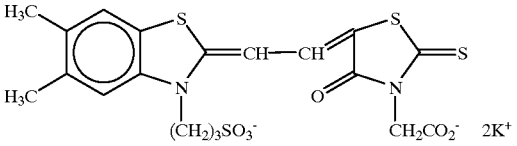
SS-4
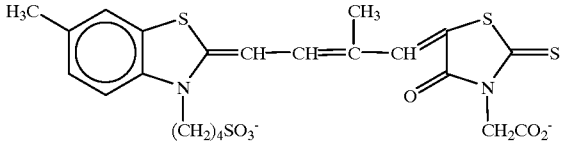
SS-5
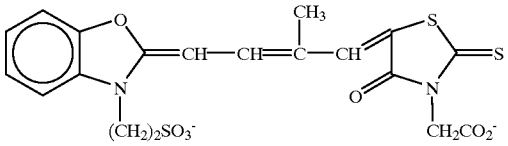
SS-6
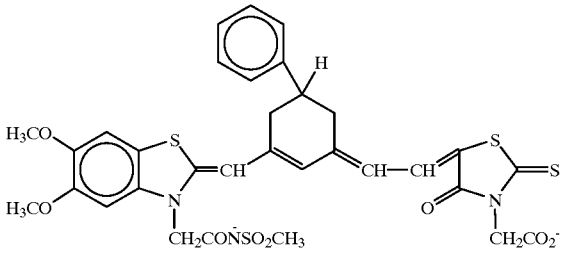
SS-7
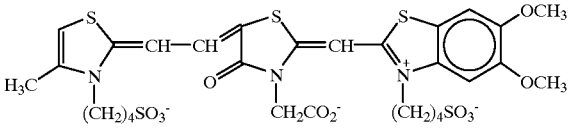
SS-8
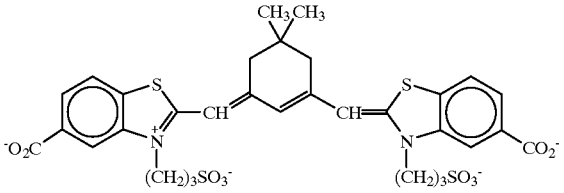
Cpd-1
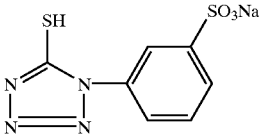
Cpd-2
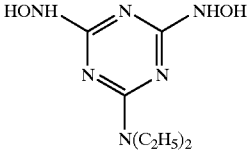
Cpd-3
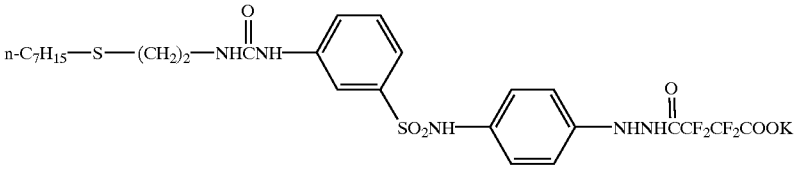
Cpd-4
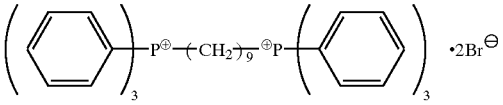
Cpd-5
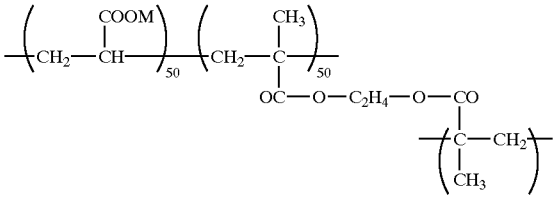
M = H or Na
Cpd-6
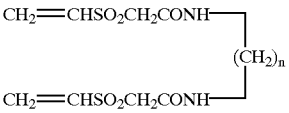
(n = 2):(n = 3) = 3:1
Cpd-7
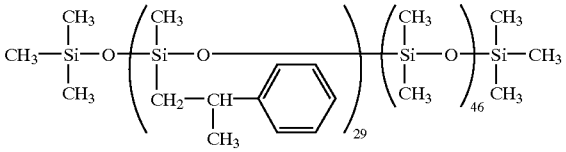

-continued

Cpd-8

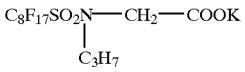

Cpd-9

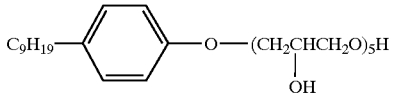

Cpd-10

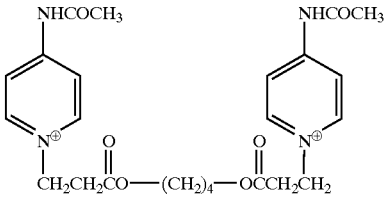

Cpd-11

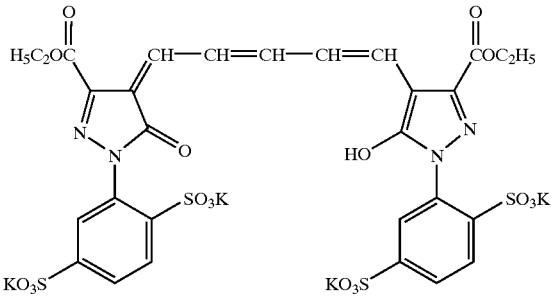

Cpd-12

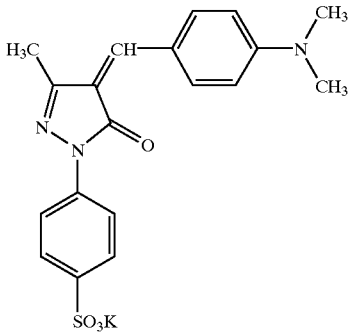

Cpd-13

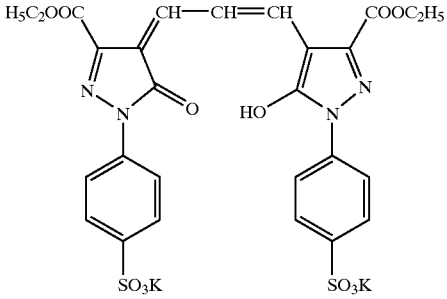

(Cpd-14)

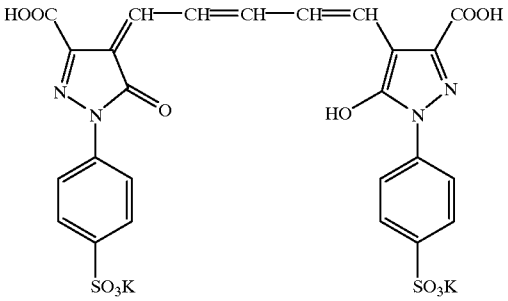

(Cpd-15)

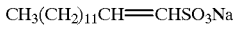

(Cpd-16)

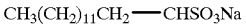

(Cpd-17)

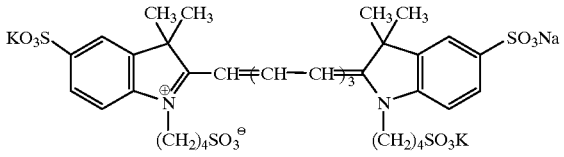

Coating Method

The layers were coated on the undercoated support by multilayer coating of four layers of a UL layer, an emulsion layer, an under protective layer and an upper protective layer in this order nearer from the support as the emulsion layer side. Four layers were simultaneously multilayer-coated by a slide bead coater system with adding a solution of a hardening agent with maintaining at 35° C., passed through a cold air set zone (5° C.), and then a conductive layer and a backing layer were coated on the support of the side opposite to the emulsion layer side in this order nearer from the support. These layers were simultaneously multilayer-coated by a curtain coater system with adding a solution of a hardening agent and then passed through a cold air set zone (5° C.) At the point of passing each set zone, coating solutions showed sufficient setting property. Both surfaces were simultaneously dried at a drying zone on the following conditions. After coating the back surface, the sample was transported so as not to touch the roller and other things at all until winding. The coating speed was 200 m/min.

Drying Conditions

After being set, the sample was dried with dry air of 30° C. until the weight ratio of water/gelatin became 800%, drying was continued with applying dry air of 35° C. 30% RH between the weight ratio of 800% and 200%, and 30 seconds after the time when the surface temperature reached 34° C. with applying the dry air at it was (the time when the surface temperature reached 34° C. was regarded as termination of drying), the sample was dried at 48° C. 2% RH for 1 minute. At this time, the drying time from the start of drying until the weight ratio of water/gelatin became 800% was 50 seconds, from water/gelatin ratio of 800% to 200% was 35 seconds, and from 200% to finish of drying was 5 seconds.

The sample was wound at 25° C. 55% RH, cut under the same ambient, subjected to humidity conditioning at 25° C. 50% RH for 8 hours in a barrier bag which had been humidity conditioned for 6 hours, and then sealed with a cardboard having been humidity conditioned at 25° C. 50% RH for 2 hours, thereby samples shown Table 1 were prepared.

TABLE 1

| Sample No. | Sensitizing Dye | Solvent Added | Fluctuation of Sensitivity (%) | Dyeing | Remarks |
|---|---|---|---|---|---|
| 1 | SS-1 | Water | 13 | 1 | Comparison |
| 2 | (1) | Water | 5 | 3 | Invention |
| 3 | (2) | Water | 7 | 2 | Invention |
| 4 | SS-1 | Methanol | 13 | 1 | Comparison |
| 5 | (1) | Methanol | 1 | 5 | Invention |
| 6 | (2) | Methanol | 3 | 4 | Invention |
| 7 | SS-2 | Methanol | 12 | 2 | Comparison |
| 8 | SS-3 | Methanol | 13 | 2 | Comparison |
| 9 | (6) | Methanol | 2 | 5 | Invention |
| 10 | SS-4 | Methanol | 12 | 1 | Comparison |
| 11 | (7) | Methanol | 1 | 4 | Invention |
| 12 | SS-5 | Methanol | 13 | 1 | Comparison |
| 13 | (12) | Methanol | 1 | 5 | Invention |
| 14 | SS-6 | Methanol | 13 | 2 | Comparison |
| 15 | (14) | Methanol | 3 | 4 | Invention |
| 16 | SS-7 | Methanol | 13 | 1 | Comparison |
| 17 | (55) | Methanol | 4 | 4 | Invention |
| 18 | SS-8 | Methanol | 12 | 1 | Comparison |
| 19 | (105) | Methanol | 6 | 3 | Invention |

A sensitizing dye was dissolved in a solvent (water or methanol) to prepare a solution, and after the solution was allowed to stand at room temperature for 2 hours, the required amount was added.

The concentration of the sensitizing dye solution:

Samples 1 to 6: 0.001 mol/liter

Samples 7 to 9, 10, 12, 14, 16 to 19: 0.005 mol/liter

Samples 11, 13, 15: 0.01 mol/liter

Samples 10 to 15: The solvent in which ascorbic acid was dissolved with each sensitizing dye in an amount of 0.0005 mol/liter was used.

The humidity in the barrier bag measured was 45%. The pH of the layer on the emulsion layer side of the samples obtained was from 5.5 to 5.8, and that on the back surface was from 6.0 to 6.5.

Evaluation of Sensitivity Fluctuation Width

Each of the same one sample as shown in Table 1 was prepared ten times by the same preparing method. Each sample was exposed with xenon flash light of emission time of $10^{-5}$ sec. through a step wedge, processed using automatic processor FG9601S (produced by Fuji Photo Film Co., Ltd.) filled with developing solution ND-1 (mother solution/water: 2/1, 35° C., 30 seconds), fixing solution NF-1 (mother solution/water: 1/2, 34° C.), and washing water (25° C.), and sensitometry was evaluated. The reciprocal of the exposure amount required to give a density of 4.0 was taken as the sensitivity, and the sensitivity fluctuation was expressed by % taking the average value of sensitivity of each sample as 100.

Results of Sensitivity Fluctuation Width

As a result, the sensitizing dyes according to the present invention were less in sensitivity fluctuation as compared with comparative sensitizing dyes and extraordinarily excellent. Further, Sample Nos. 4 to 6 changed the solvent added from water in Sample Nos. 1 to 3 to methanol, but the sensitizing dyes according to the present invention were less in sensitivity fluctuation as compared with the comparative sensitizing dyes and extraordinarily excellent. Thus, emulsions and photographic materials without unevenness among production lots can be obtained by using the sensitizing dyes and/or the producing methods according to the present invention.

Evaluation of Dyeing

Dyeing is a failure that when a photographic paper is processed after processing a photographic film, the dye transferred to the transporting roller of the automatic processor from the film adheres to the photographic paper.

The above-obtained sample of a large size (50.8 cm×61 cm) was processed using automatic processor FG9601S (produced by Fuji Photo Film Co., Ltd.) filled with developing solution ND-1 (mother solution/water: 2/1, 35° C., 30 seconds), fixing solution NF-1 (mother solution/water: 1/2, 34° C.), and washing water (25° C.). Three large size sheets were processed with the interval of 1 minute with replenishing 50 ml of the working solution per one sheet, and 10 minutes after that, three large size sheets of scanner paper PR-H100WP (manufactured by Fuji Photo Film Co., Ltd.) were processed with the interval of 1 minute. This procedure was repeated three times and dyeing of the entire surface of the emulsion layer side and the back side and the end part of the processed sheet was compared and confirmed.

Dyeing of the obtained samples was evaluated by five grade (grade 5 means best, i.e., the generation of dyeing was least, and grade 1 means worst, i.e., the generation of dyeing was most). The results obtained are shown in Table 1 above.

Results of Dyeing

As a result, the sensitizing dyes according to the present invention were less in generation of dyeing as compared with comparative sensitizing dyes and extraordinarily excellent. Further, Sample Nos. 4 to 6 changed the solvent added from water in Sample Nos. 1 to 3 to methanol, but the sensitizing dyes according to the present invention were less in dyeing as compared with the comparative sensitizing dyes and extraordinarily excellent. Thus, dyeing is hardly caused by the sensitizing dyes and/or the producing methods according to the present invention.

Results of Improvement in Solubility of Dye

In Sample Nos. 10 to 15, since the solubility in methanol of the comparative sensitizing dyes was low, the required addition amount of the solvent to the dye in Comparative Sample Nos. 10, 12 and 14 was double the amount of the samples according to the present invention having high solubility. Thus, the addition amount of a solvent can be saved by the sensitizing dyes and/or the producing methods according to the present invention.

Further, the sensitizing dyes according to the present invention were also excellent in that the concentration reduction by the dye when aged in a solution was less.

Example 2

Emulsions 0, 1, 2 and 3 were prepared according to the methods shown below.

(0) Preparation of Emulsion 0

One thousand (1,000) ml of water, 25 g of deionized ossein gelatin, 15 ml of a 50% aqueous solution of $NH_4NO_3$, and 7.5 ml of a 25% aqueous solution of $NH_3$ were put in a reaction vessel and stirred thoroughly, while maintaining the temperature at 50° C., then 750 ml of an aqueous solution of 1N silver nitrate and an aqueous solution containing 1 mol/liter of potassium bromide were added to the above mixture over 50 minutes with maintaining the silver potential during reaction of −40 mV. The thus-obtained silver bromide grains were octahedral grains having an equivalent-sphere diameter of 0.846±0.036 μm. This was designated Emulsion 0.

Emulsion 0 was desalted according to an ordinary flocculation method, $2.8\times10^{-4}$ mol per mol of silver of a methanol solution of a sensitizing dye was then added to Emulsion 0, and Emulsion 0 was subjected to gold, sulfur and selenium sensitization optimally in the presence of the sensitizing dye.

(1) Preparation of Emulsion 1

An aqueous solution of 1.9 M $AgNO_3$ and an aqueous solution of 1.9 M KBr were added by a double jet method at a rate of 25 ml/min for 70 seconds to an aqueous solution containing gelatin having an average molecular weight of 15,000 (containing 1,200 ml of water, 7.0 g of gelatin, and 4.5 g of KBr) with stirring and maintaining the temperature at 30° C., thereby tabular grain nuclei were obtained. Of the emulsion, 400 ml portion was used as a seed crystal, to which were added 650 ml of an aqueous solution of inert gelatin (containing 20 g of gelatin and 1.2 g of KBr), the temperature was raised to 75° C., and the mixture was subjected to ripening for 40 minutes. Subsequently, an aqueous solution of $AgNO_3$ (containing 1.7 g of $AgNO_3$) was added to the above emulsion over 1 minute and 30 seconds, then 7.0 ml of an aqueous solution of $NH_4NO_3$ (50 wt %) and 7.0 ml of an aqueous solution of $NH_3$ (25 wt %) were added thereto, followed by ripening for further 40 minutes.

The pH of the emulsion was then adjusted to 7 with $HNO_3$ (3N) and 1.0 g of KBr was added thereto, then 366.5 ml of an aqueous solution of 1.9 M $AgNO_3$ and an aqueous solution of KBr, then 53.6 ml of an aqueous solution of 1.9 M $AgNO_3$ and an aqueous solution of KBr (containing 33.3 mol % of KI), and then 160.5 ml of an aqueous solution of 1.9 M $AgNO_3$ and an aqueous solution of KBr were added to the emulsion with maintaining pAg at 7.9, thus Emulsion 1 was obtained.

Emulsion 1 thus obtained was triple structural grain emulsion having the highest silver iodide content part at the intermediate shell, and the average aspect ratio of Emulsion 1 was 2.8. Tabular grains having an aspect ratio of 3 or more occupied 26% of the entire projected area of the tabular grains. The variation coefficient of the grain size was 7%, and the average grain size was 0.98 μm as equivalent-sphere diameter.

Emulsion 1 was desalted according to an ordinary flocculation method, $4.1\times10^{-4}$ mol per mol of silver of a methanol solution of a sensitizing dye was then added to Emulsion 1, and Emulsion 1 was subjected to gold, sulfur and selenium sensitization optimally in the presence of the sensitizing dye.

(2) Preparation of Emulsion 2

An aqueous solution of 1.9 M $AgNO_3$ and an aqueous solution of 1.9 M KBr were added by a double jet method at a rate of 25 ml/min for 70 seconds to an aqueous solution containing gelatin having an average molecular weight of 15,000 (containing 1,200 ml of water, 7.0 g of gelatin, and 4.5 g of KBr) with stirring and maintaining the temperature at 30° C., thereby tabular grain nuclei were obtained. Of the emulsion, 350 ml portion was used as a seed crystal, to which were added 650 ml of an aqueous solution of inert gelatin (containing 20 g of gelatin and 1.2 g of KBr), the temperature was raised to 75° C., and the mixture was subjected to ripening for 40 minutes. Subsequently, an aqueous solution of $AgNO_3$ (containing 1.7 g of $AgNO_3$) was added to the above emulsion over 1 minute and 30 seconds, then 6.2 ml of an aqueous solution of $NH_4NO_3$ (50 wt %) and 6.2 ml of an aqueous solution of $NH_3$ (25 wt %) were added thereto, followed by ripening for further 40 minutes.

The pH of the emulsion was then adjusted to 7 with $HNO_3$ (3N) and 1.0 g of KBr was added thereto, then 366.5 ml of an aqueous solution of 1.9 M $AgNO_3$ and an aqueous solution of KBr, then 53.6 ml of an aqueous solution of 1.9 M $AgNO_3$ and an aqueous solution of KBr (containing 33.3 mol % of KI), and then 160.5 ml of an aqueous solution of 1.9 M $AgNO_3$ and an aqueous solution of KBr were added to the emulsion with maintaining pAg at 8.3, thus Emulsion 2 was obtained.

Emulsion 2 thus obtained was triple structural grain emulsion having the highest silver iodide content part at the intermediate shell, and the average aspect ratio of Emulsion 2 was 6.7. Tabular grains having an aspect ratio of 6 or more occupied 80% of the entire projected area of the tabular grains. Tabular grains having an aspect ratio of from 3 to 100 occupied 95% of the entire projected area of the tabular grains. The variation coefficient of the grain size was 11%, and the average grain size was 1.00 μm as equivalent-sphere diameter.

Emulsion 2 was desalted according to an ordinary flocculation method, $5.4\times10^{-4}$ mol per mol of silver of a methanol solution of a sensitizing dye was then added to Emulsion 2, and Emulsion 2 was subjected to gold, sulfur and selenium sensitization optimally in the presence of the sensitizing dye.

(3) Preparation of Emulsion 3

A solution of 0.5 M silver nitrate and a solution of 0.5 M potassium bromide each in an amount of 15 ml were added with stirring for 15 seconds by a double jet method to 1.5 liters of a 0.8% solution of low molecular weight gelatin (molecular weight: 10,000) containing 0.05 mol of potassium bromide, with maintaining the gelatin solution at 40° C. The pH of the gelatin solution at this time was 5.0. After addition, the temperature was raised to 75° C. After 220 ml of a 10% trimellited gelatin solution (trimellitation rate: 95%) was added, the emulsion was subjected to ripening for 20 minutes. Subsequently, 80 ml of a solution of 0.47 M silver nitrate was added to the emulsion.

After ripening was further performed for 10 minutes, 150 g of silver nitrate and a potassium bromide solution containing 5 mol % of potassium iodide so as to maintain pBr at 2.55 were added to the emulsion over 60 minutes by a controlled double jet method at accelerated flow rate (the final flow rate was 19 times the initial flow rate) with maintaining the potential at 0 mV. After the addition was finished, 30 ml of a 10% KI solution was added. Subsequently, 1N NaOH was added to the emulsion to adjust the pH to 7.2, and then 327 ml of a 0.5 M silver nitrate solution and 16.4 ml of a $10^{-2}$ M solution of yellow prussiate of potash (i.e., potassium ferrocyanide) were added, and then 327 ml of a 0.5 M potassium bromide solution was added to the emulsion over 20 minutes with maintaining the potential at 0 mV by a controlled double jet method (the formation of shell). The emulsion was then cooled to 35° C., washed by an ordinary flocculation method, 80 g of alkali-processed ossein gelatin deionized at 40° C. and 40 ml of a 2% $Zn(NO_3)_2$ solution were added to the emulsion and dissolved. After adjusting pH to 6.5 and pAg to 8.6, the emulsion was preserved in a cold and dark room.

The thus-obtained tabular grains were silver iodobromide grains containing 5.7 mol % of silver iodide and having a variation coefficient of an equivalent-circle diameter of projected area (hereinafter referred to as "equivalent-circle diameter") of 15%, an equivalent-circle diameter of 2.5 $\mu$m, and an average thickness of 0.10 $\mu$m (aspect ratio: 25).

Emulsion 3 was desalted according to an ordinary flocculation method, $9.3\times10^{-4}$ mol per mol of silver of a methanol solution of a sensitizing dye was then added to Emulsion 3, and Emulsion 3 was subjected chemical sensitization optimally at 60° C. with sodium thiosulfate, potassium chloroaurate and potassium thiocyanate in the presence of the sensitizing dye.

(4) Preparation of Coated Sample

On a triacetyl cellulose film support having an undercoat layer, the emulsion layer and the protective layer as shown in Table 2 below were coated to prepare a sample.

TABLE 2

| | |
|---|---|
| (1) Emulsion Layer | |
| Emulsion | $2.1 \times 10^{-2}$ mol/m$^2$ (as silver) (shown in Table 3, the dye used is also shown in Table 3) |
| Coupler | $1.5 \times 10^{-3}$ mol/m$^2$ |
| Tricresyl phosphate | 1.10 g/m$^2$ |
| Gelatin | 2.30 g/m$^2$ |
| (2) Protective Layer | |
| 2,4-Dichloro-6-hydroxy-s-triazine sodium salt | 0.08 g/m$^2$ |
| Gelatin | 1.80 g/m$^2$ |

The emulsion and sensitizing dye used in each sample are shown in Table 3 below. Each of the same one sample as shown in Table 3 was prepared ten times by the same preparing method. Each sample was subjected to sensitometric exposure for 1/100 sec. and to the following color development process.

| Step | Processing Time | Processing Temperature (° C.) | Replenishment Rate* (ml) | Tank Capacity (liter) |
|---|---|---|---|---|
| Processing Step | | | | |
| Color Development | 2 min 45 sec | 38 | 33 | 20 |
| Bleaching | 6 min 30 sec | 38 | 25 | 40 |
| Washing | 2 min 10 sec | 24 | 1,200 | 20 |
| Fixing | 4 min 20 sec | 38 | 25 | 30 |
| Washing (1) | 1 min 05 sec | 24 | counter-current system from (2) to (1) | 10 |
| Washing (2) | 1 min 00 sec | 24 | 1,200 | 10 |
| Stabilization | 1 min 05 sec | 38 | 25 | 10 |
| Drying | 4 min 20 sec | 55 | | |

Replenishment rate: per 1 meter of 35 mm wide

The composition of each processing solution is described below.

| | Mother Solution (g) | Replenisher (g) |
|---|---|---|
| Color Developing Solution | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-Ethyl-N-β-hydroxyethyl-amino)-2-methylaniline sulfate | 4.5 | 5.5 |
| Water to make | 1.01 | 1.01 |
| pH | 10.05 | 10.05 |
| Bleaching Solution | | |
| Sodium ethylenediaminetetra-acetato ferrate trihydrite | 100.0 | 120.0 |
| Disodium ethylenediamine-tetraacetate | 10.0 | 11.0 |
| Ammonium bromide | 140.0 | 160.0 |
| Ammonium nitrate | 30.0 | 35.0 |
| Aqueous ammonia (27%) | 6.5 ml | 4.0 ml |
| Water to make | 1.01 | 1.01 |
| pH | 6.0 | 5.7 |
| Fixing Solution | | |
| Sodium ethylenediaminetetra-acetate | 0.5 | 0.7 |
| Sodium sulfite | 7.0 | 8.0 |
| Sodium bisulfite | 5.0 | 5.5 |
| Aqueous solution of ammonium thiosulfate (70%) | 170.0 ml | 200.0 ml |
| Water to make | 1.01 | 1.01 |
| pH | 6.7 | 6.6 |
| Stabilizing Solution | | |
| Formalin (37%) | 2.0 ml | 3.0 ml |
| Polyoxyethylene-p-monononyl-phenyl ether (polymerization degree: 10) | 0.3 | 0.45 |
| Disodium ethylenediaminetetra-acetate | 0.05 | 0.08 |
| Water to make | 1.01 | 1.01 |
| pH | 5.8–8.0 | 5.8–8.0 |

The density of a processed sample was measured through a green filter and fresh sensitivity was evaluated. The reciprocal of the exposure amount required to give density of fog density +0.2 is taken as sensitivity, and the sensitivity fluctuation was expressed by % taking the average value of sensitivity of each sample as 100.

Results of Sensitivity Fluctuation Width

The results of sensitivity fluctuation are shown in Table 3 below.

TABLE 3

| Example No. | Emulsion | Dye No. | Fluctuation of Sensitivity (%) | Remarks |
|---|---|---|---|---|
| 25 | Emulsion 0 | SS-4 | 12 | Comparison |
| 26 | Emulsion 0 | (7) | 7 | Invention |
| 27 | Emulsion 0 | SS-7 | 13 | Comparison |
| 28 | Emulsion 0 | (55) | 10 | Invention |
| 29 | Emulsion 0 | SS-8 | 13 | Comparison |
| 30 | Emulsion 0 | (105) | 11 | Invention |
| 31 | Emulsion 1 | SS-4 | 12 | Comparison |
| 32 | Emulsion 1 | (7) | 4 | Invention |
| 33 | Emulsion 1 | SS-7 | 13 | Comparison |
| 34 | Emulsion 1 | (55) | 8 | Invention |
| 35 | Emulsion 1 | SS-8 | 13 | Comparison |
| 36 | Emulsion 1 | (105) | 9 | Invention |
| 37 | Emulsion 2 | SS-4 | 12 | Comparison |
| 38 | Emulsion 2 | (7) | 2 | Invention |
| 39 | Emulsion 2 | SS-7 | 13 | Comparison |
| 40 | Emulsion 2 | (55) | 4 | Invention |
| 41 | Emulsion 2 | SS-8 | 13 | Comparison |
| 42 | Emulsion 2 | (105) | 7 | Invention |
| 43 | Emulsion 3 | SS-4 | 12 | Comparison |
| 44 | Emulsion 3 | (7) | 1 | Invention |
| 45 | Emulsion 3 | 55-7 | 13 | Comparison |
| 46 | Emulsion 3 | (55) | 3 | Invention |
| 47 | Emulsion 3 | SS-8 | 13 | Comparison |
| 48 | Emulsion 3 | (105) | 6 | Invention |

It is clearly seen from the results in Table 3 that the sensitizing dyes according to the present invention are less in sensitivity fluctuation and extraordinarily excellent as compared with the comparative sensitizing dyes. As the aspect ratio increases from Emulsion 0 of octagonal grains to Emulsion 2, Emulsion 3 of tabular grains, the fluctuation width of the sensitizing dyes according to the present invention lessens conspicuously. Contrary to this, the fluctuation width of the comparative sensitizing dyes hardly change. Further, tabular grain shaving an aspect ratio of 3 or more are particularly excellent, and 8 or more are further excellent. Thus, emulsions and photographic materials without unevenness among production lots can be obtained by the sensitizing dyes and/or the producing methods according to the present invention.

Example 3

Preparation of PET Support

PET having an intrinsic viscosity IV=0.66 (measured in phenol/tetrachloroethane (6/4 by weight) at 25° C.) was obtained according to ordinary method with terephthalic acid and ethylene glycol. After the obtained PET was pelletized and dried at 130° C. for 4 hours, melted at 300° C., extruded from T-die, and rapidly cooled, thereby an unstretched film having a film thickness after thermal fixation of 175 μm was obtained.

The film was stretched to 3.3 times in the machine direction (i.e., the lengthwise direction) with rollers having different peripheral speeds, then 4.5 times in the transverse direction (i.e., the crosswise direction) by means of a tenter. The temperatures at that time were 110° C. and 130° C. respectively. Subsequently, the film was subjected to thermal fixation at 240° C. for 20 seconds, then relaxation by 4% in the transverse direction at the same temperature. The chuck part of the tenter was then slit, and both edges of the film were knurled. The film was wound up at 4 kg/cm$^2$, thereby a roll of film having a thickness of 175 μm was obtained.

Corona Discharge Treatment of Support Surface

Both surfaces of the support were put under room temperature and corona discharge treatment was performed at 20 m/min with a solid state corona treating apparatus model 6KVA manufactured by Piller Co., Ltd., From the reading of electric current and voltage, treatment applied to the support at that time was revealed to be 0.375 kV×A×min/m$^2$. The frequency at treatment at that time was 9.6 kHz and the gap clearance between the electrode and the dielectric roll was 1.6 mm.

Preparation of Undercoated Support

Preparation of Coating Solution A for Undercoating

To 200 ml of polyester copolymer water dispersion Pesresin A-515GB (30%, manufactured by Takamatsu Yushi Co., Ltd.) were added 1 g of polystyrene fine particles (average particle diameter: 0.2 μm), and 20 ml of Surfactant 1 (1 wt %). Distilled water was added to the above mixture to make the volume 1,000 ml, and this was designated coating solution A for undercoating.

Preparation of Coating Solution B for Undercoating

To 680 ml of distilled water were added 200 ml of styrene/butadiene copolymer water dispersion (styrene/butadiene/itaconic acid=47/50/3 (by weight), concentration: 30 wt %) and 0.1 g of polystyrene fine particles (average particle diameter: 2.5 μm), and further distilled water was added to the above mixture to make the volume 1,000 ml, and this was designated coating solution B for undercoating.

Preparation of Coating Solution C for Undercoating

Ten (10) grams of inert gelatin was dissolved in 500 ml of distilled water, and 40 g of water dispersion of fine particles of stannic oxide/antimony oxide composite (40 wt %) disclosed in JP-A-61-20033 was added thereto. Distilled water was added to the above mixture to make the volume 1,000 ml, and this was designated coating solution C for undercoating.

Preparation of Undercoated Support

On the support having been subjected to corona discharge treatment, coating solution A for undercoating was coated by means of a bar coater in a wet coating amount of 5 ml/m$^2$ and dried at 180° C. for 5 minutes. The dry film thickness was about 0.3 μm. The back surface of this support was subjected to corona discharge treatment, then coating solution B for undercoating was coated on the support by means of a bar coater in a wet coating amount of 5 ml/m$^2$ so as to obtain the dry film thickness of about 0.3 μm, and the support was dried at 180° C. for 5minutes. Further, coating solution C for undercoating was coated thereon by means of a bar coater in a wet coating amount of 3 ml/m$^2$ so as to obtain the dry film thickness of about 0.03 μm, and the support was dried at 180° C. for 5 minutes. Thus, an undercoated support was prepared.

Preparation of Silver Organic Acid Dispersion

While stirring 43.8 g of behenic acid (manufactured by Henkel Co., trade name: Edenor C22-85R), 730 ml of distilled water, and 60 ml of butanol at 79° C., 117 ml of 1 N NaOH aqueous solution was added thereto over 55 minutes and the mixture was allowed to reaction for 240 minutes. Then, 112.5 ml of an aqueous solution containing 19.2 g of silver nitrate was added thereto over 45 seconds and the solution was allowed to stand for 20 minutes, and then the temperature was lowered to 30° C. The solid content was then filtered by suction. The solid content was washed with water until the conductivity of the filtrate reached 30 mS/cm. The thus-obtained solid content was not dried and treated as a wet cake. Seven point four (7.4) grams of polyvinyl alcohol (trade name: PVA-205) and water were added to the wet cake of the amount corresponding to 100 g of dried solid content to make the entire amount 385 g, and then preliminarily dispersed in a homomixer. The preliminarily dispersed starting solution was treated three times using a disperser (trade name: Micro-fluidizer M-110S-EH equipped with G10Z interaction chamber, manufactured by Micro Fluidex International Corp.). Pressure of the disperser was adjusted to 1,750 kg/cm$^2$. Thus, silver behenate dispersion B was obtained. Silver behenate grains contained in the thus-obtained silver behenate dispersion were acicular grains having an average short axis length of 0.04 $\mu$m, average long axis length of 0.8 $\mu$m, and variation coefficient of 30%. Grain size was measured by Master Sizer X (manufactured by Malvern Instruments Ltd.). Coiled heat exchangers were respectively installed before and after the interaction chamber. The desired temperature of dispersion was set by adjusting the temperature of the cooling medium.

Preparation of 25% Dispersion of Reducing Agent

Water (176 g) was added to 80 g of 1,1-bis(2-hydroxy-3,5-dimethylphenyl)-3,5,5-trimethylhexane and 64 g of a 20% aqueous solution of modified Poval Mp203 (manufactured by Kuraray Co., Ltd.), and thoroughly mixed to make a slurry. Zirconia beads (800 g) having an average diameter of 0.5 mm were added to a reaction vessel with the above-obtained slurry and dispersed in a disperser (¼ G sand grinder mill, manufactured by Imex Co., Ltd.) for 5 hours, thereby the dispersion of the reducing agent was obtained. The particles of the reducing agent contained in the thus-obtained reducing agent dispersion had an average diameter of 0.72 $\mu$m.

Preparation of 20% Dispersion of Mercapto Compound

Water (224 g) was added to 64 g of 3-mercapto-4-phenyl-5-heptyl-1,2,4-triazole and 32 g of a 20% aqueous solution of modified Poval $Mp_{203}$ (manufactured by Kuraray Co., Ltd.), and thoroughly mixed to make a slurry. Zirconia beads (800 g) having an average diameter of 0.5 mm were added to a reaction vessel with the above-obtained slurry and dispersed in a disperser (¼ G sand grinder mill, manufactured by Imex Co., Ltd.) for 10 hours, thereby the dispersion of the mercapto compound was obtained. The particles of the mercapto compound contained in the thus-obtained mercapto compound dispersion had an average particle diameter of 0.67 $\mu$m.

Preparation of 30% Dispersion of Organic Polyhalogen Compound

Water (224 g) was added to 48 g of tribromomethylphenylsulfone, 48 g 3-tribromomethylsulfonyl-4-phenyl-5-tridecyl-1,2,4-triazole, and 48 g of a 20% aqueous solution of modified Poval MP203 (manufactured by Kuraray Co., Ltd.), and thoroughly mixed to make a slurry. Zirconia beads (800 g) having an average diameter of 0.5 mm were added to a reaction vessel with the above-obtained slurry and dispersed in a disperser (¼ G sand grinder mill, manufactured by Imex Co., Ltd.) for 5 hours, thereby a dispersion of the organic polyhalogen compound was obtained. The particles of the polyhalogen compound contained in the thus-obtained polyhalogen compound dispersion had an average particle diameter of 0.74 $\mu$m.

Preparation of Methanol Solution of Phthalazine Compound

6-Isopropylphthalazine (26 g) was dissolved in 100 ml of methanol and used.

Preparation of 20% Dispersion of Pigment

Water (250 g) was added to 64 g of C.I. Pigment Blue 60 and 6.4 g of Demol N (manufactured by Kao Corporation), and thoroughly mixed to make a slurry. Zirconia beads (800 g) having an average diameter of 0.5 mm were added to a reaction vessel with the above-obtained slurry and dispersed in a disperser (¼ G sand grinder mill, manufactured by Imex Co., Ltd.) for 25 hours, thereby the dispersion of the pigment was obtained. The particles of the pigment contained in the thus-obtained pigment dispersion had an average particle diameter of 0.21 $\mu$m.

Preparation of Silver Halide Grain 1

To 1,421 ml of distilled water was added 6.7 ml of a 1 wt % potassium bromide solution, further 8.2 ml of 1 N nitric acid and 21.8 g of phthalated gelatin were added. This mixed solution was stirred in a titanium-coated stainless reaction vessel with maintaining the temperature at 35° C. Solution a1 (37.04 g of silver nitrate was diluted with distilled water to make 159 ml) and solution b1 (32.6 g of potassium bromide was diluted with distilled water to make 200 ml) were prepared. The entire amount of solution a1 was added to the reaction vessel at a constant flow rate by a controlled double jet method with maintaining pAg at 8.1 over 1 minute (solution b1 was added by a controlled double jet method). Then, 30 ml of a 3.5% hydrogen peroxide aqueous solution was added, further, 336 ml of a 3 wt % benzimidazole aqueous solution was added. Solution a2 (solution a1 was again diluted with distilled water to make 317.5 ml) and solution b2 (dipotassium hexachloroiridate was dissolved so as to make $1\times10^{-4}$ mol per mol of the silver of solution b1, diluted with distilled water to reach the final volume of 2 times solution b1, i.e., 400 ml) were prepared. The entire amount of solution a2 was added to the reaction vessel at a constant flow rate by a controlled double jet method with maintaining pAg at 8.1 over 10 minutes (solution b2 was added by a controlled double jet method). Then, 50 ml of a 0.5% methanol solution of 2-mercapto-5-methylbenzimidazole was added, further, pAg was raised to 7.5 with silver nitrate, pH was adjusted with 1 N sulfuric acid to 3.8, and stirring was stopped. The reaction solution was subjected to precipitation, desalting and washing processes, 3.5 g of deionized gelatin was added, and 1 N sodium hydroxide was added to adjust pH to 6.0 and pAg to 8.2, thereby silver halide dispersion was obtained. The grains in thus-prepared silver halide emulsion were pure silver bromide grains having an average equivalent-sphere diameter of 0.031 $\mu$m and the variation coefficient of equivalent-sphere of 11%. Grain size was average of 1,000 grains obtained by electron microscope. {100} Plane ratio of this grain was 85% obtained by the Kubelka-Munk method. The temperature of the above emulsion was raised to 50° C. with stirring, then 5 ml of a 0.5 wt % methanol solution of N,N'-dihydroxy-N", N"-diethylmelamine and 5 ml of a 3.5 wt % methanol solution of phenoxyethanol were added thereto, and 1 minute after, $3\times10^{-5}$ mol per mol of the silver of sodium benzenethiosulfonate was added. Further 2 minutes after, a methanol solution of comparative sensitizing dye SS-4 was added in an amount of $5\times10^{-3}$ Mol per mol of the silver, and further 2 minutes after, $5\times10^{-5}$ mol per mol of the silver of a tellurium compound was added and the reaction solution was subjected to ripening for 50 minutes. Immediately before completion of ripening, 2-mercapto-5-methylbenzimidazole was added in an amount of $1\times10^{-3}$ mol per mol of the silver. The temperature was lowered and chemical sensitization was terminated. Thus, silver halide grain 1 was prepared.

Preparation of Silver Halide Grain 2

Phthalated gelatin (22 g) and 30 mg of potassium bromide were dissolved in 700 ml of water, pH was adjusted to 5.0 at 35° C. An aqueous solution (159 ml) containing 18.6 g of silver nitrate and 0.9 g of ammonium nitrate, and an aqueous solution containing potassium bromide and potassium iodide in a ratio of 92/8 were added to the foregoing solution by a controlled double jet method over 10 minutes with maintaining pAg at 7.7. Subsequently, 476 ml of an aqueous solution containing 55.4 g of silver nitrate and 2 g of ammonium nitrate, and 1 liter of an aqueous solution containing $1\times10^{-5}$ mol of dipotassium hexachloroiridate and 1 mol of potassium bromide were added to the foregoing solution by a controlled double jet method over 30 minutes with maintaining pAg at 7.7. Subsequently, 1 g of 4-hydroxy-6-methyl-1,3,3a, 7-tetraazaindene was added thereto, and then the pH was lowered, and the reaction solution was subjected to coagulation precipitation, and desalted. Then, 0.1 g of phenoxyethanol was added to adjust pH to 5.9 and pAg to 8.2, thereby the preparation of silver iodobromide grain was terminated. The thus-obtained silver halide grains were cubic grains having an iodine content: core 8 mol %, average 2 mol %, average grain size: 0.05 μm, projected area variation coefficient: 8%, and {100} plane ratio: 88%. The temperature of the thus-obtained silver halide grains was raised to 60° C., 85 mmol of sodium thiosulfate, $1.1\times10^{-5}$ mol per mol of the silver of 2,3,4,5, 6-pentafluorophenyldiphenylphosphineselenide, $1.5\times10^{-5}$ mol per mol of the silver of a tellurium compound, $3.5\times10^{-8}$ mol per mol of the silver of chloroauric acid, and $2.7\times10^{-4}$ mol per mol of the silver of thiocyanic acid were added to the above silver halide grains and ripened for 120 minutes, then rapidly cooled to 40° C. Comparative dye SS-4 in an amount of $1\times10^{-4}$ mol and 2-mercapto-5-methylbenzimidazole in an amount of $5\times10^{-4}$ mol were added thereto and the reaction solution was rapidly cooled to 30° C. to thereby obtain silver halide emulsion 2.

Preparation of Coating Solution for Emulsion Layer

Coating Solution for Emulsion Layer No. 1

The above-obtained silver organic acid dispersion (103 g) and 5 g of a 20 wt % aqueous solution of polyvinyl alcohol PVA-205 (manufactured by Kuraray Co., Ltd.) were mixed and maintained at 40° C. The above-prepared 25% reducing agent dispersion (23.2 g), 4.8 g of a 5% water dispersion of C.I. Pigment Blue 60, 10.7 g of a 30% water dispersion of organic polyhalogen compound, and 3.1 g of a 20% dispersion of mercapto compound were added to the above mixed solution. After that, 106 g of 40 wt % SBR latex purified by ultrafiltration (UF) and maintained at 40° C. was added thereto and stirred thoroughly, 6 ml of a methanol solution of a phthalazinone compound was then added, thereby a solution containing a silver organic acid was obtained. Five (5) grams of silver halide grain 1 and 5 g of silver halide grain 2 had been mixed thoroughly in advance, then this solution was mixed with the silver organic acid-containing solution in a static mixer immediate before coating to thereby prepare an emulsion layer coating solution. This coating solution was fed to a coating die in a coating silver amount of 1.4 g/m$^2$.

The above emulsion layer coating solution was revealed to have viscosity of 85 (mPa·s) at 40° C. measured by Model B viscometer (manufactured by Tokyo Keiki Co., Ltd.). The viscosity of the coating solution measured by RFS Fluid Spectrometer (manufactured by Rheometrics Far East Co.) at 25° C. was 1,500, 220, 70, 40, 20 (mPa·s) at shear rate of 0.1, 1, 10, 100, 1,000 (1/sec), respectively.

Further, UF purified SBR latex was obtained in the following manner. SBR latex shown below was diluted with distilled water to 10 times, and purified by module FS03-FC-FUY03A1 for UF-purification (Daisen Membrane System Co., Ltd.) until the ionic conductivity becomes 1.5 mS/cm. The concentration of the latex at this time was 40%.

SBR Latex

Latex of -St (68)-Bu (29)-AA (3)-

Average particle size: 0.1 μm, concentration: 45 wt %, ionic conductivity: 4.2 mS/cm (ionic conductivity was measured using a conductometer CM-30S (manufactured by Toa Denpa Kogyo Co., Ltd., starting solution of the latex (40 wt %) was measured at 25° C.), pH: 8.2

Preparation of Intermediate Layer Coating Solution of Emulsion Surface

Preparation of Intermediate Layer Coating Solution

To 772 g of a 10 wt % aqueous solution polyvinyl alcohol PVA-205 (manufactured by Kuraray Co., Ltd.) and 226 g of a 27.5% solution of latex of methyl methacrylate/styrene/2-ethylhexyl acrylate/hydroxyethyl methacrylate/acrylic acid copolymer (copolymerization weight ratio: 59/9/26/5/1) were added 2 ml of a 5 wt % aqueous solution of Aerosol OT (manufactured by American Cyanamide Co.), 4 g of benzyl alcohol, 1 g of 2,2,4-trimethyl-1,3-pentanediol monoisobutyrate, and 10 mg of benzisothiazolinone to make an intermediate layer coating solution. The coating solution was fed to a coating die so as to reach the coating amount of 5 ml/m$^2$. The viscosity of the coating solution was 21 (mPa×s) at 40° C. measured by Model B viscometer.

Preparation of First Protective Layer Coating Solution of Emulsion Surface

First Protective Layer Coating Solution No. 1

Inert gelatin (80 g) was dissolved in water, 138 ml of a 10% methanol solution of phthalic acid, 28 ml of 1 N sulfuric acid, 5 ml of a 5 wt % aqueous solution of Aerosol OT (manufactured by American Cyanamide Co.), and 1 g of phenoxyethanol were added thereto. Water was added to make the total amount 1,000 g, thereby a first protective layer coating solution was obtained. The coating solution was fed to a coating die in coating amount of 10 ml/m$^2$. The viscosity of the coating solution was 17 (mPa·s) at 40° C. measured by Model B viscometer.

Preparation of Second Protective Layer Coating Solution of Emulsion Surface

Second Protective Layer Coating Solution

Inert gelatin (100 g) was dissolved in water, 20 ml of a 5% solution of potassium N-perfluorooctylsulfonyl-N-propylalanine, 16 ml of a 5 wt % aqueous solution of Aerosol OT (manufactured by American Cyanamide Co.), 25 g of polymethyl methacrylate fine particles (average particle size: 4.0 μm), 44 ml of 1 N sulfuric acid, and 10 mg of benzisothiazolinone were added thereto. Water was added to make the total amount 1,555 g, then 445 ml of an aqueous solution containing 4 wt % of chrome alum and 0.67 wt % of phthalic acid was mixed using a static mixer immediately before coating, thereby a second protective layer coating solution was obtained. The coating solution was fed to a coating die in coating amount of 10 ml/m$^2$. The viscosity of the coating solution was 9 (mPa·s) at 40° C. measured by Model B viscometer.

Preparation of Back Coating Layer

Preparation of Solid Fine Particle Dispersion Solution of Basic Precursor

A basic precursor compound (64 g) and 10 g of surfactant Demol N (manufactured by Kao Corporation) were mixed with 246 ml of distilled water. The mixed solution was dispersed using beads in a sand mill (¼ Gallon sand grinder mill, manufactured by Imex Co. Ltd.), thereby a solid fine particle dispersion solution of a basic precursor having an average particle size of 0.2 μm was obtained.

Preparation of Solid Fine Particle Dispersion Solution of Dye

A cyanine dye compound (9.6 g) and 5.8 g of sodium p-alkylbenzenesulfonate were mixed with 305 ml of distilled water. The mixed solution was dispersed using beads in a sand mill (¼ Gallon sand grinder mill, manufactured by Imex Co., Ltd.), thereby the solid fine particle dispersion solution of the dye having an average particle size of 0.2 μm was obtained.

Preparation of Antihalation Layer Coating Solution

Gelatin (17 g), 9.6 g of polyacrylamide, 70 g of the above solid fine particle dispersion solution of the basic precursor, 56 g of the above solid fine particle dispersion solution of the dye, 1.5 g of polymethyl methacrylate fine particles (average particle size: 6.5 μm), 2.2 g of sodium polyethylenesulfonate, 0.2 g of a 1% aqueous solution of coloring dye compound, and 844 ml of $H_2O$ were mixed. Thus, an antihalation layer coating solution was prepared.

Preparation of Protective Layer Coating Solution

To a reaction vessel maintained at 40° C. were added and mixed 50 g of gelatin, 0.2 g of sodium polystyrenesulfonate, 2.4 g of N,N'-ethylenebis (vinyl sulfone acetamide), 1 g of sodium t-octylphenoxyethoxyethanesulfonate, 30 mg of benzisothiazolinone, 32 mg of $C_8F_{17}SO_3K$, 64 mg of $C_8F_{17}SO_2N(C_3H_7)—(CH_2CH_2O)_4(CH_2)_4—SO_3Na$, and 950 ml of $H_2O$ to prepare a protective layer coating solution.

Surfactant 1

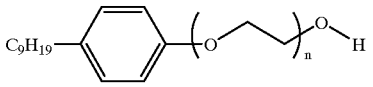

n = 8.5

Tellurium compound

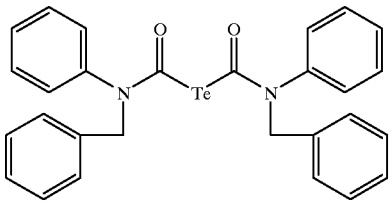

Basic precursor compound

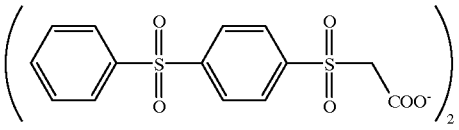

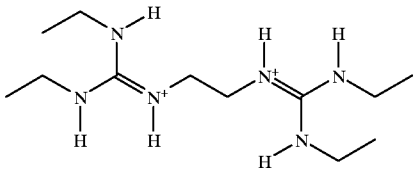

-continued

Cyanine dye compound

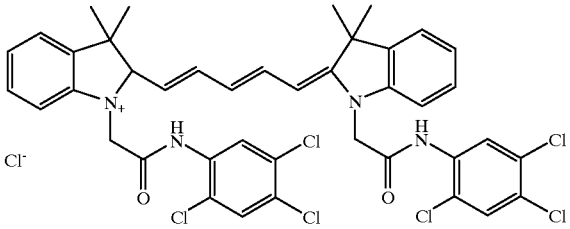

Coloring dye compound

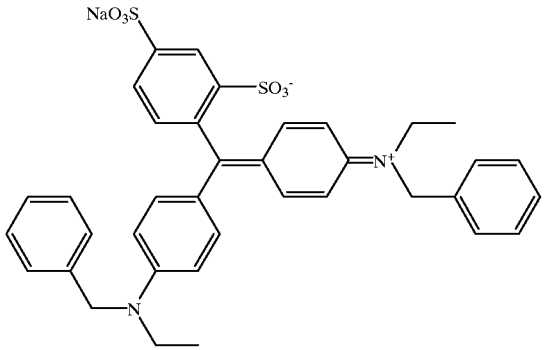

Preparation of Photothermographic Material

On the above undercoated support, the antihalation layer coating solution and the protective layer coating solution were simultaneously multilayer-coated and dried in such a manner that the coating amount of the solid content of the solid fine grain dye of the antihalation layer coating solution became 0.04 g/m$^2$ and the gelatin coating amount of the protective layer coating solution became 1 g/m$^2$. After the antihalation backing layer was formed, an emulsion layer, an intermediate layer, a first protective layer and a second protective layer were simultaneously multilayer-coated by slide coating on the opposite side of the backing layer side in this order from the undercoating side, thereby the photothermographic material was prepared. After the back side was coated, emulsion side was coated without winding up.

Coating speed was 160 m/min. The distance between the tip of the coating die and the support was 0.18 mm. The pressure in the reduced pressure chamber was set lower than atmospheric pressure by 392 Pa. In the subsequent chilling zone, air of dry-bulb temperature of 18° C. and wet-bulb temperature of 12° C. was blown at 7 m/sec for 30 seconds. After the coating solution was dried, dry air of dry-bulb temperature of 30° C. and wet-bulb temperature of 18° C. was blown at helical floating type drying zone at blowout wind speed from the hole of 20 m/second for 20 seconds, thereby the solvent in the coating solution was evaporated. Thus, Sample No. 1 was obtained.

Samples shown in Table 4 below were prepared using comparative dyes SS-5, SS-7, SS-8 in place of comparative dye SS-4, and the Dyes (7), (12), (55) and (105) according to the present invention. Each of the same one sample as shown in Table 4 was prepared ten times by the same preparing method. Each sample was subjected to sensitometric exposure with a laser sensitometer equipped with 660 nm diode, and then development process at122° C. for 19 seconds. The image obtained was evaluated using a densitometer. The sensitivity (the reciprocal of the exposure amount giving the density higher than Dmin by 1) fluctuation width was expressed by % taking the average value of sensitivity of each sample as 100.

Results of Sensitivity Fluctuation Width

The results of sensitivity fluctuation are shown in Table 4 below.

TABLE 4

| Sample No. | Dye No. | Fluctuation of Sensitivity (%) | Remarks |
|---|---|---|---|
| 41 | SS-4 | 18 | Comparison |
| 42 | (7) | 2 | Invention |
| 43 | SS-5 | 20 | Comparison |
| 44 | (12) | 2 | Invention |
| 45 | SS-7 | 20 | Comparison |
| 46 | (55) | 4 | Invention |
| 47 | SS-8 | 21 | Comparison |
| 48 | (105) | 6 | Invention |

It is clearly seen from the results in Table 3 that the sensitivity fluctuation width of the comparative sensitizing dyes are particularly large in photothermographic materials. The sensitizing dyes according to the present invention are less in sensitivity fluctuation as compared with the comparative sensitizing dyes and particularly excellent in photothermographic materials. Thus, emulsions and photographic materials without unevenness among production lots can be obtained by the sensitizing dyes and/or the producing methods according to the present invention and particularly excellent in photothermographic materials.

Example 4

The same comparison of dyeing and sensitivity fluctuation width as in Example 1 was performed using the color reversal photographic materials disclosed in Example 1 of JP-A-7-92601 and JP-A-11-160828, the color paper photographic materials disclosed in Example 1 of JP-A-6-347944 and printing materials disclosed in Example 1 of JP-A-8-292512. The same results as in Example 1 were obtained and it was confirmed that the present invention was also useful in these materials.

Example 5

The same comparison of sensitivity fluctuation width as in Examples 1, 2 and 3 was performed using the color negative photographic materials disclosed in Example 5 of JP-A-8-29904, the X-ray photographic materials disclosed in Example 1 of JP-A-8-122954, the instant photographic materials disclosed in Example 1 of JP-A-2000-284442, the photothermographic materials disclosed in Examples 5 and 6 of JP-12-122206, and the photothermographic materials disclosed in Example 1 of Japanese Patent application No.2000-89436. The same results as in Examples 1, 2 and 3 were obtained and it was confirmed that the present invention was also useful in these materials.

Effect of the Invention

By the specific sensitizing dyes and the method of adding such specific sensitizing dyes to an emulsion according to the present invention, a silver halide photographic emulsion and a silver halide photographic material stable in quality, and/or improved in dyeing property, and/or capable of reducing the amount of an organic solvent to be added can be obtained.

While the invention has been described in detail and with reference to specific examples thereof, it will be apparent to one skilled in the art that various changes and modifications can be made therein without departing from the spirit and scope thereof.

What is claimed is:

1. A silver halide photographic emulsion which comprises at least one dye or sensitizing dye having at least one organic counter ion, said at least one dye or sensitizing dye being selected from the group consisting of a merocyanine dye and a rhodacyanine dye.

2. The silver halide photographic emulsion as claimed in claim 1, wherein said dye or sensitizing dye has at least two anionic groups and/or at least two positive organic counter ions.

3. The silver halide photographic emulsion as claimed in claim 1, wherein said dye or sensitizing dye has at least one carboxyl group and at least one sulfo group.

4. The silver halide photographic emulsion as claimed in claim 1, wherein said dye or sensitizing dye is a merocyanine dye having at least one carboxyl group and at least one sulfo group.

5. A silver halide photographic material which comprises at least one silver halide photographic emulsion layer containing at least one dye or sensitizing dye having at least one organic counter ion, said at least one dye or sensitizing dye being selected from the group consisting of a merocyanine dye and a rhodacyanine dye.

6. A method of producing a silver halide photographic emulsion, which comprises the step of adding at least one dye or sensitizing dye having at least one organic counter ion to the silver halide photographic emulsion as the solution of an organic solvent, said at least one dye or sensitizing dye being selected from the group consisting of a merocyanine dye and a rhodacyanine dye.

7. The silver halide photographic emulsion as claimed in claim 1, wherein the at least one dye or sensitizing dye is present in an amount of from $1\times10^{-6}$ to $8\times10^{-2}$ mol per mol of silver halide.

8. The silver halide photographic material as claimed in claim 5, wherein the at least one dye or sensitizing dye is present in an amount of from $1\times10^{-6}$ to $8\times10^{-2}$ mol per mol of silver halide.

9. The method of claim 6, wherein the at least one dye or sensitizing dye is present in an amount of from $1\times10^{-6}$ to $8\times10^{-2}$ mol per mol of silver halide.

10. The silver halide photographic emulsion as claimed in claim 1, wherein the at least one dye or sensitizing dye is a merocyanine dye.

11. The silver halide photographic material as claimed in claim 5, wherein the at least one dye or sensitizing dye is a merocyanine dye.

12. The method of claim 6, wherein the at least one dye or sensitizing dye is a merocyanine dye.

13. The silver halide photographic emulsion as claimed in claim 1, wherein the dye is a rhodacyanine dye.

14. The silver halide photographic material as claimed in claim 5, wherein the dye is a rhodacyanine dye.

15. The method of claim 6, wherein the at least one dye or sensitizing dye is a rhodacyanine dye.

16. The silver halide photographic material as claimed in claim 5, wherein the at least one dye or sensitizing dye is a merocyanine dye or a rhodacyanine dye.

* * * * *